US008753165B2

(12) United States Patent
Weston

(10) Patent No.: US 8,753,165 B2
(45) **Date of Patent: *Jun. 17, 2014**

(54) WIRELESS TOY SYSTEMS AND METHODS FOR INTERACTIVE ENTERTAINMENT

(75) Inventor: Denise Chapman Weston, Wakefield, RI (US)

(73) Assignee: MQ Gaming, LLC, Irvine, CA (US)

( * ) Notice: Subject to any disclaimer, the term of this patent is extended or adjusted under 35 U.S.C. 154(b) by 9 days.

This patent is subject to a terminal disclaimer.

(21) Appl. No.: 12/355,489

(22) Filed: Jan. 16, 2009

(65) Prior Publication Data

US 2009/0124165 A1 May 14, 2009

Related U.S. Application Data

(63) Continuation of application No. 11/241,812, filed on Sep. 30, 2005, now Pat. No. 7,488,231, which is a continuation of application No. 10/045,582, filed on Oct. 22, 2001, now Pat. No. 7,066,781.

(60) Provisional application No. 60/241,893, filed on Oct. 20, 2000.

(51) Int. Cl.
*A63H 33/00* (2006.01)

(52) U.S. Cl.
USPC ..... 446/175; 446/297; 446/484; 340/10.1; 340/10.41

(58) Field of Classification Search
USPC ..... 446/175, 297, 299–302, 269, 484
See application file for complete search history.

(56) References Cited

U.S. PATENT DOCUMENTS

| | | | |
|---|---|---|---|
| 973,105 | A | 10/1910 | Chamberlain, Jr. |
| 1,661,058 | A | 2/1928 | Theremin |
| 1,789,680 | A | 1/1931 | Gwinnett |
| 2,001,366 | A | 5/1935 | Mittelman |
| 2,752,725 | A | 7/1956 | Unsworth |
| 2,902,023 | A | 9/1959 | Waller |

(Continued)

FOREIGN PATENT DOCUMENTS

| | | |
|---|---|---|
| CA | 2520126 | 9/2010 |
| CN | 1032246 | 4/1989 |

(Continued)

OTHER PUBLICATIONS

"Raise High the 3D Roof Beam: Kids shape these PC games as they go along." by Anne Field, article as featured in Business Week 2001.

(Continued)

*Primary Examiner* — Dmitry Suhol
*Assistant Examiner* — Alex F. R. P. Rada, II
(74) *Attorney, Agent, or Firm* — Knobbe, Martens, Olson & Bear LLP

(57) ABSTRACT

A playmate toy or similar children's toy is provided having associated wireless, batteryless ID tag that can be read from and/or written to using a radio-frequency communication protocol. The tag is mounted internally within a cavity of the toy and thereby provides wireless communication of stored information without requiring removal and reinsertion of the tag. In this manner, a stuffed animal or other toy can be quickly and easily identified non-invasively, without damaging the toy. Additional information (e.g., unique personality traits, special powers, skill levels, etc.) can also be stored on the ID tag, thus providing further personality enhancement, input/output programming, simulated intelligence and/or interactive gaming possibilities.

56 Claims, 20 Drawing Sheets

(56) References Cited

U.S. PATENT DOCUMENTS

| | | | |
|---|---|---|---|
| 3,135,512 | A | 6/1964 | Taylor |
| 3,336,030 | A | 8/1967 | Martell et al. |
| 3,395,920 | A | 8/1968 | Moe |
| 3,454,920 | A | 7/1969 | Mehr |
| 3,456,134 | A | 7/1969 | Ko |
| 3,468,533 | A | 9/1969 | House, Jr. |
| 3,474,241 | A | 10/1969 | Kuipers |
| D220,268 | S | 3/1971 | Kliewer |
| 3,572,712 | A | 3/1971 | Vick |
| 3,633,904 | A | 1/1972 | Kojima |
| 3,660,648 | A | 5/1972 | Kuipers |
| 3,707,055 | A | 12/1972 | Pearce |
| 3,795,805 | A | 3/1974 | Swanberg et al. |
| 3,843,127 | A | 10/1974 | Lack |
| 3,949,364 | A | 4/1976 | Clark et al. |
| 3,949,679 | A | 4/1976 | Barber |
| 3,973,257 | A | 8/1976 | Rowe |
| 3,978,481 | A | 8/1976 | Angwin et al. |
| 3,997,156 | A | 12/1976 | Barlow et al. |
| 4,009,619 | A | 3/1977 | Snymann |
| 4,038,876 | A | 8/1977 | Morris |
| 4,055,341 | A | 10/1977 | Martinez |
| 4,063,111 | A | 12/1977 | Dobler |
| 4,153,250 | A | 5/1979 | Anthony |
| 4,166,406 | A | 9/1979 | Maughmer |
| 4,171,737 | A | 10/1979 | McLaughlin |
| 4,175,665 | A | 11/1979 | Dogliotti |
| 4,205,785 | A | 6/1980 | Stanley |
| 4,231,077 | A | 10/1980 | Joyce et al. |
| 4,240,638 | A | 12/1980 | Morrison et al. |
| 4,282,681 | A | 8/1981 | McCaslin |
| 4,287,765 | A | 9/1981 | Kreft |
| 4,296,929 | A | 10/1981 | Meyer et al. |
| 4,303,978 | A | 12/1981 | Shaw |
| 4,318,245 | A | 3/1982 | Stowell et al. |
| 4,321,678 | A | 3/1982 | Krogmann |
| 4,325,199 | A | 4/1982 | McEdwards |
| 4,337,948 | A | 7/1982 | Breslow |
| 4,342,985 | A | 8/1982 | Desjardins |
| 4,402,250 | A | 9/1983 | Baasch |
| 4,412,205 | A | 10/1983 | Von Kemenczky |
| 4,425,488 | A | 1/1984 | Moskin |
| 4,443,866 | A | 4/1984 | Burgiss |
| 4,450,325 | A | 5/1984 | Luque |
| 4,503,299 | A | 3/1985 | Henrard |
| 4,514,600 | A | 4/1985 | Lentz |
| 4,514,798 | A | 4/1985 | Lesche |
| 4,540,176 | A | 9/1985 | Baer |
| 4,546,551 | A | 10/1985 | Franks |
| 4,558,604 | A | 12/1985 | Auer |
| 4,561,299 | A | 12/1985 | Orlando |
| 4,575,621 | A | 3/1986 | Dreifus |
| 4,578,674 | A | 3/1986 | Baker et al. |
| 4,595,369 | A | 6/1986 | Downs |
| 4,623,887 | A | 11/1986 | Welles |
| 4,623,930 | A | 11/1986 | Oshima |
| 4,627,620 | A | 12/1986 | Yang |
| 4,645,458 | A | 2/1987 | Williams |
| 4,672,374 | A | 6/1987 | Desjardins |
| 4,678,450 | A | 7/1987 | Scolari et al. |
| 4,695,058 | A | 9/1987 | Carter, III et al. |
| 4,695,953 | A | 9/1987 | Blair et al. |
| 4,699,379 | A | 10/1987 | Chateau et al. |
| 4,739,128 | A | 4/1988 | Grisham |
| 4,750,733 | A | 6/1988 | Foth |
| 4,761,540 | A | 8/1988 | McGeorge |
| 4,776,253 | A | 10/1988 | Downes |
| 4,787,051 | A | 11/1988 | Olson |
| 4,816,810 | A | 3/1989 | Moore |
| 4,817,950 | A | 4/1989 | Goo |
| 4,819,182 | A | 4/1989 | King et al. |
| 4,839,838 | A | 6/1989 | LaBiche et al. |
| 4,843,568 | A | 6/1989 | Krueger et al. |
| 4,846,568 | A | 7/1989 | Krueger |
| 4,849,655 | A | 7/1989 | Bennett |
| 4,851,685 | A | 7/1989 | Dubgen |
| 4,858,390 | A | 8/1989 | Kenig |
| 4,858,930 | A | 8/1989 | Sato |
| 4,862,165 | A | 8/1989 | Gart |
| 4,882,717 | A | 11/1989 | Hayakawa et al. |
| 4,891,032 | A | 1/1990 | Davis |
| 4,904,222 | A | 2/1990 | Gastgeb et al. |
| 4,910,677 | A | 3/1990 | Remedio et al. |
| 4,914,598 | A | 4/1990 | Krogmann |
| 4,918,293 | A | 4/1990 | McGeorge |
| 4,924,358 | A | 5/1990 | VonHeck |
| 4,932,917 | A | 6/1990 | Klitsner |
| 4,957,291 | A | 9/1990 | Miffitt |
| 4,960,275 | A | 10/1990 | Magon |
| 4,961,369 | A | 10/1990 | McGill |
| 4,964,837 | A | 10/1990 | Collier |
| 4,967,321 | A | 10/1990 | Cimock |
| 4,969,647 | A | 11/1990 | Mical et al. |
| 4,980,519 | A | 12/1990 | Mathews |
| 4,988,981 | A | 1/1991 | Zimmerman et al. |
| 4,994,795 | A | 2/1991 | MacKenzie |
| 5,011,161 | A | 4/1991 | Galphin |
| 5,036,442 | A | 7/1991 | Brown |
| RE33,662 | E | 8/1991 | Blair et al. |
| 5,045,843 | A | 9/1991 | Hansen |
| 5,048,831 | A | 9/1991 | Sides |
| D320,624 | S | 10/1991 | Taylor |
| 5,058,480 | A | 10/1991 | Suzuki et al. |
| 5,059,958 | A | 10/1991 | Jacobs et al. |
| 5,062,696 | A | 11/1991 | Oshima |
| 5,068,645 | A | 11/1991 | Drumm |
| D322,242 | S | 12/1991 | Cordell |
| 5,076,584 | A | 12/1991 | Openiano |
| D325,225 | S | 4/1992 | Adhida |
| 5,114,155 | A | 5/1992 | Tillery et al. |
| 5,114,344 | A | 5/1992 | Fumagalli et al. |
| 5,124,938 | A | 6/1992 | Algrain |
| 5,127,657 | A | 7/1992 | Ikezawa et al. |
| 5,128,671 | A | 7/1992 | Thomas, Jr. |
| D328,463 | S | 8/1992 | King et al. |
| 5,136,222 | A | 8/1992 | Yamamoto |
| 5,138,154 | A | 8/1992 | Hotelling |
| 5,145,446 | A | 9/1992 | Kuo |
| D331,058 | S | 11/1992 | Morales |
| 5,166,502 | A | 11/1992 | Rendleman |
| 5,170,002 | A | 12/1992 | Suzuki et al. |
| 5,175,481 | A | 12/1992 | Kanno |
| 5,177,311 | A | 1/1993 | Suzuki et al. |
| 5,178,477 | A | 1/1993 | Gambaro |
| 5,181,181 | A | 1/1993 | Glynn |
| 5,184,830 | A | 2/1993 | Okada et al. |
| 5,192,082 | A | 3/1993 | Inoue et al. |
| 5,192,823 | A | 3/1993 | Suzuki et al. |
| 5,194,006 | A | 3/1993 | Zaenglein, Jr. |
| 5,194,048 | A | 3/1993 | Briggs |
| 5,202,844 | A | 4/1993 | Kamio |
| 5,207,426 | A | 5/1993 | Inoue et al. |
| 5,212,368 | A | 5/1993 | Hara |
| 5,213,327 | A | 5/1993 | Kitaue |
| 5,223,698 | A | 6/1993 | Kapur |
| 5,231,568 | A | 7/1993 | Cohen et al. |
| D338,242 | S | 8/1993 | Cordell |
| 5,232,223 | A | 8/1993 | Dornbusch |
| 5,236,200 | A | 8/1993 | McGregor et al. |
| 5,247,651 | A | 9/1993 | Clarisse |
| D340,042 | S | 10/1993 | Copper et al. |
| 5,259,626 | A | 11/1993 | Ho |
| 5,262,777 | A | 11/1993 | Low et al. |
| D342,256 | S | 12/1993 | Payne et al. |
| 5,277,645 | A | 1/1994 | Kelley et al. |
| 5,279,513 | A | 1/1994 | Connelly |
| 5,280,744 | A | 1/1994 | DeCarlo |
| D345,164 | S | 3/1994 | Grae |
| 5,290,964 | A | 3/1994 | Hiyoshi et al. |
| 5,292,124 | A | 3/1994 | Carpenter |
| 5,292,254 | A | 3/1994 | Miller et al. |
| 5,296,871 | A | 3/1994 | Paley |
| 5,299,967 | A | 4/1994 | Gilbert |
| 5,307,325 | A | 4/1994 | Scheiber |

(56) References Cited

U.S. PATENT DOCUMENTS 5,310,192 A 5/1994 Miyake
5,317,394 A 5/1994 Hale
5,319,548 A 6/1994 Germain
5,320,358 A 6/1994 Jones
5,320,362 A 6/1994 Bear et al.
5,329,276 A 7/1994 Hirabayashi
5,332,322 A 7/1994 Gambaro
5,339,095 A 8/1994 Redford
D350,736 S 9/1994 Takahashi et al.
D350,782 S 9/1994 Barr
D351,430 S 10/1994 Barr
5,354,057 A 10/1994 Pruitt et al.
5,356,343 A 10/1994 Lovetere
5,357,267 A 10/1994 Inoue
5,359,321 A 10/1994 Ribic
5,359,348 A 10/1994 Pilcher et al.
5,363,120 A 11/1994 Drumm
5,365,214 A 11/1994 Angott et al.
5,366,229 A 11/1994 Suzuki
5,369,580 A 11/1994 Monji
5,369,889 A 12/1994 Callaghan
5,372,365 A 12/1994 McTeigue et al.
5,373,857 A 12/1994 Travers et al.
5,378,197 A 1/1995 Briggs
5,382,026 A 1/1995 Harvard et al.
5,393,074 A 2/1995 Bear et al.
5,396,227 A 3/1995 Carroll et al.
5,396,265 A 3/1995 Ulrich et al.
5,403,238 A 4/1995 Baxter et al.
5,405,294 A 4/1995 Briggs
5,411,269 A 5/1995 Thomas
5,416,535 A 5/1995 Sato et al.
5,421,575 A 6/1995 Triner
5,421,590 A 6/1995 Robbins
5,422,956 A 6/1995 Wheaton
5,429,361 A 7/1995 Raven et al.
5,430,435 A 7/1995 Hoch
5,432,864 A 7/1995 Lu et al.
5,435,561 A 7/1995 Conley
5,435,569 A 7/1995 Zilliox
D360,903 S 8/1995 Barr et al.
5,439,199 A 8/1995 Briggs et al.
5,440,326 A 8/1995 Quinn
5,443,261 A 8/1995 Lee et al.
5,452,893 A 9/1995 Faulk et al.
5,453,053 A 9/1995 Danta et al.
5,453,758 A 9/1995 Sato
D362,870 S 10/1995 Oikawa
5,459,489 A 10/1995 Redford
5,469,194 A 11/1995 Clark et al.
5,481,957 A 1/1996 Paley
5,482,510 A 1/1996 Ishii et al.
5,484,355 A 1/1996 King
5,485,171 A 1/1996 Copper et al.
5,488,362 A 1/1996 Ullman et al.
5,490,058 A 2/1996 Yamasaki
5,498,002 A 3/1996 Gechter
5,502,486 A 3/1996 Ueda
5,506,605 A 4/1996 Paley
5,509,806 A 4/1996 Ellsworth
5,512,892 A 4/1996 Corballis et al.
5,516,105 A 5/1996 Eisenbrey et al.
5,517,183 A 5/1996 Bozeman
5,523,800 A 6/1996 Dudek
5,524,637 A 6/1996 Erickson
5,526,022 A 6/1996 Donahue et al.
5,528,265 A 6/1996 Harrison
5,531,443 A 7/1996 Cruz
5,533,933 A 7/1996 Garnjost et al.
5,541,860 A 7/1996 Takei et al.
5,550,721 A 8/1996 Rapisarda
5,551,701 A 9/1996 Bouton et al.
5,554,033 A 9/1996 Bizzi et al.
5,554,980 A 9/1996 Hashimoto et al.
5,561,543 A 10/1996 Ogawa
5,563,628 A 10/1996 Stroop
5,569,085 A 10/1996 Igarashi et al.
D375,326 S 11/1996 Yokoi et al.
5,573,011 A 11/1996 Felsing
5,574,479 A 11/1996 Odell
5,579,025 A 11/1996 Itoh
D376,826 S 12/1996 Ashida
5,580,319 A 12/1996 Hamilton
5,581,484 A 12/1996 Prince
5,585,584 A 12/1996 Satoshi
5,586,767 A 12/1996 Bohland
5,587,558 A 12/1996 Matsushima
5,587,740 A 12/1996 Brennan
5,594,465 A 1/1997 Poulachon
5,598,187 A 1/1997 Ide et al.
5,602,569 A 2/1997 Kato
5,603,658 A 2/1997 Cohen
5,605,505 A 2/1997 Han
5,606,343 A 2/1997 Tsuboyama
5,611,731 A 3/1997 Bouton et al.
5,613,913 A 3/1997 Ikematsu et al.
5,615,132 A 3/1997 Horton
5,621,459 A 4/1997 Ueda
5,623,581 A 4/1997 Attenberg
5,624,117 A 4/1997 Ohkubo et al.
5,627,565 A 5/1997 Morishita et al.
5,632,878 A 5/1997 Kitano
D379,832 S 6/1997 Ashida
5,640,152 A 6/1997 Copper
5,641,288 A 6/1997 Zzenglein, Jr.
5,642,931 A 7/1997 Gappelberg
5,643,087 A 7/1997 Marcus et al.
5,645,077 A 7/1997 Foxlin
5,645,277 A 7/1997 Cheng
5,647,796 A 7/1997 Cohen
5,649,867 A 7/1997 Briggs
5,651,049 A 7/1997 Easterling et al.
5,655,053 A 8/1997 Renie
5,662,332 A 9/1997 Garfield
5,662,525 A 9/1997 Briggs
5,666,138 A 9/1997 Culver
5,667,217 A 9/1997 Kelly et al.
5,667,220 A 9/1997 Cheng
5,670,845 A 9/1997 Grant
5,670,988 A 9/1997 Tickle
5,672,090 A 9/1997 Liu
5,674,128 A 10/1997 Holch et al.
5,676,450 A 10/1997 Sink et al.
5,676,673 A 10/1997 Ferre et al.
5,679,004 A 10/1997 McGowan et al.
5,682,181 A 10/1997 Nguyen et al.
5,685,776 A 11/1997 Stambolic et al.
5,685,778 A 11/1997 Sheldon et al.
5,694,340 A 12/1997 Kim
5,698,784 A 12/1997 Hotelling et al.
5,701,131 A 12/1997 Kuga
5,702,232 A 12/1997 Moore
5,702,305 A 12/1997 Norman et al.
5,702,323 A 12/1997 Poulton
5,703,623 A 12/1997 Hall et al.
5,716,216 A 2/1998 O'Loughlin et al.
5,716,281 A 2/1998 Dote
5,724,106 A 3/1998 Autry et al.
5,724,497 A 3/1998 San et al.
5,726,675 A 3/1998 Inoue
5,733,131 A 3/1998 Park
5,734,371 A 3/1998 Kaplan
5,734,373 A 3/1998 Rosenberg
5,734,807 A 3/1998 Sumi
D393,884 S 4/1998 Hayami
5,736,970 A 4/1998 Bozeman
5,739,811 A 4/1998 Rosenberg et al.
5,741,182 A 4/1998 Lipps et al.
5,741,189 A 4/1998 Briggs
5,742,331 A 4/1998 Uomori
5,745,226 A 4/1998 Gigioli
D394,264 S 5/1998 Sakamoto et al.
5,746,602 A 5/1998 Kikinis
5,751,273 A 5/1998 Cohen

(56) References Cited

U.S. PATENT DOCUMENTS 5,752,880 A 5/1998 Gabai et al.
5,752,882 A 5/1998 Acres et al.
5,757,305 A 5/1998 Xydis
5,757,354 A 5/1998 Kawamura
5,757,360 A 5/1998 Nitta et al.
D395,464 S 6/1998 Shiibashi et al.
5,764,224 A 6/1998 Lilja et al.
5,769,719 A 6/1998 Hsu
5,770,533 A 6/1998 Franchi
5,771,038 A 6/1998 Wang
5,772,508 A 6/1998 Sugita et al.
D396,468 S 7/1998 Schindler et al.
5,775,998 A 7/1998 Ikematsu et al.
5,779,240 A 7/1998 Santella
5,785,317 A 7/1998 Sasaki
5,785,592 A 7/1998 Jacobsen
5,786,626 A 7/1998 Brady et al.
D397,162 S 8/1998 Yokoi et al.
5,791,648 A 8/1998 Hohl
5,794,081 A 8/1998 Itoh
5,796,354 A 8/1998 Cartabiano et al.
5,803,740 A 9/1998 Gesink et al.
5,803,840 A 9/1998 Young
5,806,849 A 9/1998 Rutkowski
5,807,284 A 9/1998 Foxlin
5,810,666 A 9/1998 Mero et al.
5,811,896 A 9/1998 Grad
5,819,206 A 10/1998 Horton et al.
5,820,462 A 10/1998 Yokoi et al.
5,820,471 A 10/1998 Briggs
5,820,472 A 10/1998 Briggs
5,822,713 A 10/1998 Profeta
5,825,298 A 10/1998 Walter
5,825,350 A 10/1998 Case, Jr. et al.
D400,885 S 11/1998 Goto
5,830,065 A 11/1998 Sitrick
5,831,553 A 11/1998 Lenssen et al.
5,833,549 A 11/1998 Zur et al.
5,835,077 A 11/1998 Dao et al.
5,835,156 A 11/1998 Blonstein et al.
5,835,576 A 11/1998 Katz
5,836,817 A 11/1998 Acres et al.
5,838,138 A 11/1998 Henty
5,841,409 A 11/1998 Ishibashi et al.
D402,328 S 12/1998 Ashida
5,847,854 A 12/1998 Benson, Jr.
5,850,624 A 12/1998 Gard
5,851,149 A 12/1998 Xidos et al.
5,853,327 A 12/1998 Gilboa
5,853,332 A 12/1998 Briggs
5,854,622 A 12/1998 Brannon
5,855,483 A 1/1999 Collins et al.
D405,071 S 2/1999 Gambaro
5,865,680 A 2/1999 Briggs
5,867,146 A 2/1999 Kim et al.
5,874,941 A 2/1999 Yamada
5,875,257 A 2/1999 Marrin et al.
D407,071 S 3/1999 Keating
D407,761 S 4/1999 Barr
5,893,562 A 4/1999 Spector
5,897,437 A 4/1999 Nishiumi
5,898,421 A 4/1999 Quinn
5,900,867 A 5/1999 Schindler et al.
5,901,246 A 5/1999 Hoffberg et al.
5,902,968 A 5/1999 Sato et al.
5,906,542 A 5/1999 Neumann
D410,909 S 6/1999 Tickle
5,908,996 A 6/1999 Litterst et al.
5,911,634 A 6/1999 Nidata et al.
5,912,612 A 6/1999 DeVolpi
5,913,019 A 6/1999 Attenberg
5,913,727 A 6/1999 Ahdoot
5,919,149 A 7/1999 Allen
5,923,317 A 7/1999 Sayler et al.
5,924,695 A 7/1999 Heykoop
5,926,780 A 7/1999 Fox et al.
5,929,782 A 7/1999 Stark et al.
5,929,841 A 7/1999 Fujii
5,929,848 A 7/1999 Albukerk et al.
D412,940 S 8/1999 Kato et al.
5,931,739 A 8/1999 Layer et al.
5,942,969 A 8/1999 Wicks
5,944,533 A 8/1999 Wood
5,946,444 A 8/1999 Evans et al.
5,947,789 A 9/1999 Chan
5,947,868 A 9/1999 Dugan
5,955,713 A 9/1999 Titus
5,955,988 A 9/1999 Blonstein
5,956,035 A 9/1999 Sciammarella
5,957,779 A 9/1999 Larson
5,961,386 A 10/1999 Sawaguchi
5,963,136 A 10/1999 O'Brien
5,964,660 A 10/1999 James et al.
5,967,898 A 10/1999 Takasaka et al.
5,967,901 A 10/1999 Briggs
5,971,270 A 10/1999 Barna
5,971,271 A 10/1999 Barna
5,973,757 A 10/1999 Aubuchon et al.
5,980,254 A 11/1999 Muehle et al.
5,982,352 A 11/1999 Pryor
5,982,356 A 11/1999 Akiyama
5,984,785 A 11/1999 Takeda et al.
5,984,788 A 11/1999 Lebensfeld et al.
5,986,570 A 11/1999 Black et al.
5,986,644 A 11/1999 Herder
5,989,120 A 11/1999 Truchsess
5,991,085 A 11/1999 Rallison et al.
5,991,693 A 11/1999 Zalewski
5,996,033 A 11/1999 Chiu-Hao
5,999,168 A 12/1999 Rosenberg
6,001,014 A 12/1999 Ogata
6,001,015 A 12/1999 Nishiumi et al.
6,002,394 A 12/1999 Schein
6,009,458 A 12/1999 Hawkins et al.
D419,199 S 1/2000 Cordell et al.
D419,200 S 1/2000 Ashida
6,010,406 A 1/2000 Kajikawa et al.
6,011,526 A 1/2000 Toyoshima et al.
6,012,980 A 1/2000 Yoshida et al.
6,012,984 A 1/2000 Roseman
6,013,007 A 1/2000 Root et al.
6,016,144 A 1/2000 Blonstein
6,019,680 A 2/2000 Cheng
6,020,876 A 2/2000 Rosenberg
6,024,647 A 2/2000 Bennett et al.
6,024,675 A 2/2000 Kashiwaguchi
6,025,830 A 2/2000 Cohen
6,037,882 A 3/2000 Levy
6,044,297 A 3/2000 Sheldon
6,049,823 A 4/2000 Hwang
6,052,083 A 4/2000 Wilson
6,057,788 A 5/2000 Cummings
6,058,342 A 5/2000 Orbach
6,059,576 A 5/2000 Brann
6,060,847 A 5/2000 Hettema et al.
6,066,075 A 5/2000 Poulton
6,069,594 A 5/2000 Barnes et al.
6,072,467 A 6/2000 Walker
6,072,470 A 6/2000 Ishigaki
6,075,443 A 6/2000 Schepps et al.
6,075,575 A 6/2000 Schein et al.
6,076,734 A 6/2000 Dougherty et al.
6,077,106 A 6/2000 Mish
6,078,789 A 6/2000 Bodenmann
6,079,982 A 6/2000 Meader
6,080,063 A 6/2000 Khosla
6,081,819 A 6/2000 Ogino
6,084,315 A 7/2000 Schmitt
6,084,577 A 7/2000 Sato et al.
6,085,805 A 7/2000 Bates
6,087,950 A 7/2000 Capan
6,089,987 A 7/2000 Briggs
6,091,342 A 7/2000 Janesch et al.
D429,718 S 8/2000 Rudolph

(56) References Cited

U.S. PATENT DOCUMENTS 6,095,926 A 8/2000 Hettema et al.
6,102,406 A 8/2000 Miles et al.
6,110,039 A 8/2000 Oh
6,110,041 A 8/2000 Walker et al.
6,115,028 A 9/2000 Balakrishnan
6,127,990 A 10/2000 Zwern
6,129,549 A 10/2000 Thompson
6,132,318 A 10/2000 Briggs
6,137,457 A 10/2000 Tokuhashi
D433,381 S 11/2000 Talesfore
6,142,870 A 11/2000 Wada
6,142,876 A 11/2000 Cumbers
6,144,367 A 11/2000 Berstis
6,146,278 A 11/2000 Kobayashi
6,148,100 A 11/2000 Anderson et al.
6,149,490 A 11/2000 Hampton
6,150,947 A 11/2000 Shima
6,154,723 A 11/2000 Cox et al.
6,155,926 A 12/2000 Miyamoto et al.
6,160,405 A 12/2000 Needle
6,160,540 A 12/2000 Fishkin et al.
6,160,986 A 12/2000 Gabai et al.
6,162,122 A 12/2000 Acres et al.
6,162,123 A 12/2000 Woolston
6,162,191 A 12/2000 Foxin
6,164,808 A 12/2000 Shibata
6,171,190 B1 1/2001 Thanasack et al.
6,174,242 B1 1/2001 Briggs et al.
6,176,837 B1 1/2001 Foxlin
6,181,253 B1 1/2001 Eschenbach et al.
6,181,329 B1 1/2001 Stork et al.
6,183,364 B1 2/2001 Trovato
6,183,365 B1 2/2001 Tonomura et al.
6,184,847 B1 2/2001 Fateh et al.
6,184,862 B1 2/2001 Leiper
6,184,863 B1 2/2001 Sibert
6,186,902 B1 2/2001 Briggs
6,191,774 B1 2/2001 Schena
6,196,893 B1 3/2001 Casola et al.
6,198,295 B1 3/2001 Hill
6,198,470 B1 3/2001 Agam et al.
6,198,471 B1 3/2001 Cook
6,200,216 B1 3/2001 Peppel
6,200,219 B1 3/2001 Rudell et al.
6,200,253 B1 3/2001 Nishiumi
6,201,554 B1 3/2001 Lands
6,206,745 B1 3/2001 Gabai et al.
6,206,782 B1 3/2001 Walker et al.
6,210,287 B1 4/2001 Briggs
6,211,861 B1 4/2001 Rosenberg et al.
6,214,155 B1 4/2001 Leighton
6,217,450 B1 4/2001 Meredith
6,217,478 B1 4/2001 Vohmann
6,220,171 B1 4/2001 Hettema et al.
6,220,964 B1 4/2001 Miyamoto
6,220,965 B1 4/2001 Hanna et al.
6,222,522 B1 4/2001 Mathews
D442,998 S 5/2001 Ashida
6,224,486 B1 5/2001 Walker et al.
6,224,491 B1 5/2001 Hiromi et al.
6,225,987 B1 5/2001 Matsuda
6,226,534 B1 5/2001 Aizawa
6,227,966 B1 5/2001 Yokoi
6,227,974 B1 5/2001 Eilat et al.
6,231,451 B1 5/2001 Briggs
6,234,803 B1 5/2001 Watkins
6,238,289 B1 5/2001 Sobota et al.
6,238,291 B1 5/2001 Fujimoto et al.
6,239,806 B1 5/2001 Nishiumi et al.
RE37,220 E 6/2001 Rapisarda et al.
6,241,611 B1 6/2001 Takeda et al.
6,243,491 B1 6/2001 Andersson
6,243,658 B1 6/2001 Raby
6,244,987 B1 6/2001 Ohsuga et al.
6,245,014 B1 6/2001 Brainard et al.
6,248,019 B1 6/2001 Mudie et al.
6,254,101 B1 7/2001 Young
6,254,394 B1 7/2001 Draper et al.
6,261,180 B1 7/2001 Lebensfeld et al.
6,264,202 B1 7/2001 Briggs
6,264,558 B1 7/2001 Nishiumi et al.
6,265,984 B1 7/2001 Molinaroli
6,267,673 B1 7/2001 Miyamoto et al.
6,273,425 B1 8/2001 Westfall et al.
6,273,819 B1 8/2001 Strauss et al.
6,276,353 B1 8/2001 Briggs et al.
6,280,327 B1 8/2001 Leifer et al.
6,280,328 B1 8/2001 Holch et al.
6,283,862 B1 9/2001 Richter
6,283,871 B1 9/2001 Briggs
6,287,200 B1 9/2001 Sharma
6,290,565 B1 9/2001 Galyean, III et al.
6,290,566 B1 9/2001 Gabai et al.
6,293,684 B1 9/2001 Riblett
6,297,751 B1 10/2001 Fadavi-Ardekani
6,301,534 B1 10/2001 McDermott
6,302,793 B1 10/2001 Fertitta, III et al.
6,302,796 B1 10/2001 Lebensfeld et al.
6,304,250 B1 10/2001 Yang
6,311,982 B1 11/2001 Lebensfeld et al.
6,315,673 B1 11/2001 Kopera
6,320,495 B1 11/2001 Sporgis
6,322,365 B1 11/2001 Shechter et al.
6,323,614 B1 11/2001 Palaxxolo
6,323,654 B1 11/2001 Needle
6,325,718 B1 12/2001 Nishiumi et al.
6,328,648 B1 12/2001 Walker et al.
6,328,650 B1 12/2001 Fukawa et al.
6,329,648 B1 12/2001 Delatorre
6,330,427 B1 12/2001 Tabachnik
6,331,841 B1 12/2001 Tokuhashi
6,331,856 B1 12/2001 VanHook
6,332,840 B1 12/2001 Nishiumi et al.
6,337,954 B1 1/2002 Soshi
6,342,010 B1 1/2002 Slifer
6,346,047 B1 2/2002 Sobota
6,347,993 B1 2/2002 Kondo et al.
6,347,998 B1 2/2002 Yoshitomi et al.
6,350,199 B1 2/2002 Williams et al.
6,352,478 B1 * 3/2002 Gabai et al. ..... 463/42
6,356,867 B1 3/2002 Gabai et al.
6,361,396 B1 3/2002 Snyder
6,361,507 B1 3/2002 Foxlin
D456,410 S 4/2002 Ashida
6,364,735 B1 4/2002 Bristow et al.
6,368,177 B1 4/2002 Gabai et al.
6,368,217 B2 4/2002 Kanno
6,369,794 B1 4/2002 Sakurai et al.
6,369,908 B1 4/2002 Frey et al.
6,371,375 B1 4/2002 Ackley et al.
6,371,853 B1 4/2002 Borta
6,375,566 B1 4/2002 Yamada
6,375,569 B1 4/2002 Acres
6,375,572 B1 4/2002 Masuyama et al.
6,375,578 B1 4/2002 Briggs
6,377,793 B1 4/2002 Jenkins
6,377,906 B1 4/2002 Rowe
D456,854 S 5/2002 Ashida
6,383,079 B1 5/2002 Takeda et al.
6,386,538 B1 5/2002 Mejia
6,392,613 B1 5/2002 Goto
6,394,904 B1 5/2002 Stallker
6,400,480 B1 6/2002 Thomas
6,400,996 B1 6/2002 Hoffberg et al.
6,404,409 B1 6/2002 Solomon
6,409,379 B1 6/2002 Gabathuler et al.
6,409,604 B1 6/2002 Matsuno
6,409,687 B1 6/2002 Foxlin
D459,727 S 7/2002 Ashida
D460,787 S 7/2002 Nishikawa
6,414,589 B1 7/2002 Angott et al.
6,415,223 B1 7/2002 Lin
6,421,056 B1 7/2002 Nishiumi
6,424,333 B1 7/2002 Tremblay

(56) References Cited

U.S. PATENT DOCUMENTS 6,426,719 B1 7/2002 Nagareda
6,426,741 B1 7/2002 Goldsmith et al.
6,438,193 B1 8/2002 Ko et al.
D462,683 S 9/2002 Ashida
6,445,960 B1 9/2002 Borta
6,452,494 B1 9/2002 Harrison
6,456,276 B1 9/2002 Park
D464,052 S 10/2002 Fletcher
D464,950 S 10/2002 Fraquelli et al.
6,462,769 B1 10/2002 Trowbridge et al.
6,463,257 B1 10/2002 Wood
6,463,859 B1 10/2002 Ikezawa
6,466,198 B1 10/2002 Feinstein
6,466,831 B1 10/2002 Shibata
6,473,070 B2 10/2002 Mishra et al.
6,473,713 B1 10/2002 McCall
6,474,159 B1 11/2002 Foxlin et al.
6,482,067 B1 11/2002 Pickens
6,484,080 B2 11/2002 Breed
6,490,409 B1 12/2002 Walker
6,492,981 B1 12/2002 Stork et al.
6,494,457 B2 12/2002 Conte et al.
6,496,122 B2 12/2002 Sampsell
6,509,217 B1 1/2003 Reddy
6,512,511 B2 1/2003 Willner
6,517,438 B2 2/2003 Tosaki
6,518,952 B1 2/2003 Leiper
6,525,660 B1 2/2003 Surintrspanont
6,526,158 B1 2/2003 Goldberg
6,527,638 B1 3/2003 Walker et al.
6,527,646 B1 3/2003 Briggs
6,530,838 B2 3/2003 Ha et al.
6,530,841 B2 3/2003 Bull et al.
6,538,675 B2 3/2003 Aratani
D473,942 S 4/2003 Motoki et al.
6,540,607 B2 4/2003 Mokris et al.
6,540,611 B1 4/2003 Nagata
6,544,124 B2 4/2003 Ireland
6,544,126 B2 4/2003 Sawano
6,545,611 B2 4/2003 Hayashi et al.
6,545,661 B1 4/2003 Goschy et al.
6,551,165 B2 4/2003 Smirnov
6,551,188 B2 4/2003 Toyama et al.
6,554,707 B1 4/2003 Sinclair et al.
6,554,781 B1 4/2003 Carter et al.
D474,763 S 5/2003 Tozaki et al.
6,560,511 B1 5/2003 Yokoo et al.
6,561,049 B2 5/2003 Akiyama et al.
6,565,438 B2 5/2003 Ogino
6,565,444 B2 5/2003 Nagata et al.
6,567,536 B2 5/2003 McNitt et al.
6,569,023 B1 5/2003 Briggs
6,572,108 B1 6/2003 Bristow
6,575,753 B2 6/2003 Rosa et al.
6,577,350 B1 6/2003 Proehl
6,579,098 B2 6/2003 Shechter
6,582,299 B1 6/2003 Matsuyama et al.
6,582,380 B2 6/2003 Kazlausky et al.
6,583,783 B1 6/2003 Dietrich
6,585,596 B1 7/2003 Leifer et al.
6,589,120 B1 7/2003 Takahashi
6,590,536 B1 7/2003 Walton
6,591,677 B2 7/2003 Rothoff
6,592,461 B1 7/2003 Raviv et al.
6,595,863 B2 7/2003 Chamberlain et al.
6,597,342 B1 7/2003 Haruta
6,597,443 B2 7/2003 Boman
6,598,978 B2 7/2003 Hasegawa
6,599,194 B1 7/2003 Smith
6,605,038 B1 8/2003 Teller et al.
6,607,123 B1 8/2003 Jollifee et al.
6,608,563 B2 8/2003 Weston et al.
6,609,969 B1 8/2003 Luciano et al.
6,609,977 B1 8/2003 Shimizu
6,616,452 B2 9/2003 Clark et al.
6,616,535 B1 9/2003 Nishizak
6,616,607 B2 9/2003 Hashimoto
6,626,728 B2 9/2003 Holt
6,628,257 B1 9/2003 Oka
6,629,019 B2 9/2003 Legge et al.
6,632,142 B2 10/2003 Keith
6,633,155 B1 10/2003 Liang
6,634,949 B1 10/2003 Briggs et al.
6,636,826 B1 10/2003 Abe et al.
6,641,482 B2 11/2003 Masuyama et al.
6,642,837 B1 11/2003 Vigoda et al.
6,650,029 B1 11/2003 Johnston
6,650,313 B2 11/2003 Levine
6,650,345 B1 11/2003 Saito
6,651,268 B1 11/2003 Briggs
6,654,001 B1 11/2003 Su
6,672,962 B1 1/2004 Ozaki et al.
6,676,520 B2 1/2004 Nishiumi et al.
6,676,524 B1 1/2004 Botzas
6,677,990 B1 1/2004 Kawahara
6,681,629 B2 1/2004 Foxlin et al.
6,682,074 B2 1/2004 Weston
6,682,351 B1 1/2004 Abraham-Fuchs et al.
6,684,062 B1 1/2004 Gosior et al.
D486,145 S 2/2004 Kaminski et al.
6,686,954 B1 2/2004 Kitaguchi
6,692,170 B2 2/2004 Abir
6,693,622 B1 2/2004 Shahoian et al.
6,702,672 B1 3/2004 Angell et al.
6,709,336 B2 3/2004 Siegel et al.
6,712,692 B2 3/2004 Basson
6,716,102 B2 4/2004 Whitten et al.
6,717,573 B1 4/2004 Shahoian et al.
6,717,673 B1 4/2004 Janssen
6,718,280 B2 4/2004 Hermann
6,725,107 B2 4/2004 MacPherson
6,725,173 B2 4/2004 An
D489,361 S 5/2004 Mori et al.
6,729,934 B1 5/2004 Driscoll et al.
6,733,390 B2 5/2004 Walker et al.
6,736,009 B1 5/2004 Schwabe
6,739,979 B2 5/2004 Tracy
D491,924 S 6/2004 Kaminski et al.
D492,285 S 6/2004 Ombao et al.
6,743,104 B1 6/2004 Ota et al.
6,746,334 B1 6/2004 Barney
6,747,632 B2 6/2004 Howard
6,747,690 B2 6/2004 Molgaard
6,749,432 B2 6/2004 French et al.
6,752,719 B2 6/2004 Himoto et al.
6,753,849 B1 6/2004 Curran et al.
6,753,888 B2 6/2004 Kamiwada
6,757,068 B2 6/2004 Foxlin
6,757,446 B1 6/2004 Li
6,761,637 B2 7/2004 Weston et al.
6,765,553 B1 7/2004 Odamura
D495,336 S 8/2004 Andre et al.
6,770,863 B2 8/2004 Walley
6,773,325 B1 8/2004 Mawle et al.
6,773,344 B1 8/2004 Gabai et al.
6,785,539 B2 8/2004 Hale
6,786,877 B2 9/2004 Foxlin
6,796,177 B2 9/2004 Mori
6,796,908 B2 9/2004 Weston
6,797,895 B2 9/2004 Lapstun
6,811,489 B1 11/2004 Shimizu
6,811,491 B1 11/2004 Levenberg et al.
6,812,583 B2 11/2004 Cheung et al.
6,812,881 B1 11/2004 Mullaly et al.
6,813,525 B2 11/2004 Reid
6,813,574 B1 11/2004 Yedur
6,813,584 B2 11/2004 Zhou et al.
6,816,151 B2 11/2004 Dellinger
6,821,204 B2 11/2004 Aonuma et al.
6,821,206 B1 11/2004 Ishida et al.
6,836,705 B2 12/2004 Hellman
6,836,751 B2 12/2004 Paxton
6,836,971 B1 1/2005 Wang
6,842,991 B2 1/2005 Levi

(56) References Cited

U.S. PATENT DOCUMENTS 6,846,238 B2 1/2005 Wells
6,850,221 B1 2/2005 Tickle
6,850,844 B1 2/2005 Walters
6,852,032 B2 2/2005 Ishino
6,856,327 B2 2/2005 Choi
D502,468 S 3/2005 Knight et al.
6,868,738 B2 3/2005 Moscrip
6,872,139 B2 3/2005 Sato et al.
6,873,406 B1 3/2005 Hines
D503,750 S 4/2005 Kit et al.
D504,298 S 4/2005 Hedderich et al.
6,878,066 B2 4/2005 Leifer
6,882,824 B2 4/2005 Wood
D504,677 S 5/2005 Kaminski et al.
D505,424 S 5/2005 Ashida et al.
6,890,262 B2 5/2005 Oishi
6,891,526 B2 5/2005 Gombert
6,894,686 B2 5/2005 Stamper et al.
6,897,845 B2 5/2005 Ozawa
6,897,854 B2 5/2005 Cho
6,902,483 B2 6/2005 Lin
6,903,725 B2 6/2005 Nacson
6,905,411 B2 6/2005 Nguyen et al.
6,906,700 B1 6/2005 Armstrong
6,908,386 B2 6/2005 Suzuki et al.
6,908,388 B2 6/2005 Shimizu
6,918,833 B2 7/2005 Emmerson et al.
6,921,332 B2 7/2005 Fukunaga
6,922,632 B2 7/2005 Foxlin
6,924,787 B2 8/2005 Kramer et al.
6,925,410 B2 8/2005 Narayanan
6,929,543 B1 8/2005 Ueshima et al.
6,929,548 B2 8/2005 Wang
6,932,698 B2 8/2005 Sprogis
6,932,706 B1 8/2005 Kaminkow
6,933,861 B2 8/2005 Wang
6,933,923 B2 8/2005 Feinstein
6,935,864 B2 8/2005 Shechter et al.
6,935,952 B2 8/2005 Walker et al.
6,939,232 B2 9/2005 Tanaka et al.
6,948,999 B2 9/2005 Chan
6,954,980 B2 10/2005 Song
6,955,606 B2 10/2005 Taho et al.
6,956,564 B1 10/2005 Williams
6,965,374 B2 11/2005 Villet et al.
6,966,775 B1 11/2005 Kendir et al.
6,967,563 B2 11/2005 Bormaster
6,967,566 B2 11/2005 Weston et al.
6,982,697 B2 1/2006 Wilson et al.
6,983,219 B2 1/2006 Mantyjarvi
6,984,208 B2 1/2006 Zheng
6,990,639 B2 1/2006 Wilson
6,993,451 B2 1/2006 Chang et al.
6,995,748 B2 2/2006 Gordon et al.
6,998,966 B2 2/2006 Pedersen
7,000,469 B2 2/2006 Foxlin et al.
7,002,591 B1 2/2006 Leather
7,004,847 B2 2/2006 Henry
7,029,400 B2 4/2006 Briggs
7,031,875 B2 4/2006 Ellenby et al.
7,040,986 B2 5/2006 Koshima
7,040,993 B1 5/2006 Lovitt
7,040,998 B2 5/2006 Jolliffe et al.
7,052,391 B1 5/2006 Luciano, Jr.
7,055,101 B2 5/2006 Abbott et al.
7,056,221 B2 6/2006 Thirkettle et al.
7,059,974 B1 6/2006 Golliffe et al.
7,066,781 B2 * 6/2006 Weston ..... 446/268
D524,298 S 7/2006 Hedderich et al.
7,081,033 B1 7/2006 Mawle
7,081,051 B2 7/2006 Himoto et al.
7,086,645 B2 8/2006 Hardie
7,090,582 B2 8/2006 Danieli et al.
7,094,147 B2 8/2006 Nakata
7,098,891 B1 8/2006 Pryor
7,098,894 B2 8/2006 Yang
7,102,615 B2 9/2006 Marks
7,102,616 B1 9/2006 Sleator
7,107,168 B2 9/2006 Oystol
D531,228 S 10/2006 Ashida et al.
7,115,032 B2 10/2006 Cantu et al.
7,117,009 B2 10/2006 Wong et al.
7,118,482 B2 10/2006 Ishihara et al.
7,126,584 B1 10/2006 Nishiumi et al.
7,127,370 B2 10/2006 Kelly
D531,585 S 11/2006 Weitgasser et al.
7,133,026 B2 11/2006 Horie et al.
7,136,674 B2 11/2006 Yoshie et al.
7,136,826 B2 11/2006 Alsafadi
7,137,899 B2 11/2006 Hiei
7,139,983 B2 11/2006 Kelts
7,140,962 B2 11/2006 Okuda et al.
7,142,191 B2 11/2006 Idesawa et al.
7,145,551 B1 12/2006 Bathiche
7,149,627 B2 12/2006 Ockerse
7,154,475 B2 12/2006 Crew
7,155,604 B2 12/2006 Kawai
7,158,116 B2 1/2007 Poltorak
7,158,118 B2 1/2007 Liberty
7,160,196 B2 1/2007 Thirkettle et al.
7,168,089 B2 1/2007 Nguyen et al.
7,173,604 B2 2/2007 Marvit
7,176,919 B2 2/2007 Drebin
7,180,414 B2 2/2007 Nyfelt
7,180,503 B2 2/2007 Burr
7,182,691 B1 2/2007 Schena
7,183,480 B2 2/2007 Nishitani et al.
7,184,059 B1 2/2007 Fouladi
D543,246 S 5/2007 Ashida et al.
7,220,220 B2 5/2007 Stubbs et al.
7,223,173 B2 5/2007 Masuyama et al.
7,225,101 B2 5/2007 Usuda et al.
7,231,063 B2 6/2007 Naimark
7,233,316 B2 6/2007 Smith et al.
7,236,156 B2 6/2007 Liberty et al.
7,239,301 B2 7/2007 Liberty et al.
7,252,572 B2 8/2007 Wright et al.
7,261,690 B2 8/2007 Teller et al.
7,262,760 B2 8/2007 Liberty
RE39,818 E 9/2007 Slifer
7,288,028 B2 10/2007 Rodriquez et al.
D556,201 S 11/2007 Ashida et al.
7,291,014 B2 11/2007 Chung et al.
7,292,151 B2 11/2007 Ferguson et al.
7,297,059 B2 11/2007 Vancura et al.
7,301,527 B2 11/2007 Marvit
7,301,648 B2 11/2007 Foxlin
D556,760 S 12/2007 Ashida et al.
7,307,617 B2 12/2007 Wilson et al.
D559,847 S 1/2008 Ashida et al.
D561,178 S 2/2008 Azuma
7,331,857 B2 2/2008 MacIver
7,335,134 B1 2/2008 LaVelle
D563,948 S 3/2008 d-Hoore
7,337,965 B2 3/2008 Thirkettle et al.
7,339,105 B2 3/2008 Eitaki
7,345,670 B2 3/2008 Armstrong
D567,243 S 4/2008 Ashida et al.
7,359,121 B2 4/2008 French et al.
7,359,451 B2 4/2008 McKnight
7,361,073 B2 4/2008 Martin
RE40,324 E 5/2008 Crawford
7,379,566 B2 5/2008 Hildreth
7,387,559 B2 6/2008 Sanchez-Castro et al.
7,395,181 B2 7/2008 Foxlin
7,398,151 B1 7/2008 Burrell et al.
7,408,453 B2 8/2008 Breed
7,414,611 B2 8/2008 Liberty
7,419,428 B2 9/2008 Rowe
7,424,388 B2 9/2008 Sato
7,428,499 B1 9/2008 Philyaw
7,435,179 B1 10/2008 Ford
7,441,151 B2 10/2008 Whitten et al.
7,442,108 B2 10/2008 Ganz

(56) References Cited

U.S. PATENT DOCUMENTS 7,445,550 B2 11/2008 Barney et al.
7,465,212 B2 12/2008 Ganz
7,488,231 B2 * 2/2009 Weston ..... 446/175
7,488,254 B2 2/2009 Himoto
7,489,299 B2 2/2009 Liberty et al.
7,492,268 B2 2/2009 Ferguson et al.
7,492,367 B2 2/2009 Mahajan et al.
7,500,917 B2 3/2009 Barney et al.
7,502,759 B2 3/2009 Hannigan et al.
7,519,537 B2 4/2009 Rosenberg
7,524,246 B2 4/2009 Briggs et al.
7,535,456 B2 5/2009 Liberty et al.
7,536,156 B2 5/2009 Tischer
7,564,426 B2 7/2009 Poor
7,568,289 B2 8/2009 Burlingham et al.
7,572,191 B2 8/2009 Weston et al.
7,582,016 B2 9/2009 Suzuki
7,596,466 B2 9/2009 Ohta
7,614,958 B2 11/2009 Weston et al.
7,623,115 B2 11/2009 Marks
7,627,139 B2 12/2009 Marks
7,627,451 B2 12/2009 Vock et al.
7,662,015 B2 2/2010 Hui
7,663,509 B2 2/2010 Shen
7,674,184 B2 3/2010 Briggs et al.
7,704,135 B2 4/2010 Harrison
7,727,090 B2 6/2010 Gant
7,749,089 B1 7/2010 Briggs et al.
7,774,155 B2 8/2010 Sato et al.
7,775,882 B2 8/2010 Kawamura et al.
7,775,884 B1 8/2010 McCauley
7,789,741 B1 9/2010 Fields
7,796,116 B2 9/2010 Salsman et al.
7,828,295 B2 11/2010 Matsumoto et al.
7,850,527 B2 12/2010 Barney et al.
7,878,905 B2 2/2011 Weston et al.
7,883,420 B2 2/2011 Bradbury
7,896,742 B2 3/2011 Barney et al.
7,927,216 B2 4/2011 Ikeda
7,942,745 B2 5/2011 Ikeda
7,989,971 B2 8/2011 Lemieux
8,021,239 B2 9/2011 Weston et al.
8,089,458 B2 1/2012 Barney et al.
8,164,567 B1 4/2012 Barney et al.
8,169,406 B2 5/2012 Barney et al.
8,184,097 B1 5/2012 Barney et al.
8,226,493 B2 7/2012 Briggs et al.
8,248,367 B1 8/2012 Barney et al.
8,287,373 B2 10/2012 Marks et al.
8,330,284 B2 12/2012 Weston et al.
8,342,929 B2 1/2013 Briggs et al.
8,368,648 B2 2/2013 Barney et al.
8,373,659 B2 2/2013 Barney et al.
8,384,668 B2 2/2013 Barney et al.
8,475,275 B2 7/2013 Barney et al.
8,491,389 B2 7/2013 Weston et al.
8,531,050 B2 9/2013 Barney et al.
2001/0010514 A1 8/2001 Ishino
2001/0015123 A1 8/2001 Nishitani et al.
2001/0018361 A1 8/2001 Acres
2001/0024973 A1 9/2001 Meredith
2001/0031662 A1 10/2001 Larian
2001/0034257 A1 10/2001 Weston et al.
2001/0039206 A1 11/2001 Peppel
2001/0040591 A1 11/2001 Abbott et al.
2001/0049302 A1 12/2001 Hagiwara et al.
2001/0054082 A1 12/2001 Rudolph et al.
2002/0005787 A1 1/2002 Gabai et al.
2002/0008622 A1 1/2002 Weston et al.
2002/0024500 A1 2/2002 Howard
2002/0024675 A1 2/2002 Foxlin
2002/0028071 A1 3/2002 Molgaard
2002/0028710 A1 3/2002 Ishihara et al.
2002/0032067 A1 3/2002 Barney
2002/0036617 A1 3/2002 Pryor
2002/0038267 A1 3/2002 Can et al.
2002/0052238 A1 5/2002 Muroi
2002/0058459 A1 5/2002 Holt
2002/0068500 A1 6/2002 Gabai et al.
2002/0072418 A1 6/2002 Masuyama
2002/0075335 A1 6/2002 Relimoto
2002/0090985 A1 7/2002 Tochner et al.
2002/0090992 A1 7/2002 Legge et al.
2002/0098887 A1 7/2002 Himoto et al.
2002/0103026 A1 8/2002 Himoto et al.
2002/0107069 A1 8/2002 Ishino
2002/0107591 A1 8/2002 Gabai et al.
2002/0116615 A1 8/2002 Nguyen et al.
2002/0118147 A1 8/2002 Solomon
2002/0123377 A1 9/2002 Shulman
2002/0126026 A1 9/2002 Lee et al.
2002/0128056 A1 9/2002 Kato
2002/0137427 A1 9/2002 Peters
2002/0137567 A1 9/2002 Cheng
2002/0140745 A1 10/2002 Ellenby
2002/0158751 A1 10/2002 Bormaster
2002/0158843 A1 10/2002 Levine
2002/0183961 A1 12/2002 French et al.
2002/0193047 A1 12/2002 Weston
2003/0013513 A1 1/2003 Rowe
2003/0022736 A1 1/2003 Cass
2003/0027634 A1 2/2003 Matthews, III
2003/0036425 A1 2/2003 Kaminkow et al.
2003/0037075 A1 2/2003 Hannigan
2003/0038778 A1 2/2003 Noguera
2003/0040347 A1 2/2003 Roach et al.
2003/0052860 A1 3/2003 Park et al.
2003/0057808 A1 3/2003 Lee et al.
2003/0060286 A1 3/2003 Walker et al.
2003/0063068 A1 4/2003 Anton
2003/0064812 A1 4/2003 Rappaport et al.
2003/0069077 A1 4/2003 Korienek
2003/0073505 A1 4/2003 Tracy
2003/0095101 A1 5/2003 Jou
2003/0096652 A1 5/2003 Siegel et al.
2003/0106455 A1 6/2003 Weston
2003/0107178 A1 6/2003 Weston
2003/0107551 A1 6/2003 Dunker
2003/0114233 A1 6/2003 Hiei
2003/0134679 A1 7/2003 Siegel et al.
2003/0144047 A1 7/2003 Sprogis
2003/0144056 A1 7/2003 Leifer et al.
2003/0166416 A1 9/2003 Ogata
2003/0171145 A1 9/2003 Rowe
2003/0171190 A1 9/2003 Rice
2003/0190967 A1 10/2003 Henry
2003/0193572 A1 10/2003 Wilson et al.
2003/0195037 A1 10/2003 Vuong et al.
2003/0195041 A1 10/2003 McCauley
2003/0195046 A1 10/2003 Bartsch
2003/0204361 A1 10/2003 Townsend
2003/0214259 A9 11/2003 Dowling et al.
2003/0216176 A1 11/2003 Shimizu
2003/0222851 A1 12/2003 Lai
2003/0234914 A1 12/2003 Solomon
2004/0028258 A1 2/2004 Naimark
2004/0033833 A1 2/2004 Briggs et al.
2004/0034289 A1 2/2004 Teller et al.
2004/0048666 A1 3/2004 Bagley
2004/0063480 A1 4/2004 Wang
2004/0070564 A1 4/2004 Dawson
2004/0075650 A1 4/2004 Paul
2004/0077423 A1 4/2004 Weston et al.
2004/0081313 A1 4/2004 McKnight et al.
2004/0092311 A1 5/2004 Weston et al.
2004/0095317 A1 5/2004 Zhang
2004/0102247 A1 5/2004 Smoot et al.
2004/0119693 A1 6/2004 Kaemmler
2004/0121834 A1 6/2004 Libby et al.
2004/0134341 A1 7/2004 Sandoz
2004/0140954 A1 7/2004 Faeth
2004/0143413 A1 7/2004 Oystol
2004/0147317 A1 7/2004 Ito et al.
2004/0152499 A1 8/2004 Lind et al.

(56) References Cited

U.S. PATENT DOCUMENTS

2004/0152515 A1 8/2004 Wegmuller et al.
2004/0174287 A1 9/2004 Deak
2004/0193413 A1 9/2004 Wilson
2004/0198158 A1* 10/2004 Driscoll et al. ..... 446/297
2004/0198517 A1 10/2004 Briggs
2004/0203638 A1 10/2004 Chan
2004/0204240 A1 10/2004 Barney
2004/0207597 A1 10/2004 Marks
2004/0214642 A1 10/2004 Beck
2004/0218104 A1 11/2004 Smith
2004/0222969 A1 11/2004 Buchenrieder
2004/0227725 A1 11/2004 Calarco
2004/0229693 A1 11/2004 Lind
2004/0229696 A1 11/2004 Beck
2004/0236453 A1 11/2004 Szoboszlay
2004/0239626 A1 12/2004 Noguera
2004/0252109 A1 12/2004 Trent et al.
2004/0254020 A1 12/2004 Dragusin
2004/0259651 A1 12/2004 Storek
2004/0268393 A1 12/2004 Hunleth
2005/0017454 A1 1/2005 Schoichi et al.
2005/0020369 A1 1/2005 Davis
2005/0032582 A1 2/2005 Mahajan et al.
2005/0047621 A1 3/2005 Cranfill
2005/0054457 A1 3/2005 Eyestone
2005/0059488 A1 3/2005 Larsen et al.
2005/0059503 A1 3/2005 Briggs et al.
2005/0060586 A1 3/2005 Burger
2005/0076161 A1 4/2005 Albanna
2005/0085298 A1 4/2005 Woolston
2005/0116020 A1 6/2005 Smolucha et al.
2005/0125826 A1 6/2005 Hunleth
2005/0127868 A1 6/2005 Calhoon et al.
2005/0130739 A1 6/2005 Argentar
2005/0134555 A1 6/2005 Liao
2005/0138851 A1 6/2005 Ingraselino
2005/0143173 A1 6/2005 Barney et al.
2005/0156883 A1 7/2005 Wilson et al.
2005/0162389 A1 7/2005 Obermeyer
2005/0164601 A1 7/2005 McEachen
2005/0170889 A1 8/2005 Lum et al.
2005/0172734 A1 8/2005 Alsio
2005/0174324 A1 8/2005 Liberty
2005/0176485 A1 8/2005 Ueshima
2005/0179644 A1 8/2005 Alsio
2005/0202866 A1 9/2005 Luciano et al.
2005/0210418 A1 9/2005 Marvit
2005/0210419 A1 9/2005 Kela
2005/0212749 A1 9/2005 Marvit
2005/0212750 A1 9/2005 Marvit
2005/0212751 A1 9/2005 Marvit
2005/0212752 A1 9/2005 Marvit
2005/0212753 A1 9/2005 Marvit
2005/0212754 A1 9/2005 Marvit
2005/0212755 A1 9/2005 Marvit
2005/0212756 A1 9/2005 Marvit
2005/0212757 A1 9/2005 Marvit
2005/0212758 A1 9/2005 Marvit
2005/0212759 A1 9/2005 Marvit
2005/0212760 A1 9/2005 Marvit
2005/0212764 A1 9/2005 Toba
2005/0212767 A1 9/2005 Marvit
2005/0215295 A1 9/2005 Arneson
2005/0215322 A1 9/2005 Himoto et al.
2005/0217525 A1 10/2005 McClure
2005/0227579 A1 10/2005 Yamaguchi et al.
2005/0233808 A1 10/2005 Himoto et al.
2005/0239548 A1 10/2005 Ueshima et al.
2005/0243061 A1 11/2005 Liberty
2005/0243062 A1 11/2005 Liberty
2005/0253806 A1 11/2005 Liberty
2005/0256675 A1 11/2005 Kurata
2005/0266907 A1 12/2005 Weston et al.
2005/0277465 A1 12/2005 Whitten et al.
2005/0278741 A1 12/2005 Robarts
2006/0007115 A1 1/2006 Furuhashi
2006/0028446 A1 2/2006 Liberty
2006/0030385 A1 2/2006 Barney et al.
2006/0040720 A1 2/2006 Harrison
2006/0046849 A1 3/2006 Kovacs
2006/0092133 A1 5/2006 Touma
2006/0094502 A1 5/2006 Katayama et al.
2006/0122474 A1 6/2006 Teller et al.
2006/0123146 A1 6/2006 Wu et al.
2006/0148563 A1 7/2006 Yang
2006/0152487 A1 7/2006 Grunnet-Jepsen
2006/0152488 A1 7/2006 Salsman
2006/0152489 A1 7/2006 Sweetser
2006/0154726 A1 7/2006 Weston et al.
2006/0178212 A1 8/2006 Penzias
2006/0205507 A1 9/2006 Ho
2006/0229134 A1 10/2006 Briggs et al.
2006/0231794 A1 10/2006 Sakaguchi et al.
2006/0234601 A1 10/2006 Weston
2006/0252475 A1 11/2006 Zalewski
2006/0252477 A1 11/2006 Zalewski et al.
2006/0256081 A1 11/2006 Zalewski
2006/0258452 A1 11/2006 Hsu
2006/0258471 A1 11/2006 Briggs et al.
2006/0264258 A1 11/2006 Zalewski et al.
2006/0264260 A1 11/2006 Zalewski
2006/0267935 A1 11/2006 Corson
2006/0273907 A1 12/2006 Heiman
2006/0282873 A1 12/2006 Zalewski
2006/0284842 A1 12/2006 Poltorak
2006/0287030 A1 12/2006 Briggs et al.
2006/0287084 A1 12/2006 Mao et al.
2006/0287085 A1 12/2006 Mao
2006/0287086 A1 12/2006 Zalewski
2006/0287087 A1 12/2006 Zalewski
2007/0015588 A1 1/2007 Matsumoto et al.
2007/0021208 A1 1/2007 Mao et al.
2007/0049374 A1 3/2007 Ikeda et al.
2007/0050597 A1 3/2007 Ikeda et al.
2007/0052177 A1 3/2007 Ikeda et al.
2007/0060391 A1 3/2007 Ikeda et al.
2007/0066394 A1 3/2007 Ikeda et al.
2007/0066396 A1 3/2007 Weston et al.
2007/0072680 A1 3/2007 Ikeda et al.
2007/0091084 A1 4/2007 Ueshima et al.
2007/0093291 A1 4/2007 Hulvey
2007/0100696 A1 5/2007 Illingworth
2007/0159362 A1 7/2007 Shen
2007/0173705 A1 7/2007 Teller et al.
2007/0249425 A1 10/2007 Weston et al.
2007/0252815 A1 11/2007 Kuo
2007/0257884 A1 11/2007 Taira
2007/0265075 A1 11/2007 Zalewski
2007/0265076 A1 11/2007 Lin
2007/0265088 A1 11/2007 Nakada et al.
2008/0014835 A1 1/2008 Weston et al.
2008/0015017 A1 1/2008 Ashida et al.
2008/0039202 A1 2/2008 Sawano et al.
2008/0119270 A1 5/2008 Ohta
2008/0121782 A1 5/2008 Hotelling et al.
2008/0174550 A1 7/2008 Laurila
2008/0183678 A1 7/2008 Weston et al.
2008/0273011 A1 11/2008 Lin
2008/0278445 A1 11/2008 Sweester
2009/0009294 A1 1/2009 Kupstas
2009/0033621 A1 2/2009 Quinn
2009/0051653 A1 2/2009 Barney et al.
2009/0156309 A1 6/2009 Weston et al.
2009/0215534 A1 8/2009 Wilson et al.
2009/0305799 A1 12/2009 Weston et al.
2009/0326851 A1 12/2009 Tanenhaus
2010/0056285 A1 3/2010 Weston et al.
2010/0105475 A1 4/2010 Mikhailov
2010/0144436 A1 6/2010 Marks et al.
2010/0203932 A1 8/2010 Briggs et al.
2010/0273556 A1 10/2010 Briggs et al.
2010/0289744 A1 11/2010 Cohen
2011/0081969 A1 4/2011 Ikeda
2011/0081970 A1 4/2011 Barney et al.

(56) References Cited

U.S. PATENT DOCUMENTS

| | | | |
|---|---|---|---|
| 2011/0177853 | A1 | 7/2011 | Ueshima |
| 2011/0190052 | A1 | 8/2011 | Takeda |
| 2011/0263330 | A1 | 10/2011 | Weston et al. |
| 2011/0300941 | A1 | 12/2011 | Weston et al. |
| 2012/0004031 | A1 | 1/2012 | Barney et al. |
| 2012/0034980 | A1 | 2/2012 | Weston et al. |
| 2012/0094759 | A1 | 4/2012 | Barney et al. |
| 2012/0122575 | A1 | 5/2012 | Barney et al. |
| 2012/0190452 | A1 | 7/2012 | Weston et al. |
| 2012/0208638 | A1 | 8/2012 | Barney et al. |
| 2012/0258802 | A1 | 10/2012 | Weston et al. |
| 2012/0270657 | A1 | 10/2012 | Barney et al. |
| 2012/0295710 | A1 | 11/2012 | Barney et al. |
| 2012/0309528 | A1 | 12/2012 | Barney et al. |
| 2013/0079141 | A1 | 3/2013 | Barney et al. |
| 2013/0116048 | A1 | 5/2013 | Briggs et al. |
| 2013/0116051 | A1 | 5/2013 | Barney et al. |
| 2013/0150155 | A1 | 6/2013 | Barney et al. |
| 2013/0165228 | A1 | 6/2013 | Barney et al. |
| 2013/0196727 | A1 | 8/2013 | Barney et al. |
| 2013/0217453 | A1 | 8/2013 | Briggs et al. |

FOREIGN PATENT DOCUMENTS

| | | | |
|---|---|---|---|
| CN | 1032246 | A | 4/1989 |
| CN | 1338961 | | 3/2002 |
| CN | 1559644 | | 1/2005 |
| DE | 3930581 | | 3/1991 |
| DE | 19701374 | | 7/1997 |
| DE | 19632273 | | 2/1998 |
| DE | 19648487 | | 6/1998 |
| DE | 19814254 | | 10/1998 |
| DE | 19937307 | | 2/2000 |
| DE | 10029173 | | 1/2002 |
| DE | 10219198 | | 11/2003 |
| EP | 0264782 | | 4/1988 |
| EP | 0570999 | | 12/1988 |
| EP | 0322825 | | 7/1989 |
| EP | 0 546 844 | | 6/1993 |
| EP | 0570999 | | 11/1993 |
| EP | 0695565 | A1 | 2/1996 |
| EP | 0835676 | | 4/1998 |
| EP | 0848226 | | 6/1998 |
| EP | 0852961 | | 7/1998 |
| EP | 1062994 | | 12/2000 |
| EP | 1279425 | | 1/2003 |
| EP | 1293237 | | 3/2003 |
| EP | 0993845 | | 12/2005 |
| FR | 2547093 | A1 | 12/1984 |
| GB | 2244546 | | 12/1991 |
| GB | 2307133 | | 5/1997 |
| GB | 2310481 | | 8/1997 |
| GB | 2319374 | | 5/1998 |
| GB | 2325558 | A | 11/1998 |
| GB | 2388418 | | 11/2003 |
| JP | 62-14527 | | 1/1987 |
| JP | 63-186687 | | 8/1988 |
| JP | 3-210622 | | 9/1991 |
| JP | 03-210622 | | 9/1991 |
| JP | 06-154422 | | 6/1994 |
| JP | 06-190144 | | 7/1994 |
| JP | 06-198075 | | 7/1994 |
| JP | H0677387 | | 10/1994 |
| JP | 06-308879 | | 11/1994 |
| JP | 07-028591 | | 1/1995 |
| JP | 07-107573 | | 4/1995 |
| JP | 07-115690 | | 5/1995 |
| JP | 07-146123 | | 6/1995 |
| JP | 07-200142 | | 8/1995 |
| JP | 07-262797 | | 10/1995 |
| JP | 07-302148 | | 11/1995 |
| JP | 07-318332 | | 12/1995 |
| JP | 08-095704 | | 4/1996 |
| JP | 08-106352 | | 4/1996 |
| JP | 08-111144 | | 4/1996 |
| JP | 08-114415 | | 5/1996 |
| JP | 08-122070 | | 5/1996 |
| JP | 08-152959 | | 6/1996 |
| JP | 8-191953 | | 7/1996 |
| JP | 08-191953 | | 7/1996 |
| JP | 08-211993 | | 8/1996 |
| JP | 08-221187 | | 8/1996 |
| JP | 08-305355 | | 11/1996 |
| JP | 08-335136 | | 12/1996 |
| JP | 09-149915 | | 6/1997 |
| JP | 09-164273 | | 6/1997 |
| JP | 09-34456 | | 7/1997 |
| JP | 09-225137 | | 9/1997 |
| JP | 09-230997 | | 9/1997 |
| JP | 09-237087 | | 9/1997 |
| JP | 09-274534 | | 10/1997 |
| JP | 09-319510 | | 12/1997 |
| JP | 10-021000 | | 1/1998 |
| JP | 10-033831 | | 2/1998 |
| JP | 10 043349 | | 2/1998 |
| JP | 10-099542 | | 4/1998 |
| JP | 10-154038 | | 6/1998 |
| JP | 10-235019 | | 9/1998 |
| JP | 10-254614 | | 9/1998 |
| JP | 11-053994 | | 2/1999 |
| JP | 11-099284 | | 4/1999 |
| JP | 11-114223 | | 4/1999 |
| JP | 2000-033184 | | 2/2000 |
| JP | 2000-176150 | | 6/2000 |
| JP | 2000-208756 | | 7/2000 |
| JP | 2000-270237 | | 9/2000 |
| JP | 2000-300839 | | 10/2000 |
| JP | 2000-308756 | | 11/2000 |
| JP | 2000-325653 | | 11/2000 |
| JP | 2001-038052 | | 2/2001 |
| JP | 2001-058484 | | 3/2001 |
| JP | 2001-104643 | | 4/2001 |
| JP | U20009165 | | 4/2001 |
| JP | 2001-175412 | | 6/2001 |
| JP | 2001-251324 | | 9/2001 |
| JP | 2001-265521 | | 9/2001 |
| JP | 2001-306245 | | 11/2001 |
| JP | 2002-007057 | | 1/2002 |
| JP | 2002-062981 | | 2/2002 |
| JP | 03-262677 | | 3/2002 |
| JP | 2002-78969 | | 3/2002 |
| JP | 2002-082751 | | 3/2002 |
| JP | 2002-091692 | | 3/2002 |
| JP | 03-273531 | | 4/2002 |
| JP | 2002-126375 | | 5/2002 |
| JP | 2002-136694 | | 5/2002 |
| JP | 2002-153673 | | 5/2002 |
| JP | 2002-202843 | | 7/2002 |
| JP | 2002-224444 | | 8/2002 |
| JP | 2002-233665 | | 8/2002 |
| JP | 2002-298145 | | 10/2002 |
| JP | 2003-053038 | | 2/2003 |
| JP | 2003-140823 | | 5/2003 |
| JP | 03-422383 | | 6/2003 |
| JP | 2003-208263 | | 7/2003 |
| JP | 2003-236246 | | 8/2003 |
| JP | 2003-325974 | | 11/2003 |
| JP | 2004-062774 | | 2/2004 |
| JP | 03-517482 | | 4/2004 |
| JP | 2004-313429 | | 11/2004 |
| JP | 2004-313492 | | 11/2004 |
| JP | 2005-040493 | | 2/2005 |
| JP | 2005-063230 | | 3/2005 |
| JP | 2006-113019 | | 4/2006 |
| JP | 2006-136694 | | 6/2006 |
| JP | 2006-216569 | | 8/2006 |
| JP | 2007-083024 | | 4/2007 |
| NL | 9300171 | | 8/1994 |
| RU | 2077358 | C1 | 4/1997 |
| RU | 2125853 | | 2/1999 |
| RU | 2126161 | | 2/1999 |
| WO | WO 90/07961 | | 7/1990 |
| WO | WO 94/02931 | | 3/1994 |

(56) References Cited

FOREIGN PATENT DOCUMENTS

| | | | |
|---|---|---|---|
| WO | WO 95/11730 | A1 | 5/1995 |
| WO | WO 96/14115 | | 10/1995 |
| WO | WO 96/05766 | | 2/1996 |
| WO | WO 96/14121 | | 5/1996 |
| WO | WO 97/09101 | | 3/1997 |
| WO | WO 97/12337 | | 4/1997 |
| WO | WO 97/17598 | | 5/1997 |
| WO | WO 97/20305 | | 6/1997 |
| WO | PCT/US97/01811 | | 8/1997 |
| WO | WO 97/28864 | | 8/1997 |
| WO | WO 97/32641 | | 9/1997 |
| WO | WO 98/11528 | | 3/1998 |
| WO | WO 98/36400 | | 8/1998 |
| WO | WO 99/58214 | | 11/1999 |
| WO | WO 00/33168 | | 6/2000 |
| WO | WO 00/35345 | | 6/2000 |
| WO | WO 00/61251 | A1 | 10/2000 |
| WO | WO 00/63874 | | 10/2000 |
| WO | WO 00/67863 | | 11/2000 |
| WO | WO 01/87426 | | 11/2001 |
| WO | WO 01/91042 | | 11/2001 |
| WO | WO 02/17054 | | 2/2002 |
| WO | WO 02/34345 | | 5/2002 |
| WO | WO 02/47013 | | 6/2002 |
| WO | WO 03/015005 | | 2/2003 |
| WO | WO 03/043709 | | 5/2003 |
| WO | WO 03/044743 | A2 | 5/2003 |
| WO | WO 03/088147 | | 10/2003 |
| WO | WO 03/107260 | | 12/2003 |
| WO | WO 2004/039055 | | 5/2004 |
| WO | WO 2004/051391 | | 6/2004 |
| WO | WO 2004087271 | | 10/2004 |
| WO | WO 2006/039339 | | 4/2006 |
| WO | WO 2006/101880 | | 9/2006 |
| WO | WO 2007/058996 | | 5/2007 |
| WO | WO 2007/120880 | | 10/2007 |

OTHER PUBLICATIONS

"212 Series of Decoders" HT12D/HT12F by HOLTEK-Product Specification (Nov. 2002).

"212" Series Encoders HT12A/HT12E by HOLTEK- Product Specification (Apr. 2000).

"Enchanted Spell-Casting Sorcerers Wand" by Ken Holt as featured on www.inventionconnection.com online advertisement (Dec. 2002).

"Nintendo Wii Controller Invented by Americans: Midway Velocity Controller Technology Brief," Presentation dated Jun. 28, 2000, obtained from http://www.youtube.com/watch?v=wjLhSrSxFNw on Jun. 30, 2010, 1 page.

"Ollivanders: Makers of Fine Wands." Dec. 2, 2002. [online] [retrieved on Mar. 30, 2005], Retrieved from Internet <URL:http//www.cim.mcgill.edu/!jer/courses/hci/assignments/2002/www.ece.mcgill.ca/%7Eeuryd>.

"Owl Magic Wand and Owl Magic Orb" Press Release by Emerald Forest Toys (Nov. 2001).

"The Magic Labs Conjure Wands" as featured on www.magic-lab.com Product Specification Dec. 2002.

"Toy Wand Manufacturer Selects MEMSIC Sensor: Magic Labs cuts costs with MEMSIC sensor" Press Release by MEMSIC, Inc. as featured on www.memsic.com May 2002.

Allen, et al., "Tracking: Beyond 15 Minutes of Thought," SIGGRAPH 2001 Course 11 (Course Pack) from Computer Graphics (2001).

Azuma et al., "Improving Static and Dynamic Registration in an Optical See-Through HMD," International Conference on Computer Graphics and Interactive Techniques Proceedings of the 21st annual conference on Computer graphics and interactive techniques, pp. 197-204 (1994).

Badler et al., "Multi-Dimensional Input Techniques and Articulated Figure Positioning by Multiple Constraints," Interactive 3D Graphics, Oct. 1986; pp. 151-169.

Balakrishnan, "The Rockin' Mouse: Integral 3D Manipulation on a Plane," (CHI '97), Univ. Toronto, (1997).

Bhatnagar, "Position trackers for Head Mounted Display systems: A survey" (Technical Report), University of North Carolina at Chapel Hill (Mar. 1993).

Bianchi, "A Tailless Mouse, New cordless Computer Mouse Invented by ArcanaTech." Inc, Article (Jun. 1992).

Bishop, "The Self-Tracker: A Smart Optical Sensor on Silicon," Ph.D. Dissertation, Univ. of North Carolina at Chapel Hill (1984), 65 pages.

Britton et al., "Making Nested rotations Convenient for the User," ACM SIGGRAPH Computer Graphics, vol. 12, Issue 3, pp. 222-227 (Aug. 1978).

Britton, "A Methodology for the Ergonomic Design of Interactive Computer Graphic Systems, and its Application to Crystallography" (UNC Thesis) (1977).

Business Wire, "Feature/Virtual reality glasses that interface to Sega channel," Time Warner, TCI: project announced concurrent with Comdex (Nov. 1994).

Business Wire, "Free-space 'Tilt' Game Controller for Sony Playstation Uses Scenix Chip; SX Series IC Processes Spatial Data in Real Time for On-Screen" (Dec. 1999), 3 pages.

Business Wire, "Logitech Magellan 3D Controller," Logitech (Apr. 1997).

Business Wire, "Mind Path Introduces Gyropoint RF Wireless Remote" (Jan. 2000), 3 pages.

Business Wire, "Pegasus' Wireless PenCell Writes on Thin Air with ART's Handwriting Recognition Solutions," Business Editors/High Tech Writers Telecom Israel 2000 Hall 29, Booth 19-20 (Nov. 2000).

Business Wire, "RPI ships low-cost pro HMD Plus 3D Mouse and VR PC graphics card system for CES" (Jan. 1995).

Buxton, Bill, "Human input/output devices," In M. Katz (ed.), Technology Forecast: 1995, Menlo Park, C.A.; Price Waterhouse World Film Technology Center, 49-65 (1994).

Canaday, R67-26 "The Lincoln Wand," IEEE Transactions on Electronic Computers, vol. EC-16, No. 2, p. 240 (Apr. 1967), 1 page.

D.W. Kormos et al., "Intraoperative, Real-Time 3-D Digitizer for Neurosurgical Treatment and Planning," 1993; 1 page.

Foxlin et al., "An Inertial Head-Orientation Tracker with Automatic Drift Compensation for Use with HMD's," Proceedings of the conference on Virtual reality software and technology, Singapore, Singapore, pp. 159-173 (1994).

Foxlin et al., "Miniature 6-DOF Inertial System for Tracking HMDs," SPIE vol. 3362 (Apr. 1998).

Foxlin et al., "WearTrack: A Self-Referenced Head and Hand Tracker for Wearable Computers and Portable VR," International Symposium on Wearable Computers (ISWC 2000), Oct. 16-18, 2000, Atlanta, GA (2000).

Foxlin, "Head-tracking Relative to a Moving Vehicle or Simulator Platform Using Differential Inertial Sensors," InterSense, Inc., Presented: Helmet and Head-Mounted Displays V, SPIE vol. 4021, AeroSense Symposium, Orlando FL, Apr. 24-25, 2000 (2000).

Foxlin, "Inertial Head Tracker Sensor Fusion by a Complementary Separate-bias Kalman Filter," Proceedings of the IEEE 1996 Virtual Reality Annual International Symposium, pp. 185-194, 267 (1996).

Foxlin, et al., "Constellation: A Wide-Range Wireless Motion-Tracking System for Augmented Reality and Virtual Set Applications," ACM SIGGRAPH, pp. 372-378 (1998).

Hinckley et al., "The VideoMouse: A Camera-Based Multi-Degree-of-Freedom Input Device" A59, ACM UIST'99 Symposium on User Interface Software & Technology, CHI Letters 1 (1), pp. 103-112. (Jan. 1999), 10 pages.

Hinckley, et al., "Sensing Techniques for Mobile Interaction," Proceedings of the 13th Annual ACM Symposium on User Interface Software and Technology (San Diego, Cal.), ACM UIST 2000 & Technology, CHI Letters 2 (2), at 91-100 (ACM) (2000).

Interfax Press Release, "Tsinghua Tongfang Releases Unique Peripheral Hardware for 3D Gaming," 2002, 1 page.

Jakubowsk, et al., "Increasing Effectiveness of Human Hand Tremor Seperation Process by Using Higher-Order Statistics," Measurement Science Review, vol. 1 (2001).

(56) References Cited

OTHER PUBLICATIONS

James H. Clark, "Designing Surfaces in 3-D," Graphics and Image Processing-Communications of the ACM, Aug. 1976; vol. 19; No. 8; pp. 454-460.
James H. Clark, "Three Dimensional Man Machine Interaction," Siggraph '76, Jul. 14-16 Philadelphia, Pennsylvania, 1 page.
Jonathan Green et al., "Camping in the Digital Wilderness: Tents and Flashlights as Interfaces to Virtual Worlds," Chi 2002, Apr. 2002, pp. 780-781.
Ju, et al., "The Challenges of Designing a User Interface for Consumer Interactive Television Consumer Electronics Digest of Technical Papers.," IEEE 1994 International Conference on Volume , Issue , Jun. 21-23, 1994 pp. 114-115 (Jun. 1994).
Laser Tag: General info: History of Laser Tag; Mar. 1984 pp. 1-5.
Laser Tag: Lazer Tag Branded Gear; Sep. 2006, pp. 1-25.
Mackenzie et al., "A two-ball mouse affords three degrees of freedom," Extended Abstracts of the CHI '97 Conference on Human Factors in Computing Systems, pp. 303-304. New York: ACM (1997).
Maclean, "Designing with Haptic Feedback", Proceedings of IEEE Robotics and Automation (ICRA 2000), at 783-88 (Apr. 22-28, 2000).
Maybeck: "Stochastic Models, Estimation and Control," vol. 1, Mathematics in Science and Engineering, vol. 141 (1979).
Michael F. Deering, "HoloSketch A Virtual Reality Sketching Animation Tool," ACM Transactions on Computer-Human Interaction, Sep. 1995; vol. 2, No. 3; pp. 220-238.
Mitchel Resnick et al., "Digital Manipulatives: New Toys to Think With," Chi 98; Apr. 1998; pp. 281-287.
Naimark, et al., "Encoded LED System for Optical Trackers," Fourth IEEE and ACM International Symposium on Mixed and Augmented Reality, pp. 150-153 (2005).
New Strait Times Press Release, "Microsoft's New Titles," 1998, 1 page.
News Article "New Game Controllers Using Analog Devices' G-Force Tilt to be Featured at E3", Norwood, MA (May 10, 1999).
Newswire PR, "Five New Retailers to Carry Gyration's Gyropoint Point and Gyropoint Pro" (1996), 3 pages.
Nintendo Tilt Controller Ad, Electronic Gaming Monthly, 1994, 1 page.
Odell, "An Optical Pointer for Infrared Remote Controllers," Proceedings of International Conference on Consumer Electronics (1995).
Pajama Sam: No Need to Hide When It's Dark Outside Infogrames, Sep. 6, 2002.
Phillips, "On the Right Track: A unique optical tracking system gives users greater freedom to explore virutal worlds" (Apr. 2000).
Pierce et al., "Image Plane Interaction Techniques in 3D Immersive Environments," Proceedings of the 1997 symposium on Interactive 3D graphics, portal.acm.org (1997).
Pryor et al., "A Reusable Software Architecture for Manual Controller Integration," IEEE Conf. on Robotics and Automation, Univ of Texas (Apr. 1997).
R. Borovoy et al., "Things that Blink: Computationally Augmented Name Tags," IBM Systems Journal, vol. 35, Nos. 3 & 4, 1996; pp. 488-495.
Rekimoto, "Tilting Operations for Small Screen Interfaces," Proceedings of the 9th Annual ACM Symposium on User Interface Software and Technology, pp. 167-168 (1996).
Richard Borovoy et al., "Groupwear: Nametags That Tell About Relationships," Chi 98, Apr. 1998, pp. 329-330.
Riviere, et al., "Adaptive Canceling of Physiological Tremor for Improved Precision in Microsurgery," IEEE Transactions on Biomedical Engineering, vol. 45, No. 7 (Jul. 1998).
Robbinett et al., "Implementation of Flying, Scaling, and Grabbing in Virtual Worlds," ACM Symposium (1992).
Robert E. Drzymala et al., "A Feasibility Study Using a Stereo-Optical Camera System to Verify Gamma Knife Treatment Specification," Proceedings of 22nd Annual EMBS International Conference, Jul. 2000; pp. 1486-1489.
Robinett et al., "The Visual Display Transformation for Virtual Reality," University of North Carolina at Chapel Hill (1994).
Rolland, et al., "A Survey of Tracking Technology for Virtual Environments," University of Central Florida, Center for Research and Education in Optics Lasers (CREOL) (2001 ).
Schofield, Jack et al., Coming up for airpad, The Guardian (Feb. 2000).
Sutherland, "A Head-Mounted Three Dimensional Display," AFIPS '68 (Fall, part 1): Proceedings of the Dec. 9-11, 1968, fall joint computer conference, part I, pp. 757-764 (Dec. 1968).
Sutherland, Ivan E., "Sketchpad: A Man-Machine Graphical Communication System," AFIPS '63 (Spring): Proceedings of the May 21-23, 1963, Spring Joint Computer Conference, pp. 329-346 (May 1963).
Tech Designers Rethink Toys: Make Them Fun. Wall Street Journal, Dec. 14, 2001.
Timmer, "Modeling Noisy Time Series: Physiological Tremor," International Journal of Bifurcation and Chaos, vol. 8, No. 7 (1998).
Timmer, et al, "Pathological Tremors: Deterministic Chaos or Nonlinear Stochastic Oscillators?" Chaos, vol. 10, No. 1 (Mar. 2000).
Timmer, et al., "Cross-Spectral Analysis of Tremor Time Series," International Journal of Bifurcation and Chaos, vol. 10, No. 11 (2000).
Timmer, et al., Cross-Spectral Analysis of Physiological Tremor and Muscle Activity: II Application to Synchronized Electromyogram, Biological Cybernetics, vol. 78 (1998).
Toy Designers Use Technology in New Ways as Sector Matures, WSJ, Dec. 17, 2001.
UNC Computer Science Department, "News & Notes from Sitterson Hall," UNC Computer Science, Department Newsletter, Issue 24, Spring 1999 (Apr. 1999).
Vanessa Colella et al., "Participatory Simulations: Using Computational Objects to Learn about Dynamic Systems," Chi 98; Apr. 1998, pp. 9-10.
Vaz, et al., "An Adaptive Estimation of Periodic Signals Using a Fourier Linear Combiner," IEEE Transactions on Signal Processing, vol. 42, Issue 1, pp. 1-10 (Jan. 1994).
Verplaetse, "Inertial Proprioceptive Devices: Self-Motion Sensing Toys and Tools," IBM Systems Journal (Sep. 1996).
Verplaetse, "Inertial-Optical Motion-Estimating Camera for Electronic Cinematography," Masters of Science Thesis, MIT, (1997).
Wang, et al., "Tracking a Head-Mounted Display in a Room-Sized Environment with Head-Mounted Cameras," SPIE 1990 Technical Symposium on Optical Engineering and Photonics in Aerospace Sensing, vol. 1290, pp. 47-57 (1990).
Ward, et al., "A Demonstrated Optical Tracker With Scalable Work Area for Head-Mounted Display Systems," Symposium on Interactive 3D Graphics, Proceedings of the 1992 Symposium on Interactive 3D Graphics, pp. 43-52, ACM Press, Cambridge, MA (1992).
Watt 3D Computer Graphics, "Three-Dimensional Geometry in Computer Graphics,", pp. 1-22 Addison-Wesley (1999).
Welch, "Hawkeye Zooms in on Mac Screens with Wireless Infrared Penlight Pointer," MacWeek (May 1993).
Widrow, et al., "Fundamental Relations Between the LMS Algorithm and the DFT," IEEE Transactions on Circuits and Systems, vol. 34, No. CAS-7, (Jul. 1987).
Williams, et al., "Physical Presence: Palettes in Virtual Spaces," Society of Photo-Optical Instrumentation Engineers (SPIE) Conference Series, vol. 3639, No. 374-384 (May 1999).
Wormell, "Unified Camera, Content and Talent Tracking in Digital Television and Movie Production," InterSense, Inc. & Mark Read, Hypercube Media Concepts, Inc. Presented: NAB 2000, Las Vegas, NV, Apr. 8-13, 2000 (2000).
Youngblut, et al., "Review of Virtual Environment Interface Technology," Institute for Defense Analyses (Jul. 1996), 270 pages.
U.S. Appl. No. 60/730,659, Oct. 26, 2005, Marks et al.
"Wii Mailbag," IGN.com, Jan. 26, 2006 (accessed at http://uk.wii.ign.com/mail/2006-01-26.html on Aug. 31, 2011).
Acar, et al., "Experimental evaluation and comparative analysis of commercial variable-capacitance MEMS accelerometers," Journal of Micromechanics and Microengineering, vol. 13 (1), pp. 634-645, May 2003.

(56) References Cited

OTHER PUBLICATIONS

Achenbach, "Golf's New Measuring Stick," Golfweek, 1 page, Jun. 11, 2005.
Act Labs, Miacomet Background, Jan. 27, 2001, http://web.archive.org/web/200101271753/http://www.act-labs.com/ realfeel_background.htm, (accessed on Sep. 7, 2011).
Ang, et al., "Design of All-Accelerometer Inertial Measurement Unit for Tremor Sensing in Hand-held Microsurgical Instrument," Proceedings of the 2003 IEEE International Conference on Robotics & Automation, Sep. 14-19, 2003, Taipei, Taiwan, pp. 1781-1786 (2003).
Baudisch, et al., "Soap: a Pointing Device that Works in Mid-air," Proc. UIST '06, Oct. 15-18, 2006, Montreux, Switzerland (2006).
Bjork, Staffan et al., Pirates! Using the Physical World as a Game Board, Reportedly presented as part of INTERACT 2001: 8th TC.13 IFIP International Conference on Human-Computer Interaction, Jul. 9-13, 2001, Tokyo, Japan.
Bowman, et al., "An Introduction to 3-D User Interface Design," MIT Presence, vol. 10, No. 1, pp. 96-108 (Feb. 2001).
Brownell, Richard, Review: Peripheral-GameCube-G3 Wireless Controller, gamesarefun.com, Jul. 13, 2003 (accessed at http://www.gamesarefun.com/gamesdb/perireview.php?perireviewid=1 on Jul. 29, 2011).
Buchanan, Levi: "Happy Birthday, Rumble Pak," IGN.com, Apr. 3, 2008 (accessed at http://retro.ign.com/articles/864/864231p1.html on Jul. 29, 2011).
Buxton et al., "A Study in Two-Handed Input," Proceedings of CHI '86, pp. 321-326 (1986) (accessed at http://www.billbuxton.com/2hands.html on Jul. 29, 2011).
Buxton, Bill, A Directory of Sources for Input Technologies (last updated Apr. 19, 2001), http://web.archive.org/web/20010604004849/http://www.billbuxton.com/InputSources.html (accessed on Sep. 8, 2011).
CNET News.com, "Nintendo Wii Swings Into Action," May 25, 2006 (accessed at http://news.cnet.com/2300-1043_3-6070295-4.html on Aug. 5, 2011).
Colella, Vanessa et al., "Participatory Simulations: Using Computational Objects to Learn about Dynamic Systems," Chi 98; Apr. 1998, pp. 9-10.
Crecente, Brian, "Motion Gaming Gains Momentum," kotaku.com, Sep. 17, 2010 (accessed at http://kotaku.com/5640867/motion-gaming-gains-momentum on Aug. 31, 2011).
CSIDC Winners—"Tablet-PC Classroom System Wins Design Competition," IEEE Computer Society Press, vol. 36, Issue 8, pp. 15-18, IEEE Computer Society, Aug. 2003.
Ewalt, David M., "Nintendo's Wii is a Revolution," Review, Forbes.com, Nov. 13, 2006 (accessed at http://www.forbes.com/2006/11/13/wii-review-ps3-tech-media-cx_de_1113wii.html on Jul. 29, 2011).
Expert Report of Kenneth Holt on Behalf of Respondents Nintendo of America, Inc. and Nintendo Co., Ltd., dated Nov. 3, 2011.
Expert Report of Nathaniel Polish, Ph.D. on Behalf of Respondents Nintendo of America, Inc. and Nintendo Co., Ltd., dated Nov. 3, 2011.
Fielder, Lauren "E3 2001: Nintendo unleashes GameCube software, a new Miyamoto game, and more," GameSpot, May 16, 2001 (accessed at http://www.gamespot.com/news/2761390/e3-2001-nintendo-unleashes-gamecube-software-a-new-miyamoto-game-and-more?tag=gallery_summary%3Bstory on Jul. 29, 2011).
Foxlin, "Generalized architecture for simultaneous localization, auto-calibration, and map-building," IEEE/RSJ Conf. on Intelligent Robots and Systems (IROS 2002), Oct. 2-4, 2002, Lausanne, Switzerland (2002).
Foxlin, et al., "VIS-Tracker: A Wearable Vision-Inertial Self-Tracker," IEEE VR2003, Mar. 22-26, 2003, Los Angeles, CA (2003).
Frankle, "E3 2002: Roll O Rama," Roll-o-Rama GameCube Preview at IGN, May 23, 2002 (accessed at http://cube.ign.com/articles/360/360662p1.html on Sep. 7, 2011).
FrontSide Field Test, "Get This!" Golf Magazine, Jun. 2005, p. 36.
Furniss, Maureen, "Motion Capture," posted at http://web.mit.edu/m-i-t/articles/index_furniss.html on Dec. 19, 1999; paper presented at the Media in Transition Conference at MIT on Oct. 8, 1999 (accessed on Sep. 8, 2011).
Green, Jonathan, et al., "Camping in the Digital Wilderness: Tents and Flashlights As Interfaces to Virtual Worlds," Chi 2002, Apr. 2002, pp. 780-781.
Gyration Ultra Cordless Optical Mouse, Setting Up Ultra Mouse, Gyration Quick Start Card part No. DL-00071-0001 Rev. A. Gyration, Inc., Jun. 2003.
Hinckley, "Synchronous Gestures for Multiple Persons and Computers," Paper presented at ACM UIST 2003 Symposium on User Interface Software & Technology in Vancouver, BC, Canada (Nov. 2003).
Immersion, "Immersion Ships New Wireless CyberGlove(R) II Hand Motion-Capture Glove; Animators, Designers, and Researchers Gain Enhanced Efficiency and Realism for Animation, Digital Prototyping and Virtual Reality Projects," Business Wire, Dec. 7, 2005 (available at http://ir.immersion.com/releasedetail.cfm?releaseid=181278).
Kunz, Andreas M. et al., "Design and Construction of a New Haptic Interface," Proceedings of DETC '00, ASME 2000 Design Engineering Technical Conferences and Computers and Information in Engineering Conference, Baltimore, Maryland, Sep. 10-13, 2000.
Laser Tag: General info: History of Laser Tag, http://lasertag.org/general/history.html (accessed on Mar. 13, 2008; historical dates start on Mar. 1984).
Lee et al, "Tilta-Pointer: the Free-Space Pointing Device," Princeton COS 436 Project (Fall 2004); retrieved from Google's cache of http://www.milyehuang.com/cos436/project/specs.html on May 27, 2011.
Lee et al., "Two-Dimensional Position Detection System with MEMS Accelerometer for Mouse Applications," Design Automation Conference, 2001, Proceedings, 2001 pp. 852-857, Jun. 2001.
Leganchuk et al., "Manual and Cognitive Benefits of Two-Handed Input: An Experimental Study," ACM Transactions on Computer-Human Interaction, vol. 5, No. 4, pp. 326-259, Dec. 1998.
Liu, et al., "Enhanced Fisher Linear Discriminant Models for Face Recognition," Paper presented at 14th International Conference on Pattern Recognition (ICPR'98), Queensland, Australia (Aug. 1998).
Logitech's WingMan Cordless RumblePad Sets PC Gamers Free, Press Release, Sep. 2, 2001 (accessed at http://www.logitech.com/en-us/172/1373 on Aug. 5, 2011).
Louderback, J. "Nintendo Wii", Reviews by PC Magazine, Nov. 13, 2006 (accessed at http://www.pcmag.com/article/print/193909 on Sep. 8, 2011).
Marrin, "Possibilities for the Digital Baton as a General Purpose Gestural Interface," Late-Breaking/Short Talks, Paper presented at CHI 97 Conference in Atlanta Georgia, Mar. 22-27, 1997 (accessed at http://www.sigchi.org/chi97/proceedings/short-talk/tm.htm on Aug. 5, 2011).
"Raise High the 3D Roof Beam: Kids shape these PC games as they go along." by Anne Field, article as featured in Business Week 2001. (Nov. 26, 2001).
"Tilt Switch" by Fuji & Co. as featured on www.fuji-piezo.com online advertisement May 2001.
Algrain, "Estimation of 3-D Angular Motion Using Gyroscopes and Linear Accelerometers," IEEE ransactions on Aerospace and Electronic Systems, vol. 27, No. 6, pp. 910-920 (Nov. 1991).
Algrain, et al., "Accelerometer Based Line-of-Sight Stabilization Approach for Pointing and Tracking System," Second IEEE Conference on Control Applications, vol. 1 , Issue 13-16 pp. 159-163 (Sep. 1993).
Algrain, et al., "Interlaced Kalman Filtering of 3-D Angular Motion Based on Euler's Nonlinear Equations," IEEE Transactions on Aerospace and Electronic Systems, vol. 30, No. 1 (Jan. 1994).
Analog Devices "ADXL50 Single Axis Accelerometer" (Data Sheet), http://www.analog.com/en/obsolete/adx150/products/product.html (Mar. 1996).
Arcanatech IMP A Tailless Mouse Inc Jun. 1992.
Azarbayejani, et al., "Visually Controlled Graphics," IEEE Transactions on Pattern Analysis and Machine Intelligence, vol. 15, No. 6, pp. 602-605 (Jun. 1993).

(56) References Cited

OTHER PUBLICATIONS

Azuma et al., "Making Augmented Reality Work Outdoors Requires Hybrid Tracking,"Proceedings of the International Workshop on Augmented Reality, San Francisco, CA, Nov. 1, 1998, Bellevue, Washington, pp. 219-224 (1999).
Azuma, et al., "A motion-stabilized outdoor augmented reality system," Proceedings of IEEE Virtual Reality '99, Houston, TX (Mar. 1999).
BBN Report, "Virtual Environment Technology for Training (VETT)," The Virtual Environment and Teleoperator Research Consortium (VETREC) (Mar. 1992).
Bei, "BEI GyrochipTM Model QRS11 Data Sheet," BEI Systron Donner Inertial Division, BEI Technologies, Inc., (Sep. 1998).
Benbasat, "An Inertial Measurement Unit for User Interfaces," Massachusetts Institute of Technology Dissertation, (Sep. 2000), 135 pages.
Byte, "Imp Coexists With Your Mouse," What's New, ArcaneTec (Jan. 1994).
Caruso et al., "New Perspective on Magnetic Field Sensing," Sensors Magazine (Dec. 1998).
Caruso et al., "Vehicle Detection and Compass Applications using AMR Magnetic Sensors", Honeywell (May 1999).
Caruso, "Application of Magnetoresistive Sensors in Navigation Systems," Sensors and Actuators, SAE SP-1220, pp. 15-21 (Feb. 1997).
Caruso, "Applications of Magnetic Sensors for Low Cost Compass Systems," Honeywell, SSEC, http://www.ssec.honeywell.com/magnetic/datasheets/lowcost.pdf (May 1999).
Cutrone, "Hot products: Gyration GyroPoint Desk, GyroPoint Pro gyroscope-controlled wired and wireless mice" (Computer Reseller News) (Dec. 1995).
Emura, et al., "Sensor Fusion Based Measurement of Human Head Motion," 3rd IEEE International Workshop on Robot and Human Communication (Jul. 1994).
Fuchs (Foxlin), "Inertial Head-Tracking," MS Thesis, Massachusetts Institute of Technology, Dept. of Electrical Engineering and Computer Science (Sep. 1993).
Haykin, et al., "Adaptive Tracking of Linear Time-Variant Systems by Extended RLS Algorithms, IEEE Transactions on Signal Processing," vol. 45, No. 5 (May 1997).
Heath, "Virtual Reality Resource Guide Al Expert," v9 n5 p32(14) (May 1994).
Jacob, "Human-Computer Interaction—Input Devices" http://www.cs.tufts.edu/.about.jacob/papers/surveys.html, "Human-Computer Interaction: Input Devices," ACM Computing Surveys, vol. 28, No. 1, pp. 177-179 (Mar. 1996).
Kohlhase, "NASA Report, The Voyager Neptune travel guide," Jet Propulsion Laboratory Publication 89-24, excerpt (Jun. 1989).
Kuipers, Jack B., "SPASYN—An Electromagnetic Relative Position and Orientation Tracking System," IEEE Transactions on Instrumentation and Measurement, vol. 29, No. 4, pp. 462-466 (Dec. 1980).
La Scala, et al., "Design of an Extended Kalman Filter Frequency Tracker," IEEE Transactions on Signal Processing, vol. 44, No. 3 (Mar. 1996).
Liang, et al., "On Temporal-Spatial Realism in the Virtual Reality Environment," ACM 1991 Symposium on User Interface Software and Technology (Nov. 1991).
Liu, et al., "Enhanced Fisher Linear Discriminant Models for Face Recognition," Proc, 14.sup.th International Conference on Pattern Recognition, Queensland, Australia (Aug. 1998).
Luinge, et al., "Estimation of orientation with gyroscopes and accelerometers," Proceedings of the First Joint BMES/EMBS Conference, 1999., vol. 2, p. 844 (Oct. 1999).
Mackinlay, "Rapid Controlled Movement Through a Virtural 3D Workspace," ACM SIGGRAPH Computer Graphics archive, vol. 24, No. 4, pp. 171-176 (Aug. 1990).
Mulder, "Human movement tracking technology," School of Kinesiology, Simon Fraser University (Jul. 1994).
Nishiyama, "A Nonlinear Filter for Estimating a Sinusoidal Signal and its Parameters in White Noise: On the Case of a Single Sinusoid," IEEE Transactions on Signal Processing, vol. 45, No. 4 (Apr. 1997).
Nishiyama, "Robust Estimation of a Single Complex Sinusoid in White Noise-H.infin. Filtering Approach," IEEE Transactions on Signal Processing, vol. 47, No. 10 (Oct. 1999).
Ovaska, "Angular Acceleration Measurement: A Review," Instrumentation and Measurement Technology Conference, Conference Proceedings. IEEE, vol. 2 (Oct. 1998).
Pique, "Semantics of Interactive Rotations," Interactive 3D Graphics, Proceedings of the 1986 workshop on Interactive 3D graphics, pp. 259-269 (Oct. 1986).
Raab, et al., "Magnetic Position and Orientation Tracking System," IEEE Transactions on Aerospace and Electronic Systems, vol. AES-15, No. 5, pp. 709-718 (Sep. 1979).
Selectech Airmouse Mighty Mouse Electronics Today International p. 11 Sep. 1990.
Sorenson, et al., "The Minnesota Scanner: A Prototype Sensor for Three-Dimensional Tracking of Moving Body Segments," IEEE Transactions on Robotics and Animation (Aug. 1989).
Stovall, "Basic Inertial Navigation," NAWCWPNS TM 8128, Navigation and Data Link Section, Systems Integration Branch (Sep. 1997).
Titterton et al., "Strapdown Inertial Navigation Technology," pp. 1-56 and pp. 292-321 (May 1997).
Van Rheeden, et al., "Noise Effects on Centroid Tracker Aim Point Estimation," IEEE Trans. on Aerospace and Electronic Systems, vol. 24, No. 2, pp. 177-185 (Mar. 1988).
Welch, et al., "The High-Performance Wide-Area Optical Tracking : The HiBall Tracking System," MIT Presence, Presence, vol. 10 , No. 1 (Feb. 2001).
Welch, et al., "SCAAT: Incremental Tecking with Incomplete Information," Computer Graphics, SIGGRAPH 97 Conference Proceedings, pp. 333-344 (Aug. 1997).
You, et al., "Orientation Tracking for Outdoor Augmented Reality Registration," IEE Computer Graphics and Applications, IEEE, vol. 19, No. 6, pp. 36-42 (Nov. 1999).
"Coleco Vision: Super Action™ Controller Set," www.vintagecomputing.com/wp-content/images/retroscan/ coleco_sac_1_large.jpg., Sep. 2006.
"Controllers-Atari Space Age Joystic," AtariAge: Have You Played Atari Today? www.atariage.com/controller_page.html?SystemID=2600& ControllerID-12., Sep. 1, 2006.
"Controllers-Booster Grip," AtariAge: Have You Played Atari Today? www.atariage.com/controller_page.html?SystemID=2600& ControllerID=18., Sep. 1, 2006.
"Game Controller" Wikipedia, Jan. 5, 2005.
"Get Bass," Videogame by Sega, The International Arcade Museum and the KLOV (accessed at http://www.arcade-museum.com/game_detail.php?game_id=7933 on Jul. 29, 2011).
"Glove-based input interfaces" Cyberglove/Cyberforce, http://www.angelfire.com/ca7/mellott124/glove1.htm (accessed on Jul. 29, 2011).
Kirby Tilt 'n' Tumble (GCN-GBA Spaceworld 2001, You Tube Video, uploaded by adonfjv on Sep. 5, 2006 (accessed at http://www.youtube.com/watch?v=5rLhlwp2iGk on Sep. 7, 2011; digital video available upon request).
"Kirby Tilt 'n' Tumble 2" http://www.unseen64.net/2008/04/08/koro-koro-kirby-2-kirby-tilt-n-tumble-2-gc-unreleased/, Apr. 8, 2008 (accessed on Jul. 29, 2011).
"MEMS enable smart golf clubs," Small Times, Jan. 6, 2005, accessed at http://dpwsa.electroiq.com/index/display/semiconductors-article-display/269788/articles/smalltimes/consumer/2005/01/mems-enable-smart-golf-clubs.html on Jul. 29, 2011.
"Miacomet and Interact Announce Agreement to Launch Line of Reel Feel™ Sport Controllers", PR Newswire (May 13, 1999), accessed at http://www.thefreelibarary.com/_print/PrintArticle.aspx?id=54621351 on Sep. 7, 2011.
"Interview with Pat Goschy, the "Real" Nintendo Wii Inventor," YouTube video uploaded by agbulls on Jan. 14, 2008 (accessed at http://www.youtube.com/watch?v=oKtZysYGDLE on Feb. 11, 2011; digital video available upon request).
"Ollivanders: Makers of Fine Wands." Dec. 2, 2002. [online] [retrieved on Mar. 30, 2005], Retrieved from Internet<URL:http//.www.cim.mcgill.edu/!jer/courses/hci/assignments/2002/www.ece.mcgill.ca/%7Eeu ryd>.

(56) References Cited

OTHER PUBLICATIONS

"The Big Ideas Behind Nintendo's Wii," Business Week, Nov. 16, 2006 (accessed at http://www.businessweek.com/technology/content/nov2006/tc20061116_750580.htm on Aug. 31, 2011).
Merians, et al., "Virtual Reality-Augmented Rehabilitation for Patients Following Stroke," Physical Therapy, vol. 82, No. 9, Sep. 2002.
Merrill, "FlexiGesture: A sensor-rich real-time adaptive gesture and affordance learning platform for electronic music control," Thesis, Massachusetts Institute of Technology, Jun. 2004.
Miller, Paul, "Exclusive shots of Goschy's prototype 'Wiimote' controllers," Engadget, Jan. 15, 2008 (accessed at http://www.engadget.com/2008/01/15/exclusive-shots-of-goschys-prototype-wiimote-controllers/ on Aug. 31, 2011).
Miller, Ross, "Joystiq interview: Patrick Goschy talks about Midway, tells us he 'made the Wii'," Joystiq.com, Jan. 16, 2008 (accessed at http://www.joystiq.com/2008/01/16/joystiq-interview-patrick-goschy-talks-about-midway-tells-us-h/ on Aug. 31, 2011).
Nintendo, Nintendo Game Boy Advance Wireless Adapter, Sep. 26, 2003.
Pai, et al., "The Tango: A Tangible Tangoreceptive Whole-Hand Interface," Paper presented at Joint Eurohaptics and IEEE Symposium on Haptic Interfaces for Virtual Environment and Teleoperator Systems, Pisa, Italy, Mar. 18-20, 2005 (2005).
Paley, W. Bradford, "Interaction in 3D Graphics," SIGGRAPH Computer Graphics Newsletter, col. 32, No. 4 (Nov. 1998) (accessed at http://www.siggraph.org/publications/newsletter/v32n4/contributions/paley.html on Aug. 2, 2011).
Paradiso, et al., "Interactive Therapy with Instrumented Footwear," CHI 2004, Apr. 24-29, 2004, Vienna, Austria.
Paradiso, Joseph A., "The Brain Opera Technology: New Instruments and Gestural Sensors for Musical Interaction and Performance" (Nov. 1998) (electronic copy available at http://pubs.media.mit.edu/pubs/papers/98_3_JNMR_Brain_Opera.pdf).
PC World, "The 20 Most Innovative Products of the Year," Dec. 27, 2006 (accessed at http://www.pcworld.com/printable/article/id,128176/printable.html on Aug. 2, 2011).
Perry, Simon, "Nintendo to Launch Wireless Game Boy Adaptor," Digital Lifestyles, http://digital-lifestyles.info/2003/09/26/Nintendo-to-launch-wireless-game-boy-adaptor/, Sep. 26, 2003 (accessed on Jul. 29, 2011).
Phillips, "LPC2104/2105/2106, Single-chip 32-bit microcontrollers; 128 kB ISP/IAP Flash with 64 kB/32 kB/16 kB RAM," 32 pages, Dec. 22, 2004.
Piyabongkarn, "Development of a MEMS Gyroscope for Absolute Angle Measurement," Dissertation, Univ. Minnesota, Nov. 2004.
PowerGlove product Program Guide, Mattel, 1989 (Text of Program Guide provided from http://hiwaay.net/~lkseitz/cvtg/power_glove.shtml; the text was typed in by Lee K. Sietz; document created Aug. 25, 1988; accessed on Aug. 2, 2011).
PR Newswire, "Five New Retailers to Carry Gyration's Gyropoint Point and Gyropoint Pro," Jul. 8, 1996 (accessed at http://www.thefreelibrary.com/__/print/PrintArticle.aspx?id=54592268 on Jun. 18, 2010).
Resnick et al; Digital Manipulatives: New Toys to Think With; Apr. 1998; 7 pages.
Respondents Nintendo Co., Ltd. and Nintendo of America Inc.'s Objections and Supplemental Responses to Complainants Creative Kingdoms, LLC and New Kingdoms, LLC's Interrogatory Nos. 35, 44, 47, 53, and 78, dated Oct. 13, 2011.
Response to Office Action dated Sep. 18, 2009 for U.S. Appl. No. 11/404,844.
Ribo, et al., "Hybrid Tracking for Outdoor Augmented Reality Applications," IEEE Computer Graphics and Applications, vol. 22, No. 6, pp. 54-63, Nov./Dec. 2002.
Rothman, Wilson, "Unearthed: Nintendo's Pre-Wiimote Prototype," gizmodo.com, Aug. 29, 2007 (accessed at http://gizmodo.com/gadgets/exclusive/unearthed-nintendo-2001-prototype-motion+sensing-one+handed-controller-by-gyration-294642.php on Aug. 31, 2011).
Rothman, Wilson, "Wii-mote Prototype Designer Speaks Out, Shares Sketchbook," Gizmodo.com, Aug. 30, 2007 (accessed at http://gizmodo.com/gadgets/exclusive/wii+mote-prototype-designer-speaks-out-shares-sketchbook-295276.php on Aug. 31, 2011).
Satterfield, Shane, "E3 2002: Nintendo announces new GameCube games," GameSpot, http://www.gamespot.com/gamecube/action/rollorama/news/2866974/e3-2002-nintendo-announces-new-gamecube-games, May 21, 2002 (accessed on Aug. 11, 2011).
Sawada, et al., "A Wearable Attitude-Measurement System Using a Fiberoptic Gyroscope," MIT Presence, vol. 11, No. 2, pp. 109-118, Apr. 2002.
Skiens, Mike, "Nintendo Announces Wireless GBA Link", Bloomberg, Sep. 25, 2003 (accessed at http://www.nintendoworldreport.com/news/9011).
Smartswing, "The SmartSwing Learning System: How it Works," 3 pages, Apr. 26, 2004, http://web.archive.org/web/20040426213631/http://www.smartswinggolf.com/tls/how_it_works.html (accessed on Jul. 29, 2011).
Smartswing, "The SmartSwing Product Technical Product: Technical Information," Apr. 26, 2004, http://web.archive.org/web/20040426174854/http://www.smartswinggolf.com/products/technical_info.html (accessed on Jul. 29, 2011).
Sulic, "Logitech Wingman Cordless Rumblepad Review," Gear Review at IGN, Jan. 14, 2002 (accessed at http://gear.ign.com/articles/317/317472p1.html on Aug. 1, 2011).
Tech Designers Rethink Toys: Make Them Fun Wall Street Journal, Dec. 17, 2001.
U.S. Appl. No. 60/730,659 to Marks et al., filed Oct. 25, 2005.
Ulanoff, Lance, "Nintendo's Wii is the Best Product Ever," PC Magazine, Jun. 21, 2007 (accessed at http://www.pcmag.com/print_article2/0,1217,a=210070,00.asp?hidPrint=true on Aug. 1, 2011).
U.S. Appl. No. 60/214,317, filed Jun. 27, 2000.
Van Laerhoven et al., "Using an Autonomous Cube for Basic Navigation and Input," Proceedings of the 5th International Conference on Multimodal interfaces, Vancouver, British Columbia, Canada, pp. 203-210, Nov. 5-7, 2003.
Villoria, Gerald, "Hands on Roll-O-Rama Game Cube," Game Spot, http://www.gamespot.com/gamecube/action/rollorama/news.html?sid=2868421&com_act=convert&om_clk=newsfeatures&tag=newsfeatures;title;1&m, May 29, 2002 (accessed on Jul. 29, 2011).
Wiley, M., "Nintendo Wavebird Review," Jun. 11, 2002, http://gear.ign.com/articles/361/361933p1.html (accessed on Aug. 1, 2011).
Williams et al., "The Virtual Haptic Back Project," presented at the IMAGE 2003 Conference, Scottsdale, Arizona, Jul. 14-18, 2003.
Wilson "XWand: UI for Intelligent Environments," http://research.microsoft.com/en-us/um/people/awilson/wand/default.htm, Apr. 2004.
Wired Glove, Wikipedia article, 4 pages, http://en.wikipedia.org/wiki/Wired_glove, Nov. 18, 2010.
Wormell et al., "Advancements in 3D Interactive Devices for Virtual Environments," Presented at the Joint International Immersive Projection Technologies (IPT)/Eurographics Workshop on Virtual Environments (EGVE) 2003 Workshop, Zurich, Switzerland, May 22-23, 2003 (available for download at http://www.intersense.com/pages/44/123/) (2003).
Zhai, "User Performance in Relation to 3D Input Device Design," Computer Graphics 32(4), pp. 50-54, Nov. 1998; text downloaded from http://www.almaden.ibm.com/u/zhai/papers/siggraph/final.html on Aug. 1, 2011.
Zowie Playsets, http://www.piernot.com/proj/zowie/ (accessed on Jul. 29, 2011).
"At-home fishing", http:www.virtualpet.com/vp/media/fishing/homef.jpg (accessed on Jan. 14, 2010).
"ASCII Entertainment releases the Grip," ASCII Entertainment Software—Press News—Coming Soon Magazine, May 1997 (electronic version accessed at http://www.csoon.com/issue25/p_ascii4.htm on Sep. 6, 2011).
"Emerald Forest Toys" [online] [retrieved on Sep. 14, 2005], retrieved from Internet <URL:http://www.pathworks.net/print_eft.html>.

(56) References Cited

OTHER PUBLICATIONS

"Sony PS2 Motion Controller 5 years ago (2004)," YouTube Video uploaded by r1oot on Jul. 8, 2009 (accessed at http://www.youtube.com/watch?v=JbSzmRt7HhQ&feature=related on Sep. 6, 2011; digital video available upon request).
ASCII, picture of one-handed controller, 2 pages, Feb. 6, 2006.
Bluffing Your Way in Pokemon, Oct. 14, 2002, 7 pages.
Briefs, (New & Improved), (Brief Article), PC Magazine, Oct. 26, 1993.
Britton et al., "Making Nested Rotations Convenient for the User," SIGGRAPH '78 Proceedings of the 5th Annual Conference on Computer Graphics and Interactive Techniques, vol. 12, Issue 3, pp. 222-227 (Aug. 1978).
Business Wire, "Feature/Virtual reality glasses that interface to Sega channel,Time Warner, TCI; project announced concurrent with COMDEX," Nov. 14, 1994 (accessed at http://findarticles.com/p/articles/mi_m0EIN/is_1994_Nov_14/ai_15923497/?tag=content;col1 on Jul. 7, 2010).
Business Wire, "Free-space 'Tilt' Game Controller for Sony Playstation Uses Scenix Chip; SX Series IC Processes Spatial Data in Real Time for On-Screen," Dec. 6, 1999 (accessed at http://findarticles.com/p/articles/mi_m0EIN/is_1999_Dec_6/ai_58042965/?tag=content;col1 on Jul. 7, 2010)).
Business Wire, "Logitech MAGELLAN 3D Controller," Apr. 14, 1997 (accessed at http://www.thefreelibrary.com/_/print/PrintArticle.aspx?id=19306114 on Feb. 10, 2011).
Business Wire, "Mind Path Introduces GYROPOINT RF Wireless Remote," Jan. 27, 2000 (accessed at http://www.allbusiness.com/company-activities-management/operations-office/6381880-1.html on Jun. 17, 2010).
Business Wire, "Pegasus' Wireless PenCell Writes on Thin Air with ART's Handwriting Recognition Solutions," Business Editors/High Tech Writers Telecom Israel 2000 Hall 29, Booth 19-20, Nov. 7, 2000 (accessed at http://www.highbeam.com/doc/1G1-66658008.html on Jun. 17, 2010).
Business Wire, "RPI ships low-cost pro HMD Plus 3D Mouse and VR PC graphics card system for CES," Jan. 9, 1995 (accessed at http://www.highbeam.com/doc/1G1-16009561.html on Jun. 17, 2010).
Business Wire, "InterSense Inc. Launches InertiaCube2—The World's Smallest Precision Orientation Sensor with Serial Interface," Aug. 14, 2001 (accessed at http://www.highbeam.com/doc/1G1-77183067.html/print on Sep. 7, 2011.
Clark, James H., "Designing Surfaces in 3-D," Graphics and Image Processing-Communications of the ACM, Aug. 1976; vol. 19; No. 8; pp. 454-460.
Complainants' Petition for Review, dated Sep. 17, 2012.
Complainants' Response to Commission's Request for Statements on the Public Interest, dated Oct. 10, 2012.
Complainants' Response to Respondents' Petition for Review, dated Sep. 25, 2012.
Dichtburn, "Camera in Direct3D" Toymaker (Feb. 6, 2005), http://web.archive.org/web/20050206032104/http:toymaker.info/games/html/camera.html (accessed on Jul. 29, 2011).
Digital ID Cards The next generation of 'smart' cards will have more than a one-track mind. Wall Street Journal, Jun. 25, 2001.
Expert Report of Branimir R. Vojcic, Ph.D. on Behalf of Complainants Creative Kingdoms, LLC and New Kingdoms, LLC, dated Nov. 17, 2011.
Ferrin, "Survey of Helmet Tracking Technologies," Proc. SPIE vol. 1456, p. 86-94 (Apr. 1991).
Foremski, T., "Remote Control Mouse Aims at Interactive TV" Electronics Weekly, Mar. 9, 1994.
Foxlin et al., "An Inertial Head-Orientation Tracker with Automatic Drift Compensation for Use with HMD's," Proceedings of the 1994 Virtual Reality Software and Technology Conference, Aug. 23-26, 1994, Singapore, pp. 159-173 (1994).
Foxlin et al., "Miniature 6-DOF Inertial System for Tracking HMDs," SPIE vol. 3362, Helmet and Head-Mounted Displays III, AeroSense 98, Orlando, FL, Apr. 13-14, 1998 (1998).
Foxlin et al., "WearTrack: A Self-Referenced Head and Hand Tracker for Wearable Computers and Portable VR," Proceedings of International Symposium on Wearable Computers (ISWC 2000), Oct. 16-18, 2000, Atlanta, GA (2000).
Foxlin et al., "FlightTracker: A Novel Optical/Inertial Tracker for Cockpit Enhanced Vision, Symposium on Mixed and Augmented Reality," Proceedings of the 3rd IEEE/ACM International Symposium on Mixed and Augmented Reality (ISMAR 2004), Nov. 2-5, 2004, Washington, D.C. (2004).
Foxlin, "Head-tracking Relative to a Moving Vehicle or Simulator Platform Using Differential Inertial Sensors," Proceedings of Helmet and Head-Mounted Displays V, SPIE vol. 4021, AeroSense Symposium, Orlando, FL, Apr. 24-25, 2000 (2000).
Foxlin, et al., "Constellation™: A Wide-Range Wireless Motion-Tracking System for Augmented Reality and Virtual Set Applications," ACM SIGGRAPH 98, Orlando, Florida, Jul. 19-24, 1998 (1998).
Foxlin, et al., "Miniaturization, Calibration & Accuracy Evaluation of a Hybrid Self-Tracker," IEEE/ACM International Symposium on Mixed and Augmented Reality (ISMAR 2003), Oct. 7-10, 2003, Tokyo, Japan (2003).
gamecubicle.com News Article, Nintendo WaveBird Controller, http://www.gamecubicle.com/news-Nintendo_gamecube_wavebird_controller.htm, May 14, 2002 (accessed on Aug. 5, 2011).
Gelmis, J., "Ready to Play, The Future Way," Buffalo News, Jul. 23, 1996 (accessed from LexisNexis research database on Sep. 6, 2011).
Harada et al., "Portable Absolute Orientation Estimation Device with Wireless Network Under Accelerated Situation" Proceedings of the 2004 IEEE International Conference on Robotics & Automation, New Orleans, LA, Apr. 2004, pp. 1412-1417(2004).
Heath, "Virtual Reality Resource Guide Al Expert," v9 n5 p32(14) (May 1994) (accessed at http://ftp.hitl.washington.edu/scivw-ftp/commercial/VR-Resource-Guide.txt on Jun. 17, 2010).
HiBall-3100—"Wide-Area, High-Precision Tracker and 3D Digitizer," www.3rdtech.com/HiBall.htm (accessed on Jul. 29, 2011).
Hind, Nicholas, "Cosmos: A composition for Live Electronic Instruments Controlled by the Radio Baton and Computer Keyboard (Radio Baton and Magic Glove)," A Final Project Submitted to the Department of Music of Stanford University in Partial Fulfillment of the Requirements for the Degree of Doctor Musical Arts/UMI Microform 9837187, Jan. 1998.
IGN Article—Mad Catz Rumble Rod Controller, Aug. 20, 1999.
Initial Determination on Violation of Section 337 and Recommended Determination on Rememdy and Bond, dated Aug. 31, 2012.
International Preliminary Examination Report, International App. No. PCT/US00/09482; dated Apr. 24, 2001; 4 pages.
International Search Report and Written Opinion, International App. No. PCT/US04/08912; mailed Aug. 26, 2004; 10 pages.
International Search Report and Written Opinion, International App. No. PCT/US05/34831; mailed Jul. 2, 2008; 11 pages.
International Search Report and Written Opinion; International Appl. No. PCT/US2006/043915; mailed Mar. 9, 2007; 8 pages.
Intersense, "InterSense Inc., The New Standard in Motion Tracking," Mar. 27, 2004, http://web.archive,org!web12004040500550Z/http://intersense.com (accessed on May 19, 2009).
Intersense, "InterSense Mobile Mixed Reality Demonstration," YouTube Video dated Oct. 2006 on opening screen; uploaded by InterSenseInc. on Mar. 14, 2008 (accessed at http://www.youtube.com/watch?v=daVdzGK0nUE&feature=channel_page on Sep. 8, 2011; digital video available upon request).
Intersense, "IS-900 Precision Motion Trackers," Jun. 14, 2002, http://web.archive.org/web/20020614110352/http://www.isense.com/products/prec/is900/ (accessed on Sep. 8, 2011).
Intersense, Inc., "Comparison of Intersense IS-900 System and Optical Systems," Whitepaper, Jul. 12, 2004., available at http://www.jazdtech.com/techdirect/research/InterSense-Inc.htm?contentSetId=60032939&supplierId=60018705.
Ju, et al., "The Challenges of Designing a User Interface for Consumer Interactive Television Consumer Electronics Digest of Technical Papers.," IEEE 1994 International Conference on Volume , Issue , Jun. 21-23, 1994 pp. 114-115 (Jun. 1994) (downloaded from IEEE Xplore on Jul. 13, 2010).

(56) References Cited

OTHER PUBLICATIONS

Keir et al., "Gesture-recognition with Nonreferenced Tracking," IEEE Symposium on 3D User Interfaces, pp. 151-158, Mar. 25-26, 2006.
Kennedy, P.J. "Hand-held Data Input Device," IBM Technical Disclosure Bulletin, vol. 26, No. 11, pp. 5826-5827, Apr. 1984.
Kindratenko, "A Comparison of the Accuracy of an Electromagnetic and a Hybrid Ultrasound-Inertia Position Tracking System," MIT Presence, vol. 10, No. 6, pp. 657-663, Dec. 2001.
Kosak, Dave, "Mind-Numbing New Interface Technologies," Gamespy.com, Feb. 1, 2005 (accessed at http://www.gamespy.com/articles/584/584744p1.html on Aug. 31, 2011).
Laughlin et al., "Inertial Angular Rate Sensors: Theory and Applications," Sensors Magazine Oct. 1992.
Lee et al., "Innovative Estimation Method with Measurement Likelihood for all-Accelerometer Type Inertial Navigation System," IEEE Transactions on Aerospace and Electronic Systems, vol. 38, No. 1, Jan. 2002.
Link, "Field-Qualified Silicon Accelerometers from 1 Milli g to 200,000 g," Sensors, Mar. 1993.
Lobo et al., "Vision and Inertial Sensor Cooperation Using Gravity as a Vertical Reference," IEEE Trans. on Pattern Analysis and Machine Intelligence, vol. 25, No. 12, pp. 1597-1608, Dec. 2003.
Logitech, "Logitech Tracker—Virtual Reality Motion Tracker," downloaded from http://www.vrealities.com/logitech.html on Jun. 18, 2010.
Marks, Richard (Jan. 21, 2004) (Windows Media v7). EyeToy: A New Interface for Interactive Entertainment, Stanford University (accessed at http://lang.stanford.edu/courses/ee380/2003-2004/040121-ee380-100.wmv on Sep. 7, 2011; digital video available upon request).
Morgan, C., "Still chained to the overhead projector instead of the podium," (TV Interactive Corp's LaserMouse Remote Pro infrared mouse) (clipboard) (brief article) (product announcement) Government Computer News, Jun. 13, 1994.
Moser, "Low Budget Inertial Navigation Platform (2000)," www.tmoser.ch/typo3/11.0.html (accessed on Jul. 29, 2011).
Myers et al., "Interacting at a Distance: Measuring the Performance of Laser Pointers and Other Devices," CHI 2002, Apr. 2002.
News Article, "New Game Controllers Using Analog Devices' G-Force Tilt to be Featured at E3", Norwood, MA (May 10, 1999) (accessed at http://www.thefreelibrary.com/__/print/PrintArticle.aspx?id=54592268 on Jun. 17, 2010).
Nishiyama, "Robust Estimation of a Single Complex Sinusoid in White Noise-H∞ Filtering Approach," IEEE Transactions on Signal Processing, vol. 47, No. 10, pp. 2853-2856 (Oct. 1999).
Odell, "An Optical Pointer for Infrared Remote Controllers," (1995) (downloaded from IEEE Xplore on Jul. 7, 2010).
Petition of the Office of Unfair Import Investigations for Review-in-Part of the Final Initial Determination, dated Sep. 17, 2012.
Phillips, "Forward/Up Directional Incompatibilities During Cursor Placement Within Graphical User Interfaces," Ergonomics, vol. 48, No. 6, May 15, 2005.
Phillips, "Techwatch: On the Right Track: A unique optical tracking system gives users greater freedom to explore virtual worlds," Computer Graphics World, vol. 23, Issue 4 (Apr. 2000).
PR Newswire, "Three-Axis MEMS-based Accelerometer From STMicroelectronics Targets Handheld Terminals," Feb. 18, 2003 (accessed at http://www.thefreelibrary.com/__/print/PrintArticle.aspx?id=54592268 on Aug. 3, 2011).
Pre-Hearing Statement of Complainants Creative Kingdoms, LLC and New Kingdoms, LLC, dated Jan. 13, 2012.
Pryor et al., "A Reusable Software Architecture for Manual Controller Integration," IEEE Conf. on Robotics and Automation, Univ of Texas, pp. 3583-3588 (Apr. 1997).
Regan, "Smart Golf Clubs," baltimoresun.com, Jun. 17, 2005.
Respondents Nintendo Co., Ltd. and Nintendo of America Inc.'s Contingent Petition for Review of Initial Determination, dated Sep. 17, 2012.
Respondents Nintendo Co., Ltd. and Nintendo of America Inc.'s Response to Complainants' and Staff's Petitions for Review, dated Sep. 25, 2012.
Response of the Office of Unfair Import Investigations to the Petitions for Review, dated Sep. 25, 2012.
Reunert, "Fiber-Optic Gyroscopes: Principles and Applications," Sensors, Aug. 1993, pp. 37-38.
Riviere, et al., "Adaptive Canceling of Physiological Tremor for Improved Precision in Microsurgery," IEEE Transactions on Biomedical Engineering, vol. 45, No. 7, pp. 839-846 (Jul. 1998).
Romer, Kay et al., Smart Playing Cards: A Ubiquitous Computing Game, Personal and Ubiquitous Computing, Dec. 2002, vol. 6, Issue 5-6, pp. 371-377, London, England.
Sayed, "A Framework for State-Space Estimation with Uncertain Models," IEEE Transactions on Automatic Control, vol. 46, No. 7, Jul. 2001.
Schofield, Jack et al., Games reviews, "Coming up for airpad," The Guardian (Feb. 3, 2000) (accessed at http://www.guardian.co.uk/technology/2000/feb/03/online supplement5/print on Jun. 18, 2010).
Smartswing, "SmartSwing: Intelligent Golf Clubs that Build a Better Swing," http://web.archive.org/web/20040728221951/http://www.smartswinggolf.com/ (accessed on Sep. 8, 2011).
Smartswing, "The SmartSwing Learning System Overview," Apr. 26, 2004, http://web.archive.org/web/2004426215355/http://www.smartswinggolf.com/tls/index.html (accessed on Jul. 29, 2011).
Smartswing, Training Aid, Austin, Texas, Apr. 2005.
Specification of the Bluetooth System—Core v1.0b, Dec. 1, 1999.
Sutherland, "A Head-Mounted Three Dimensional Display," Paper presented at AFIPS '68 Fall Joint Computer Conference, Dec. 9-11, 1968, (1968); electronic paper available at www.cise.ufl.edu/~lok/teaching/dcvef05/papers/sutherland-headmount.pdf.
Sutherland, Ivan E., "Sketchpad: A Man-Machine Graphical Communication System," Proceedings of the AFIPS Spring Joint Computer Conference, Detroit, Michigan, May 21-23, 1963, pp. 329-346 (source provided is reprinting of text accessed at http://www.guidebookgallery.org/articles/sketchpadamanmachinegraphicalcommunicationsystem on Sep. 8, 2011).
Templeman, James N., "Virtual Locomotion: Walking in Place through Virtual Environments," Presence, vol. 8, No. 6, pp. 598-617, Dec. 1999.
Timmer, et al, "Pathological Tremors: Deterministic Chaos or Nonlinear Stochastic Oscillators?" Chaos, vol. 10, No. 1 pp. 278-288 (Mar. 2000).
Traq 3D, "Healthcare,"http: //www.traq3d.com/Healthcare/Healthcare.aspx (accessed on Jan. 21, 2010).
US Dynamics Corp, "Spinning Mass Mechanical Gyroscopes," Aug. 2006.
US Dynamics Corp, "The Concept of 'Rate', (more particularly, angular rate pertaining to rate gyroscopes) (rate gyro explanation)," Aug. 2006.
US Dynamics Corp, "US Dynamics Model 475 Series Rate Gyroscope Technical Brief," Dec. 2005.
US Dynamics Corp, "US Dynamics Rate Gyroscope Interface Brief (rate gyro IO)" Aug. 2006.
Van Den Bogaard, Thesis, "Using linear filters for real-time smoothing of rotational data in virtual reality application," dated Aug. 2, 2004, available at http://www.science.uva.nl/research/ias/alumni/m.sc.theses/theses/RobvandenBogaarad.pdf.
Vaz, et al., "An Adaptive Estimation of Periodic Signals Using a Fourier Linear Combiner," IEEE Transactions on Signal Processing, vol. 42, No. 1, pp. 1-10 (Jan. 1994).
Verplaetse, "Inertial Proprioceptive Devices: Self-Motion Sensing Toys and Tools," IBM Systems Journal, vol. 35, Nos. 3&4 (Sep. 1996).
Vorozcovs et al., "The Hedgehog: A Novel Optical Tracking Method for Spatially Immersive Displays," MIT Presence, vol. 15, No. 1, pp. 108-121, Feb. 2006.
Welch, "Hawkeye Zooms in on Mac Screens with Wireless Infrared Penlight Pointer," MacWeek, May 3, 1993 (excerpt of article accessed at http://www.accessmylibrary.com/article/print/1G1-13785387 on Jun. 18, 2010 ).

(56) References Cited

OTHER PUBLICATIONS

Williams, et al., "Physical Presence: Palettes in Virtual Spaces," Society of Photo-Optical Instrumentation Engineers (SPIE) Conference Series, vol. 3639, No. 374-384 (May 1999), available at http://www.fakespacelabs.com/papers/3639_46_LOCAL.pdf.
Wilson et al., "Xwand: UI for Intelligent Spaces," Paper presented at CHI 2003 Conference, Ft. Lauderdale, FL, Apr. 5-10, 2003, available at http://research.microsoft.com/en-us/um/people/awilson/publications/WilsonCHI2003/CHI%202003%20XWand.pdf (2003).
Worringham, et al., "Directional Stimulus-Response Compatibility: A Test of Three Alternative Principles," Ergonomics, vol. 41, Issue 6, pp. 864-880 (Jun. 1998).
Yang et al., "Implementation and Evaluation of 'Just Follow Me': An Immersive, VR-Based, Motion-Training System," MIT Presence: Teleoperators and Virtual Environments, vol. 11, No. 3, at 304-23 (MIT Press), Jun. 2002.
Yun et al., "Recent Developments in Silicon Microaccelerometers," SENSORS, 9(10) University of California at Berkeley, Oct. 1992.
Zhou et al., "A survey—Human Movement Tracking and Stroke Rehabilitation," Technical Report: CSM-420, ISSN 1744-8050, Dept. of Computer Sciences, University of Essex, UK, Dec. 8, 2004.
Zhu et al., "A Real-Time Articulated Human Motion Tracking Using Tri-Axis Inertial/Magnetic Sensors Package," IEEE Transactions on Neural Systems and Rehabilitation Engineering, vol. 12, No. 2, Jun. 2004.

* cited by examiner

400

WIRELESS TOY SYSTEMS AND METHODS FOR INTERACTIVE ENTERTAINMENT

RELATED APPLICATIONS

This application is a continuation of U.S. patent application Ser. No. 11/241,812, filed Sep. 30, 2005, which is a continuation of U.S. patent Application Ser. No. 10/045,582, filed Oct. 22, 2001, now U.S. Pat. No. 7,066,781, issued Jun. 27, 2006, which claims priority to U.S. Provisional Patent Application No. 60/241,893, filed Oct. 20, 2000, each of which is hereby incorporated herein by reference in its entirety.

BACKGROUND OF THE INVENTION

1. Field of the Invention

This invention relates in general to children's toys primarily of the stuffed-animal, doll or action figure variety, and, in particular, to a children's toy having an RFID tag or other wireless, batteryless communication/identification device associated therewith.

2. Description of the Related Art

Children's toys in the form of traditional dolls, puppets, stuffed animals and the like have been around for centuries and are an enduring favorite among children—particularly among toddler-age children. A favorite doll, stuffed animal or other similar toy can provide a much-needed imaginary friend, pet or playmate for a child who occasionally gets lonely or bored. Such "playmate" toys can also help a child to express himself or herself and to learn basic social skills that foster personality development and overall social adjustment.

Most traditional playmate toys are simple stuffed animals, puppets or molded plastic dolls and the like. Most are mass produced and distributed nationally and/or internationally via a vast network of stores, wholesalers, retailers and other distributors. Many of these toys embody, represent or are otherwise associated with a particular licensed television character or personality, such as the Sesame Street™ puppets, Barney and Friends™, or the various Disney™ characters. Thus, the familiarity and likeability of the licensed character creates demand for the licensed toy. Others are simple generic forms representing people, animals, cars, robots, friendly monsters, and/or other imaginative creations.

Some playmate toys are personalized via individual names, birth certificates, etc. For example, the once-popular Cabbage Patch Kids™ came complete with individualized facial and hair features, name and official birth certificate. Another popular toy vendor, Build 'A Bear™, takes the concept of personalization even further by allowing and encouraging children to actually pick out, stuff, dress and name their favorite stuffed-animal playmate toy. In many cases, the vendor/retailer continues to provide periodic birthday reminder cards, custom wardrobe selections, notices of special events and the like even after the toy is purchased. All of these individualized "personality" touches can make an otherwise-inanimate playmate toy seem more real and fun for a child and helps foster that certain special relationship and bond that often develops between a child and his or her favorite playmate toy.

Another recent improvement involves uniquely identifying a stuffed animal toy with a bar-code tag that is inserted into the stuffing of the toy and which can be "surgically" extracted and read using conventional bar-code technology. The internal bar code tag is useful in helping identify lost or stolen stuffed animals and to return them to their rightful owners. However, use of an internal bar code tag in this manner is inconvenient and can potentially damage the stuffed animal during surgical extraction and replacement. On the other hand, placing the bar code tag on an accessible exterior portion of the stuffed animal could impair the aesthetics and functionality of the toy, possibly posing choking hazards and/or increasing the risk that the tag becomes separated from the stuffed animal.

SUMMARY OF THE INVENTION

The present invention expands and improves upon the concept of a playmate toy or other similar children's toy by associating with the toy a unique wireless, batteryless ID tag ("tag" or "token") that can be read from and/or written to using radio-frequency waves. Because radio waves can easily penetrate solid objects, such as the outer skin of a toy and/or the like, the tag can be mounted internally within a cavity of the toy and thereby provide communication of stored information without requiring surgical removal of the tag. Thus, a stuffed animal or other toy can be quickly and easily identified non-invasively, without damaging the toy. Additional information (e.g., unique personality traits, special powers, skill levels, etc.) can also be easily stored on the tag, thus providing further personality enhancement, input/output programming, simulated intelligence and/or interactive gaming possibilities.

In accordance with one embodiment, the present invention provides a children's toy comprising a doll, puppet or stuffed animal containing therein a wireless tag/transponder configured and adapted to facilitating non-invasive electronic storage and retrieval of desired information.

In accordance with another embodiment the present invention provides an interactive play system and seemingly magical toy for enabling a trained user to electronically send and receive information to and from other toys and/or to and from various reader devices distributed throughout a play facility and/or connected to a master control system. The toy or other seemingly magical object is configured to use a send/receive radio frequency communication protocol which provides a basic foundation for a complex, interactive entertainment system to create a seemingly magic interactive play experience for play participants who possess and learn to use the magical toy.

In accordance with another embodiment the present invention provides an interactive play structure in the theme of a "magic" training center. Within the play structure, play participants train a magical bear and/or learn to use a "magic wand" and/or other tracking/actuation device. The bear or wand allows play participants to electronically and "magically" interact with their surrounding play environment simply by placing the bear or wand in a particular location to produce desired effects within the play environment. Various receivers or transceivers are distributed throughout the play structure to facilitate such interaction via wireless communications.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Figure 1:
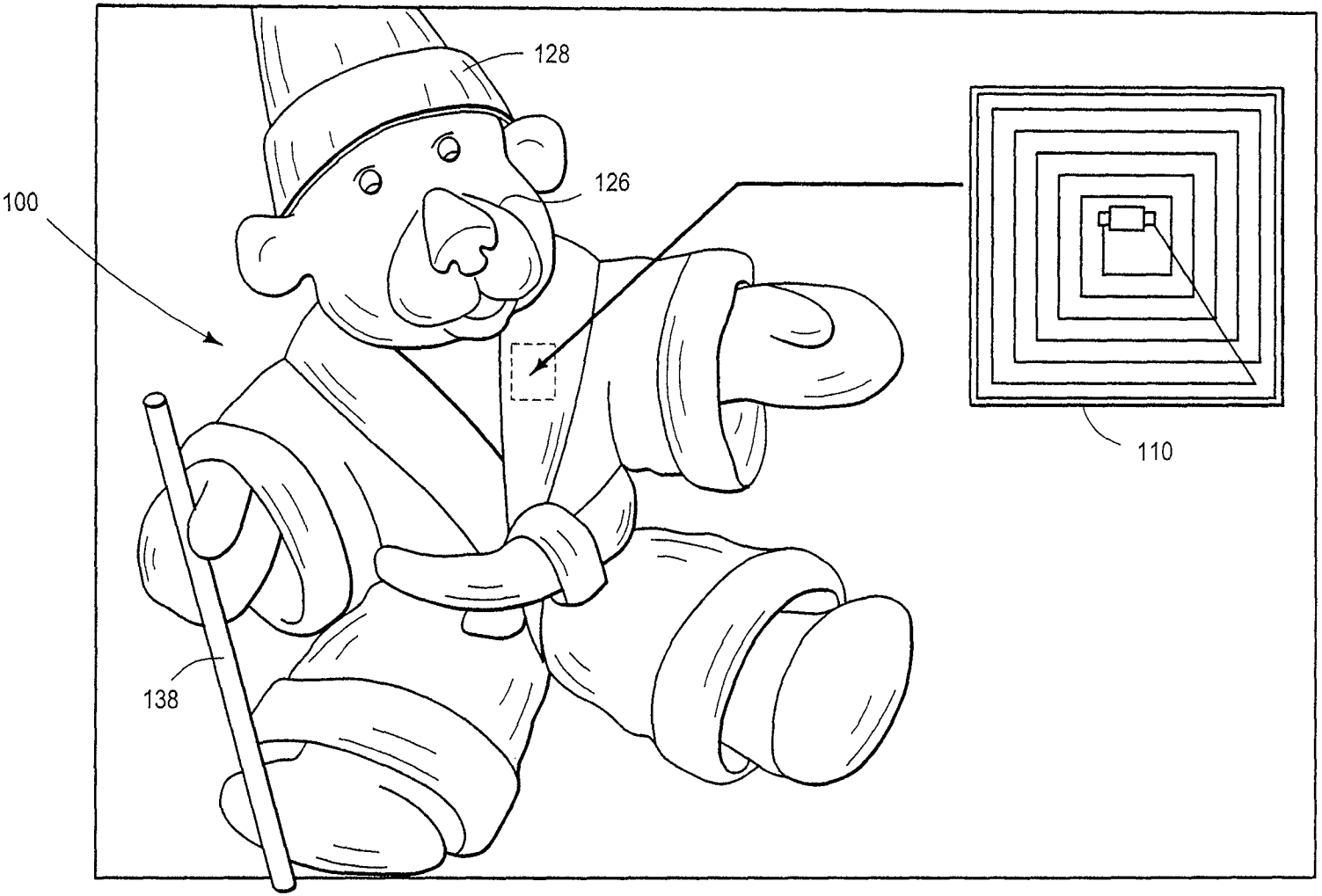
FIG. 1 is a partially-exploded schematic view of a children's toy in the form of a stuffed-animal having an RFID tag device associated therewith in accordance with one preferred embodiment of the invention.

In describing the various preferred embodiments in reference to the appended figures, similar reference numerals may sometimes be used to indicate similar structures or features of the invention. However, it is to be understood that such indicated structures or features may or may not be identical in the various described embodiments of the invention.

RFID-Tagged Toy

FIG. 1 is a partially-exploded schematic view of a children's toy 100 having an RFID tag device 110 associated therewith in accordance with one preferred embodiment of the invention. In the illustrated embodiment the toy comprises a simple stuffed "teddy bear." Of course those skilled in the art will readily appreciate that the invention is equally applicable to many other types of toys, such as, for example and without limitation: stuffed animals, dolls, puppets, action figures, robots, battery operated toys, trinkets, amusement items, jewelry, board games and board game tokens, masks, costumes, magic wands/hats/bags and the like, interactive children's books, balls, pillows, bean bags, and many other similar toys capable of carrying and/or receiving an RFID tag as described herein. Other than as described herein, the bear 100 is fabricated and constructed in any conventional fashion using known and existing materials, fabrics, stuffing and the other materials, as desired.

At least one electronic tag device—preferably a read/write, wireless, batteryless, RFID tag device 110—is inserted inside the body 126 of the bear 100, as illustrated, to create a "magic bear" toy having features and advantages of the present invention. Preferably, insertion of the tag is accomplished during manufacture of the bear at the factory or within a retail facility, in the case of a make-your-own-bear. Alternatively, the tag may be inserted into an existing stuffed-animal or other toy by surgical insertion, partial disassembly or other expedients readily apparent to those skilled in the art.

Figure 10:
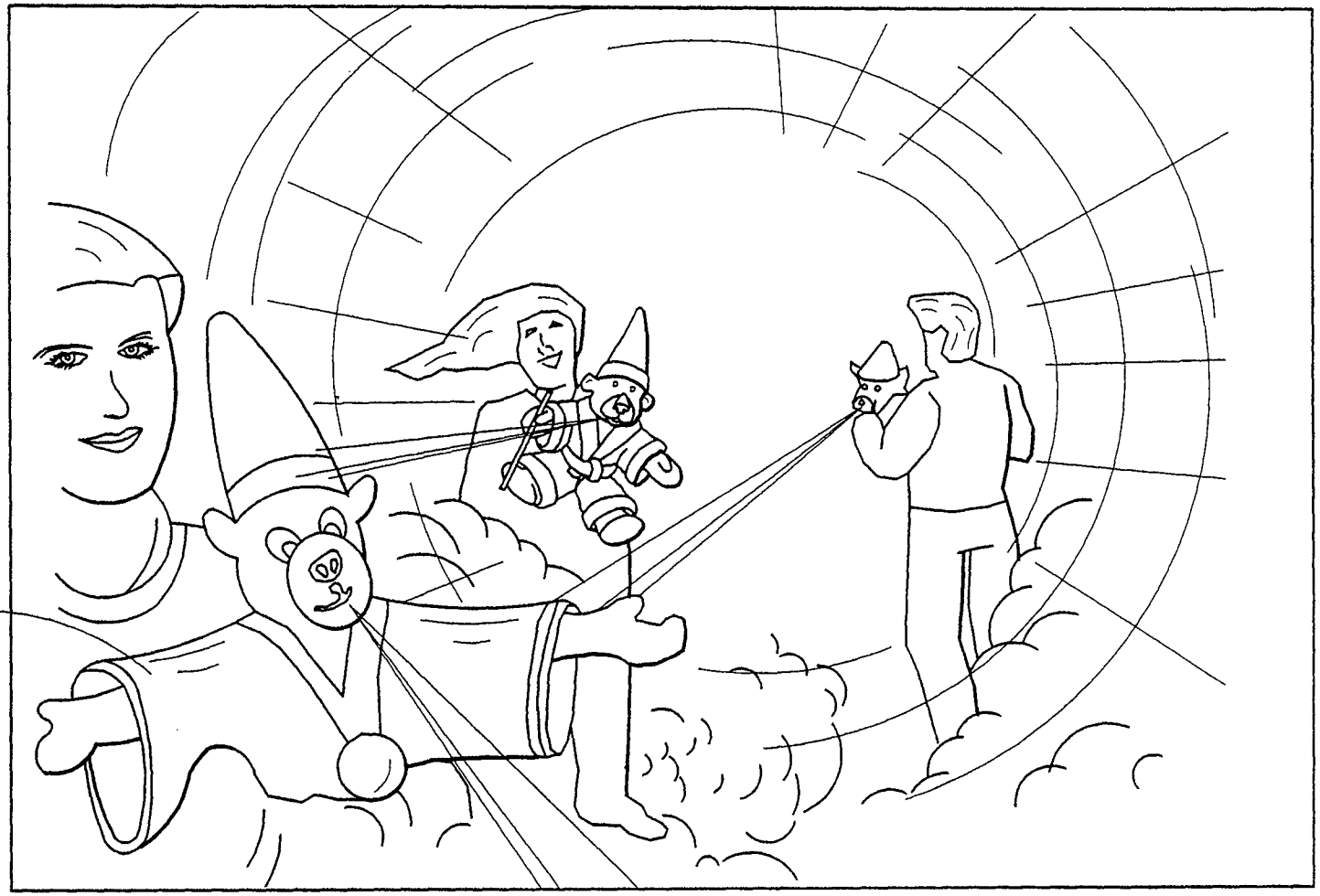

If desired, the tag may be enveloped, contained or otherwise embodied in a small heart-shaped trinket, case or other similar-shaped item as may be appropriate and fun for kids. Preferably, the tag 110 is permanently installed and contained within the body 126 of the bear such that it cannot be easily removed or become dislodged. Placement of the tag within the body 126 is preferably such that it does not interfere with or diminish the softness of the bear or expose sharp/hard surfaces that may poke or puncture the skin of the bear 100. The head and belly are preferred tag locations. Alternatively, multiple tags 110 may be inserted and placed with the body of the bear 100 at one or more different locations (e.g., hands, feet, head, belly, etc.) as desired in order to provide redundant and/or multi-functioning tag devices. Various auxiliary devices, special effects and the like may also be provided to complement the overall theme and functionality of the toy 100. For example, the bear 100 may include an LED indicator on its nose (see FIG. 10) which glows whenever the bear becomes "magically empowered" (i.e., when its tag is read and/or the bear comes within proximity of an associated reader).

The particular tag device 110 illustrated is intended to be inserted inside a children's toy 100. Alternatively and/or in addition, one or more RFID tag devices may be affixed or adhered to the toy bear 100 upon any convenient surface thereof, or it may be inserted into one or more associated articles of clothing, accessories, jewelry or other items designed to be worn/used either by the playmate toy or a child. For example, a "magic" hat 128, or wand 138 may be donned by the bear 100 for purposes of special "magic training" sessions.

Figure 2C:
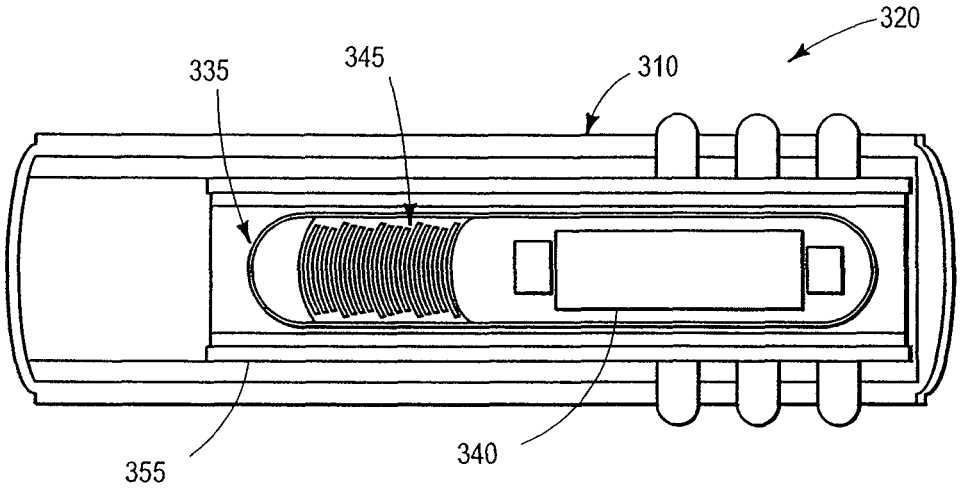
FIG. 2C is a partial cross-section detail view of the distal end or transmitting portion of the wand toy of FIG. 2A, illustrating the provision of an RFID tag device therein.
Figure 2A:
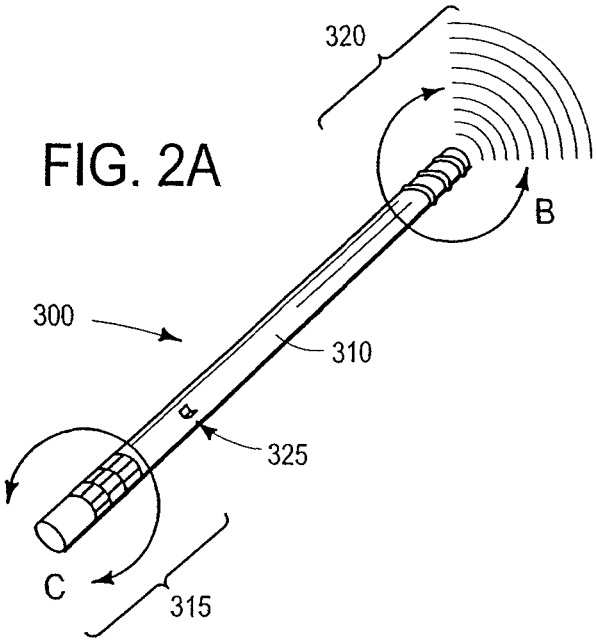
FIG. 2A is a perspective view of a children's toy in the form of a magical wand having an RFID tag device associated therewith in accordance with one preferred embodiment of the invention.

FIG. 2 illustrates in more detail the basic construction of a preferred embodiment of one such "magic" wand 300 having features and advantages in accordance with one preferred embodiment of the invention. As illustrated in FIG. 2A the wand 300 basically comprises an elongated hollow pipe or tube 310 having a proximal end or handle portion 315 and a distal end or transmitting portion 320. If desired, an internal cavity may be provided to receive one or more batteries to power optional lighting, laser or sound effects and/or to power longer-range transmissions such as via an infrared LED transmitter device or RF transmitter device. An optional button 325 may also be provided, if desired, to enable particular desired functions, such as sound or lighting effects or longer-range transmissions.

Figure 2B:
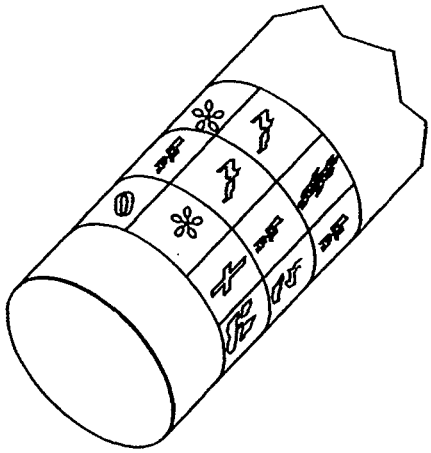
FIG. 2B is a partially exploded detail view of the proximal end or handle portion of the wand toy of FIG. 2A, illustrating the optional provision of combination wheels having features and advantages in accordance with the present invention.

FIG. 2B is a partially exploded detail view of the proximal end 315 of the magic wand toy 300 of FIG. 2A. As illustrated, the handle portion 315 is fitted with optional combination wheels having various symbols and/or images thereon. Preferably, certain wand functions may require that these wheels be rotated to produce a predetermined pattern of symbols such as three owls, or an owl, a broom and a moon symbol. Those skilled in the art will readily appreciate that the combination wheels may be configured to actuate electrical contacts and/or other circuitry within the wand 300 in order to provide the desired functionality. Alternatively, the combinations wheels may provide a simple security measure to prevent unauthorized users from actuating the wand.

RFID Tag/Transponder

FIG. 2C is a partial cross-section detail view of the distal end of magic wand toy 300 of FIG. 2A. As illustrated, the distal end 320 is fitted with an RFID (radio frequency identification device) transponder 335 that is operable to provide relatively short-range RF communications (<60 cm). This transponder basically comprises a passive (non-battery-operated) RF transmitter/receiver chip 340 and an antenna 345 provided within an hermetically sealed vial 350. A protective silicon sheathing 355 is preferably inserted around the sealed vial 350 between the vial and the inner wall of the tube 310 to insulate the transponder from shock and vibration.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 3:
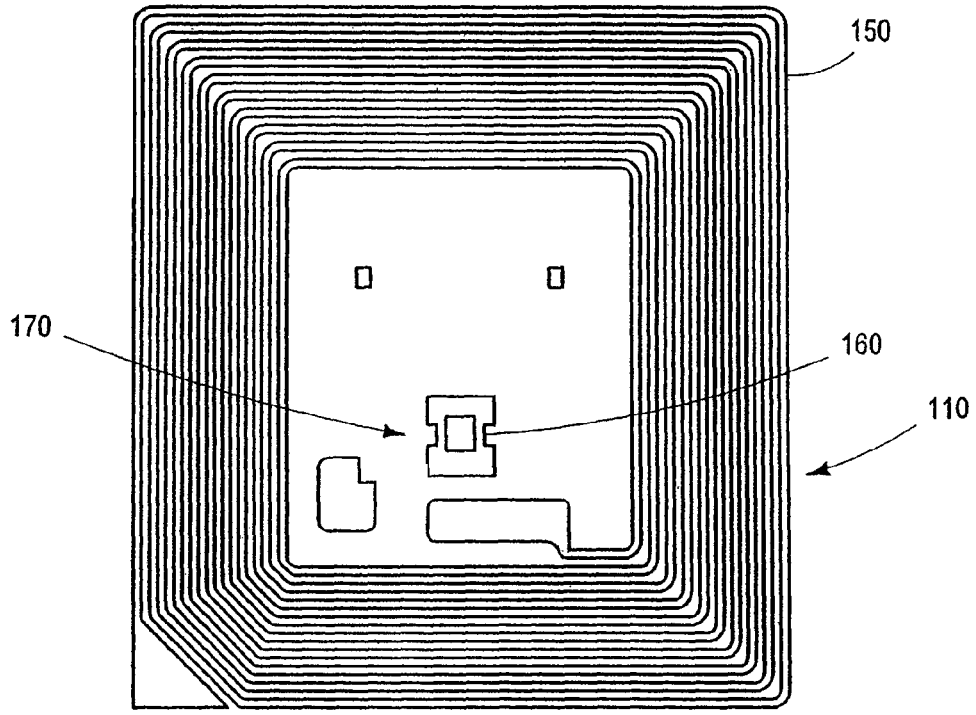
FIG. 3 is a detailed schematic view of one embodiment of an RFID tag device for use with the toy of FIG. 1 and having features and advantages in accordance with the present invention.

FIG. 3 is a detailed schematic view of an alternative embodiment of an RFID tag device 110 for use with the toy bear of FIG. 1. The tag 110 in the preferred embodiment illustrated preferably comprises a radio frequency tag pre-programmed with a unique bear identifier number ("UBIN"). Other stored information (either pre-programmed or programmed later) may include, for example, the bear's name, its owner's name and age, the bear's rank or level, total points accumulated, tasks completed, facilities visited, etc. The tag 110 generally comprises a spiral wound antenna 150, a radio frequency transmitter chip 160 and various electrical leads and terminals 170 connecting the chip 160 to the antenna 150.

The tag may be a passive tag 110 or battery-powered, as expedience and costs dictate. Preferably, the tag 110 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag 110 illustrated is the 13.56 mHz tag sold under the brand name Tagit™ available from Texas Instruments, Inc. (http://www.tiris.com, Product No. RI-103-110A). The tag 110 has a useful read/write range of about 25 cm and contains 256-bits of on-board memory arranged in 8×32-bit blocks which may be programmed (written) and read by a suitably configured read/write device. If a longer read/write range (e.g., 1-100 meters) and/or more memory (e.g., 1-100 Mb) is desired, optional battery-powered tags may be used instead, such as the AXCESS active RFID network system available from AXCESS, Inc. and/or various other RF-based asset and people tracking applications known to those skilled in the art.

Figure 4A:
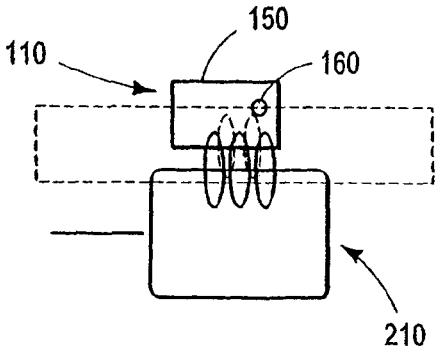
FIGS. 4A and 4B are schematic diagrams illustrating typical operation of the RFID tag device of FIG. 3.
Figure 4B:
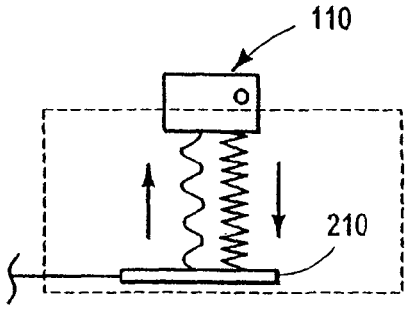

FIG. 4 is a simplified block diagram illustrating the basic organization and function of the electronic circuitry comprising the radio frequency transmitter chip 160 of the RFID tag device 110 of FIG. 2. The chip 160 basically comprises a central processor 230, Analogue Circuitry 235, Digital Circuitry 240 and on-board memory 245. On-board memory 245 is divided into read-only memory (ROM) 250, random access memory (RAM) 255 and non-volatile programmable memory 260, which is available for data storage. The ROM-based memory 250 is used to accommodate security data and the tag operating system instructions which, in conjunction with the processor 230 and processing logic deals with the internal "house-keeping" functions such as response delay timing, data flow control and power supply switching. The RAM-based memory 255 facilitates temporary data storage during transponder interrogation and response. The non-volatile programmable memory 260 may take various forms, electrically erasable programmable read only memory (EEPROM) being typical. It is used to store the transponder data and is preferably non-volatile to ensure that the data is retained when the device is in its quiescent or power-saving "sleep" state.

Various data buffers or further memory components (not shown), may be provided to temporarily hold incoming data following demodulation and outgoing data for modulation and interface with the transponder antenna 150. Analog Circuitry 135 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 240 provides certain control logic, security logic and internal microprocessor logic required to operate central processor 230.

Advantageously, the UBIN stored on each tag 110 may be used to wirelessly identify and track individual bears 100 within a retail facility, park, hotel/resort/restaurant and/or anywhere else around the world. Optionally, each tag 110 may also include a unique kid identifier number ("UKIN") which may be used to match one or more bears with an individual kid-owner. If desired, the tag 110 may be covered with an adhesive paper label (not shown) for surface adhesion to a toy, clothes, or any other tag bearing surface. More preferably, the tag 110 may be molded and/or embedded into a relatively stiff plastic sheet substrate and/or transponder cylinder which holds and supports the tag 110. Optionally, the sheet substrate, transponder or other support structure may be shaped as a heart, a medallion, a high-tech gizmo or any other fanciful shape, as desired. The resulting structures may be inserted into the bear 100 (e.g., a heart), or they may be worn externally by either the bear 100 and/or its kid-owner (e.g., as a bracelet, necklace, key chain trinket, etc.).

Reader/Writer Devices

In operation, various RFID reader (and/or reader/writer) devices are provided and may be distributed throughout a hotel/resort, retail facility, play facility, theme park, family entertainment center or any other "magic bear" compatible environment. These readers are able to read the information stored on each tag 110 when the associated bear 100 is brought into suitable proximity of the reader (1 to 100 cm). Advantageously, because radio waves can easily penetrate solid objects, such as the outer skin of a toy and/or the like, the tag 110 can be mounted internally within a cavity of the toy, thereby providing communication of stored information without requiring surgical extraction of the tag. Thus, the UBIN and UKIN information can be conveniently read non-invasively, without damaging the toy. This information may be easily communicated to a cash-register display, computer monitor, interactive game control system, display system or other tracking, recording or displaying device for purposes of identifying, logging and creating a record of each bear's experience. Additional information (e.g., unique personality traits, special powers, skill levels, etc.) can also be easily stored on the tag, thus providing further personality enhancement, input/output programming, simulated intelligence and/or interactive gaming possibilities.

Information may also be conveniently used to identify a bear's name, birthday, and owner, calculating point totals from various gaming experiences, tracking and/or locating lost bears/children, verifying whether or not a bear/child is inside a facility, photo capture and retrieval, and/or many other useful purposes as will be readily obvious and apparent to those skilled in the art. Optionally, various updated information may be written to the tag 110, such as new point totals, rank, enhanced "magic" powers and skills.

Figure 6:
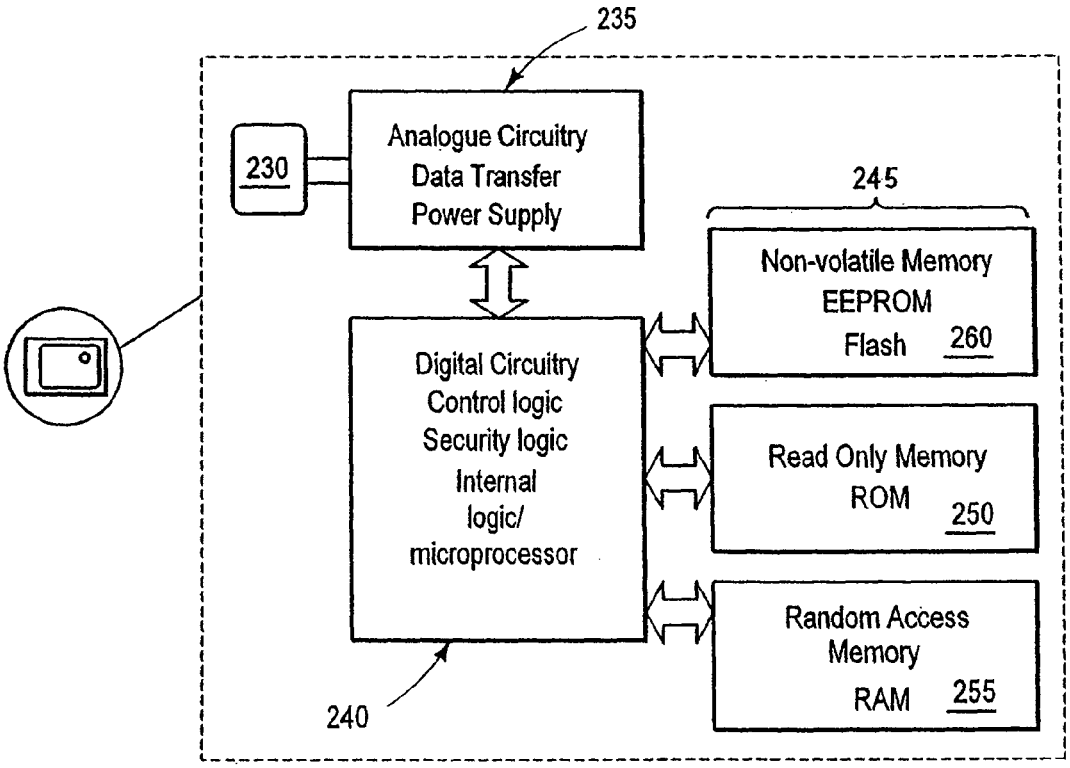
FIG. 6 is a simplified block diagram illustrating the basic organization and function of the electronic circuitry comprising the RFID tag device of FIG. 3.
Figure 5:
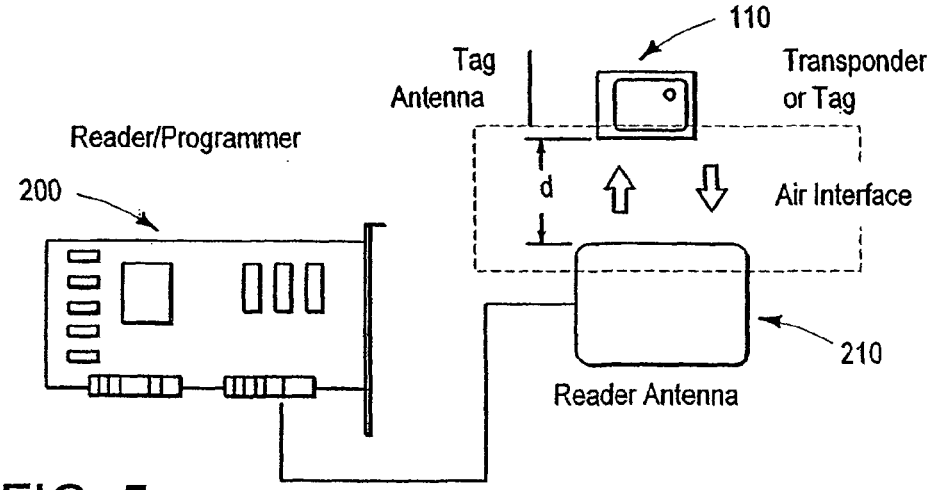
FIG. 5 is simplified schematic diagram of an RFID read/write system for use with the RFID tag device of FIG. 3 and having features and advantages in accordance with the present invention.

FIGS. 5 and 6 are simplified schematic illustrations of tag and reader operation. The tag 110 is initially activated by a radio frequency signal broadcast by an antenna 210 of an adjacent reader or activation device 200. The signal impresses a voltage upon the antenna 150 by inductive coupling which is then used to power the chip 160 (see, e.g., FIG. 3). When activated, the chip 160 transmits via radio frequency a unique identification number preferably corresponding to the UBIN and/or UKIN described above (see, e.g., FIG. 3 and associated discussion). The signal may be transmitted either by inductive coupling or, more preferably, by propagation coupling over a distance "d" determined by the range of the tag/reader combination. This signal is then received and processed by the associated reader 200 as described above. If desired, the RFID tag or transponder 110 may also be configured for read/write communications with an associated reader/writer. Thus, the unique tag identifier number (UBIN or UKIN) and any other stored information can be read, changed or other information may be added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care should be taken in the placement and orientation of the various readers 200 so as to minimize the probability of such data transmission errors. Preferably, the readers are placed at least 30-60 cm away from any metal objects, power lines or other potential interference sources. Those skilled in the art will also recognize that the write range of the tag/reader combination is typically somewhat less (~10-15% less) than the read range "d" and, thus, this should also be taken into account in determining optimal placement and positioning of each reader device 200.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

Master Control System

Figure 7:
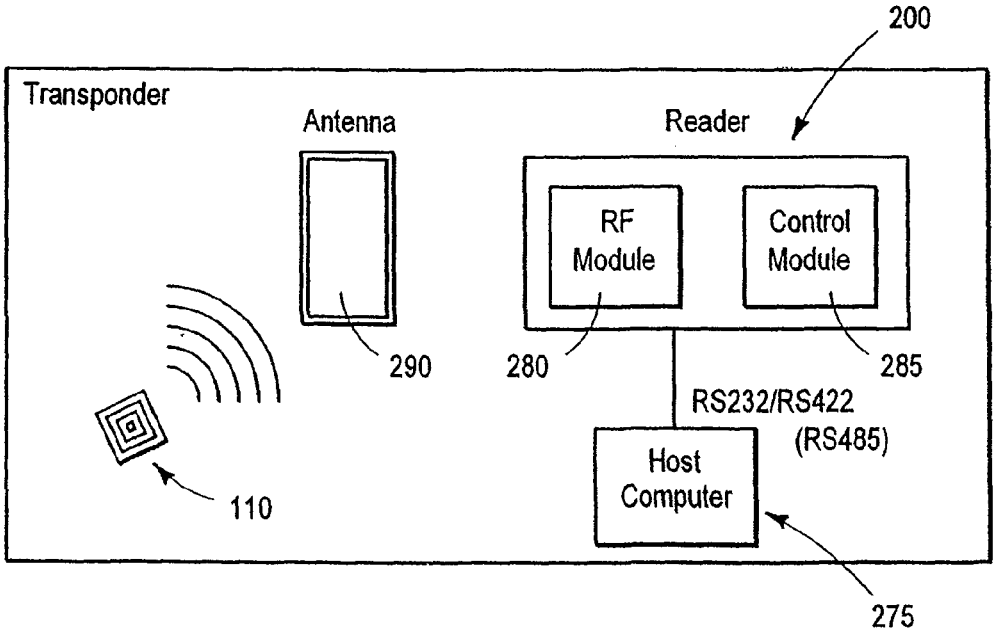
FIG. 7 is a simplified schematic diagram of an RF reader and master control system for use with the RFID-tagged toys of FIGS. 1 and 2 and having features and advantages in accordance with the present invention.

Depending upon the degree of complexity desired and the amount of information sharing required, some or all of the various reader/writer devices 200 may be connected to a master control system or central server 375 as illustrated in FIG. 7. For example, various electronic interactive play elements may be disposed throughout a play facility and which allow play participants to create desired "magical" effects. These may include interactive elements such as projectile accelerators, cannons, interactive targets, fountains, geysers, cranes, filter relays, and the like for amusing and entertaining play participants and/or for producing various desired visual, aural or tactile effects. These may be actuated manually by play participants or, more desirably, "magically" electronically by appropriately "training" one's bear in various magic skills. Some interactive play elements may have simple immediate effects, while others may have complex and/or delayed effects. Some play elements may produce local effects while others may produce remote effects. Each play participant within the facility, or sometimes a group of play participants working together, preferably must experiment with the various play elements and using their magic bears in order to discover how to create the desired effect(s). Once one play participant figures it out, he or she can use the resulting play effect to surprise and entertain other play participants. Yet other play participants will observe the activity and will attempt to also figure it out in order to turn the tables on the next group. Repeated play on a particular play element can increase the bear's magic skills to repeatedly produce a desired effect or increase the size or range of such effects. Optionally, play participants can have their bears compete with one another using the various interactive play elements to see which player's bear can create bigger, longer, more accurate or more spectacular magical effects.

In the case of an interactive play facility with a master control system preferably each RFID tag 110 is configured to electronically send and receive information to and from each reader/writer 200 distributed throughout the play facility using a send receive radio frequency ("SRRF") communication protocol. This communications protocol provides the basic foundation for a complex, interactive entertainment system which creates a seemingly magic interactive play experience for participants whose bears learn to use the seemingly "magical" powers they are imbued with via the RFID tag technology.

In the most refined embodiments, a participant may use his or her "magic bear" or other similar toy to electronically send and receive information to and from other bears/toys and/or to and from a master control system located within and/or associated with any of a number of play environments. This network of SRRF-compatible play environments provides a complex, interactive play and entertainment system that creates a seamless magical interactive experience that transcends conventional physical and temporal boundaries.

SRRF may generally be described as an RF-based communications technology and protocol that allows pertinent information and messages to be sent and received to and from two or more SRRF compatible devices or systems. While the specific embodiments descried herein are specific to RF-based communication systems, those skilled in the art will readily appreciate that the broader interactive play concepts taught herein may be realized using any number of commercially available 2-way and/or 1-way medium range wireless communication devices and communication protocols such as, without limitation, infrared-, digital-, analog, AM/FM-, laser-, visual-, audio-, and/or ultrasonic-based systems, as desired or expedient.

In a preferred embodiment, a play facility is configured with SRRF technology to provide a master control system 275 for an interactive entertainment play environment using SRRF-compatible magic bears, magic wands and/or other SRRF compatible toys. A typical play facility provided with SRRF technology may allow 300-400 or more users to more-or-less simultaneously send and receive electronic transmissions to and from the master control system using the bear, a magic wand and/or other SRRF-compatible toys.

The SRRF system preferably uses a software program and data-base that can track the locations and activities of up to a hundred or more participants. This information is then used to adjust the play/ride experience for the user based on "knowing" where the user/player has been, what objectives that player (or group of players in a ride vehicle) has accomplished and how many points or levels have been reached. The system can then send messages to the users throughout the ride experience. For example, the system can allow or deny access to a secret passage based on how many points or levels reached by that participant's bear and/or based on what objectives the bear has accomplished or helped accomplish. It can also indicate, via sending a message to the user the amount of points or specific objectives necessary to complete a "mission" or enter the next level of play. The master control system may log events into a data base for later retrieval and use in applications, such as:

- Identifying a guest with a name, address and personal data (birthday, favorite color, bear's name, etc.)
- Locating the bear and child
- Triggering an event or special effect
- Allowing passage into a secret or magical place
- Recording activities completed, giving points for those achievements which then can be used for future redemption
- Storing information to create a storybook of each child's adventures
- Using bear/tag as a debit charge to purchase snacks, gift items, etc.

The master control system can also preferably send messages to the user from other users. Optionally, the system may be suitably configured to allow multiple users to interact with each other adjusting the master control system. The master system can also preferably interface with digital imaging and/or video capture so that the users can be visually tracked. Any user can locate another user either through the video capturing system or by sending a message to another device. At the end of a visit, participants are informed of their activities and the system interfaces with photo-printout capabilities. For example, as each participant enters a specific "game zone" within the facility, a reader reads data stored on the tag 110 embedded with the participant's bear or other SRRF-compatible toy. This information is communicated to the master system which logs/tracks the guest's progress through the facility while interfacing with other interactive systems within the venue. For example, upon receipt of an activation message received from a first game zone, the master system may trigger a digital camera focused on that area, thus capturing a digital image of the player and/or his or her bear. This photo image is electronically time-stamped and stored with identifying UBIN and UKIN for later retrieval. In this manner the SRRF technology allows the master control system to uniquely identify and track bears and people as they interact with various games and activities in a semi-controlled play environment.

Theming/Storyline

The present invention may be carried out using a wide variety of suitable themed environments, storylines and characters, as will be readily apparent to those skilled in the art. The following specific example is provided for purposes of illustration and for better understanding of the invention and should not be taken as limiting the invention in any way:

EXAMPLE

In a special spot of the world exists an incredible place made of magic. In the most amazing and enchanting forest lives an amazing wizard who has spent his life making cuddly critters who posses unusual abilities. These critters look like ordinary teddy bears or stuffed animals; cute and cuddly ready to become a child's best friend. But behind the fluff and stuffing this one-of-kind bear is Magical. Each and every bear was carefully created by this Wizard, has made thousands of unique stuffed creatures with the gift to become magical. However, these creations do not start off with magic powers. Only when the bear and its human mate are brought together the magic is sparked. But even then the bear is not yet able to use all of its magic powers until it is properly taught. It is the responsibility of the human to take the bear on a magic journey through the Enchanted Forest where the magic teachings begin. Then, for days to follow the bear is able to practice its magic powers in all sort of "normal" places. When the training and practice is complete, the bear is given its magic inductions and diploma (a hat, wand, etc., as appropriate) and is able to practice level-one magic. The magic bear's owner can then choose from a big selection of special clothing, accessories and other magical items to customize their new friend. New and improved magic skills can be learned by the magic bear and its human mate on its next journey to the enchanted forest.

The "MagicMate" is a specially designed stuffed animal that has "smart" ability (RFID tag/transponder), which makes it possible to be tracked and trigger effects throughout a special bear training facility (e.g., retail store, hotel/resort, family entertainment center, etc.). The facility can track and send signals to the bear from the time it is purchased and continuing even after the bear leaves the training facility. To the child/owner the bear is truly magical; making effects happen whenever the bear comes into contact with a magic-bear compatible device. In addition, the bear seems to be magically watched by the Wizard who seems to always know where the bear is and what it is doing.

For example, the bear training center may be located within a family hotel/resort. The experience begins when the guest (or the guests parents) reserve a room at the resort. They are given a special invitation to become a special owner to a magic bear who needs their help to become magical. They are given a basic background of the experience and the story behind Magic Mates. Guests who choose to participate would be assigned a specially designed magic-ready hotel room. Guests can also choose to partake any time they are staying at the resort. Of course, visitors not staying at the hotel may also purchase a magic-mate.

Figure 8:
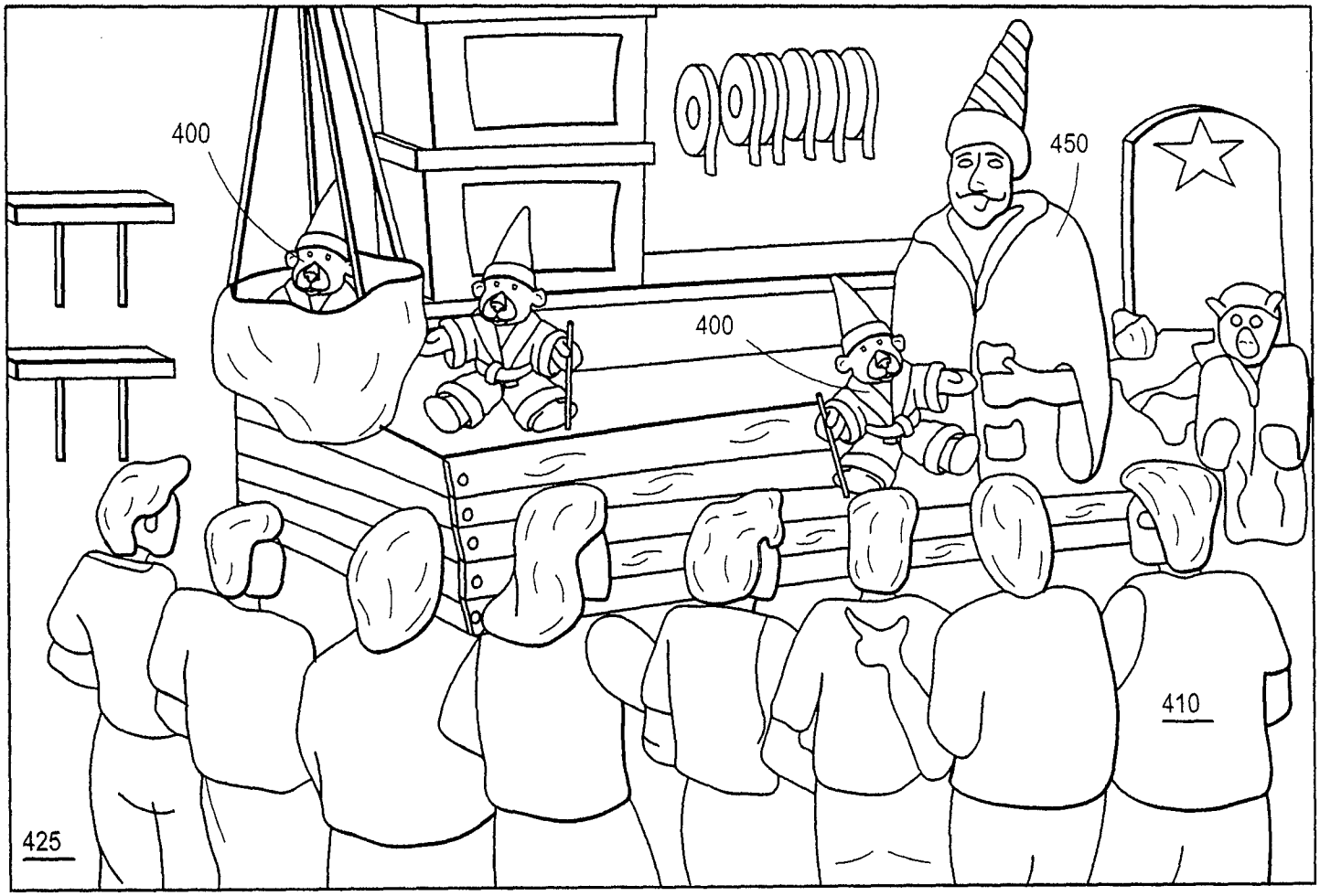
FIGS. 8-23 are various illustrations of a resort-based "magic bear" training facility having features and advantages of the present invention.
Figure 9:
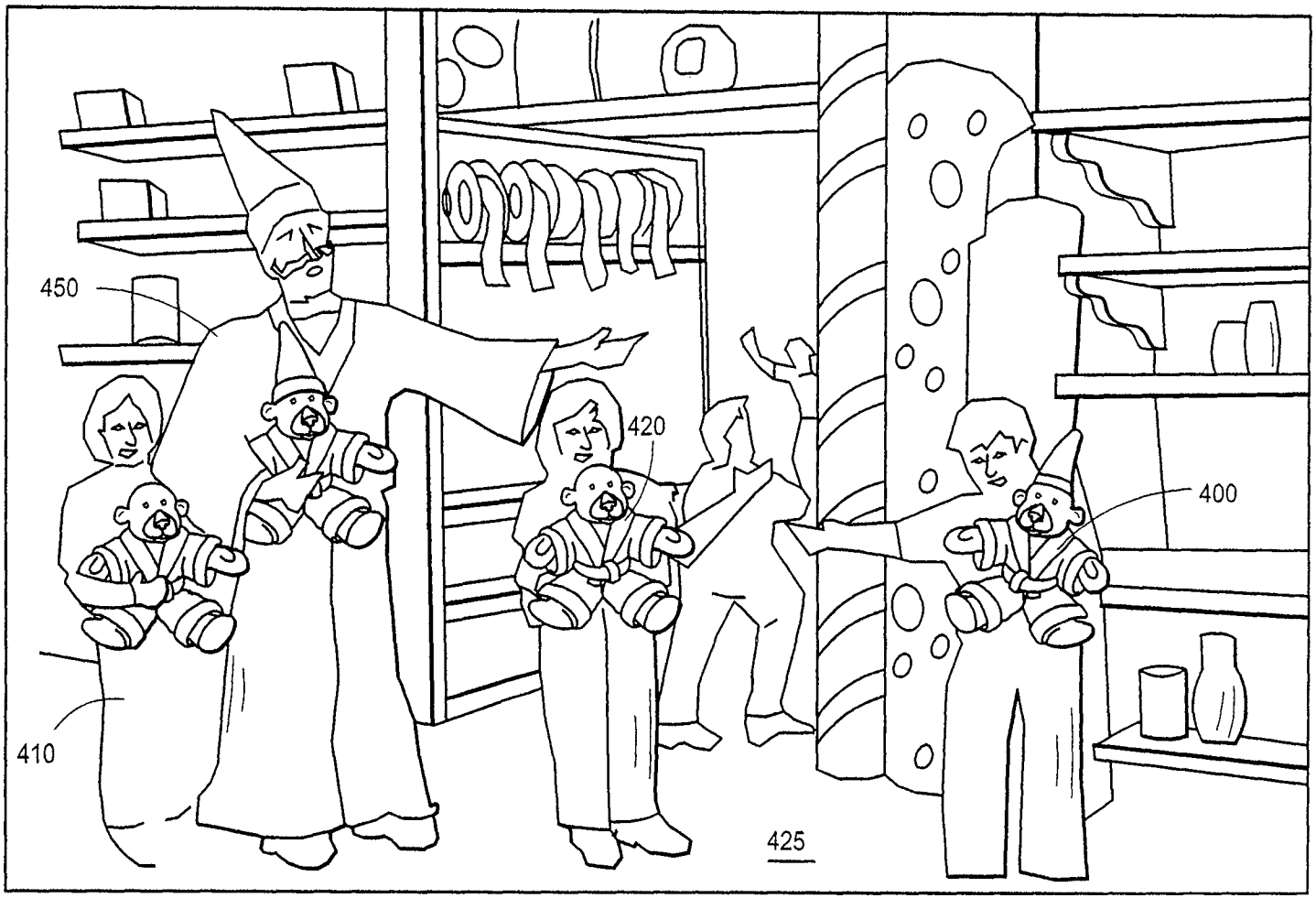

Once guests 410 arrive at the resort they select a time in which they will meet the Wizard 450 at his workshop 425 and finally are joined with their new magical friend 400 (FIGS. 8-9). When the guest arrives at this The Wizard Workshop 425 they are greeted by a Wizard 450 or two who lead them into the Wizard Workshop where they carefully select their magic mate 400. The guests are led into the workshop by a masterful Wizard who introduces them to his special creations. The Wizard also tells guests about his magical workshop and how he created these special bears for over 200 years and then helps the guests select their new magic-mate. Guests are asked to sign official adoption papers (initial identification process: name, address, bear name, etc.) and told how to care for their magic bear. The Wizard performs a special trick that "sparks" the bears magic so that it can begin its magic training with its new owner.

Figure 11:
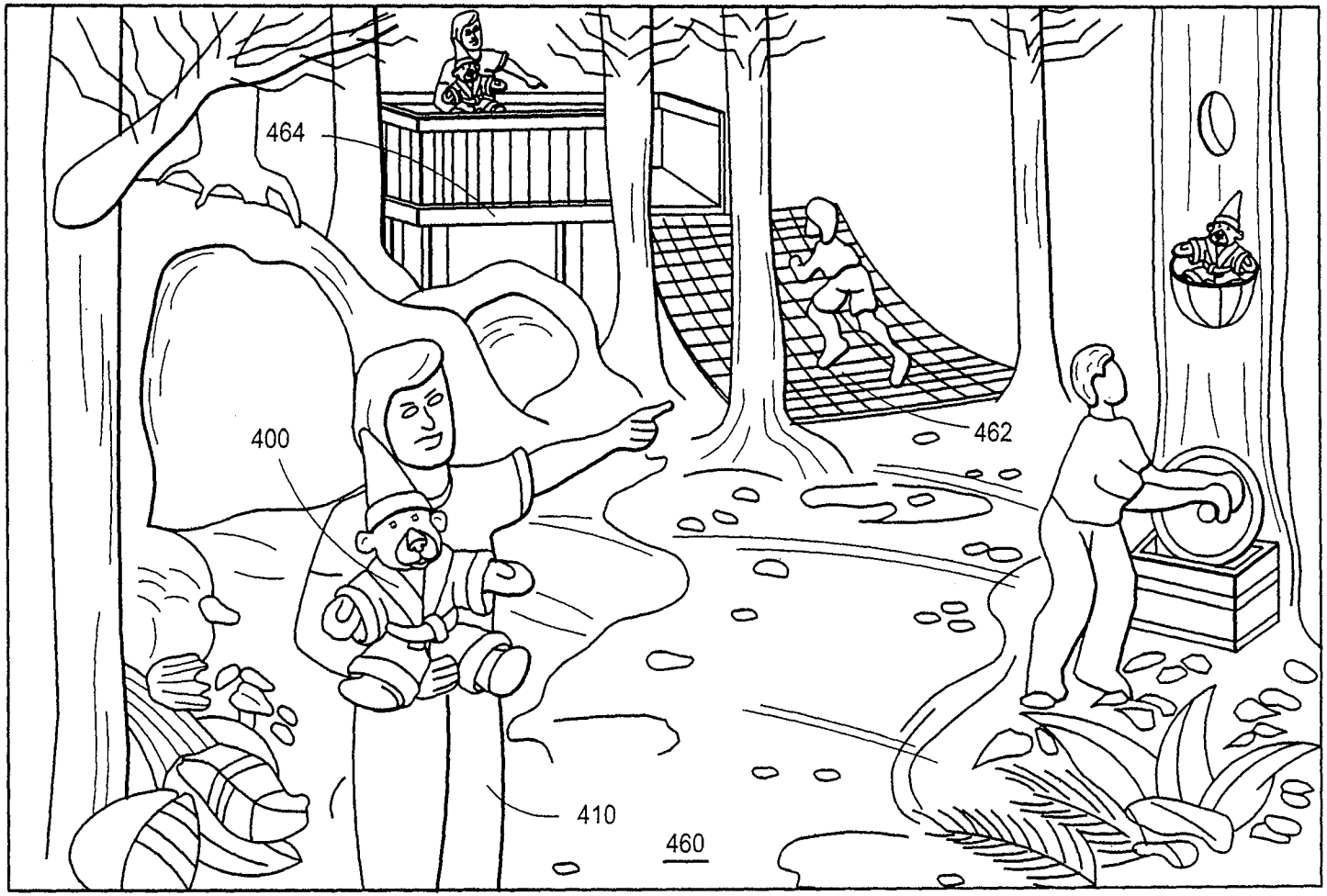
Figure 12:
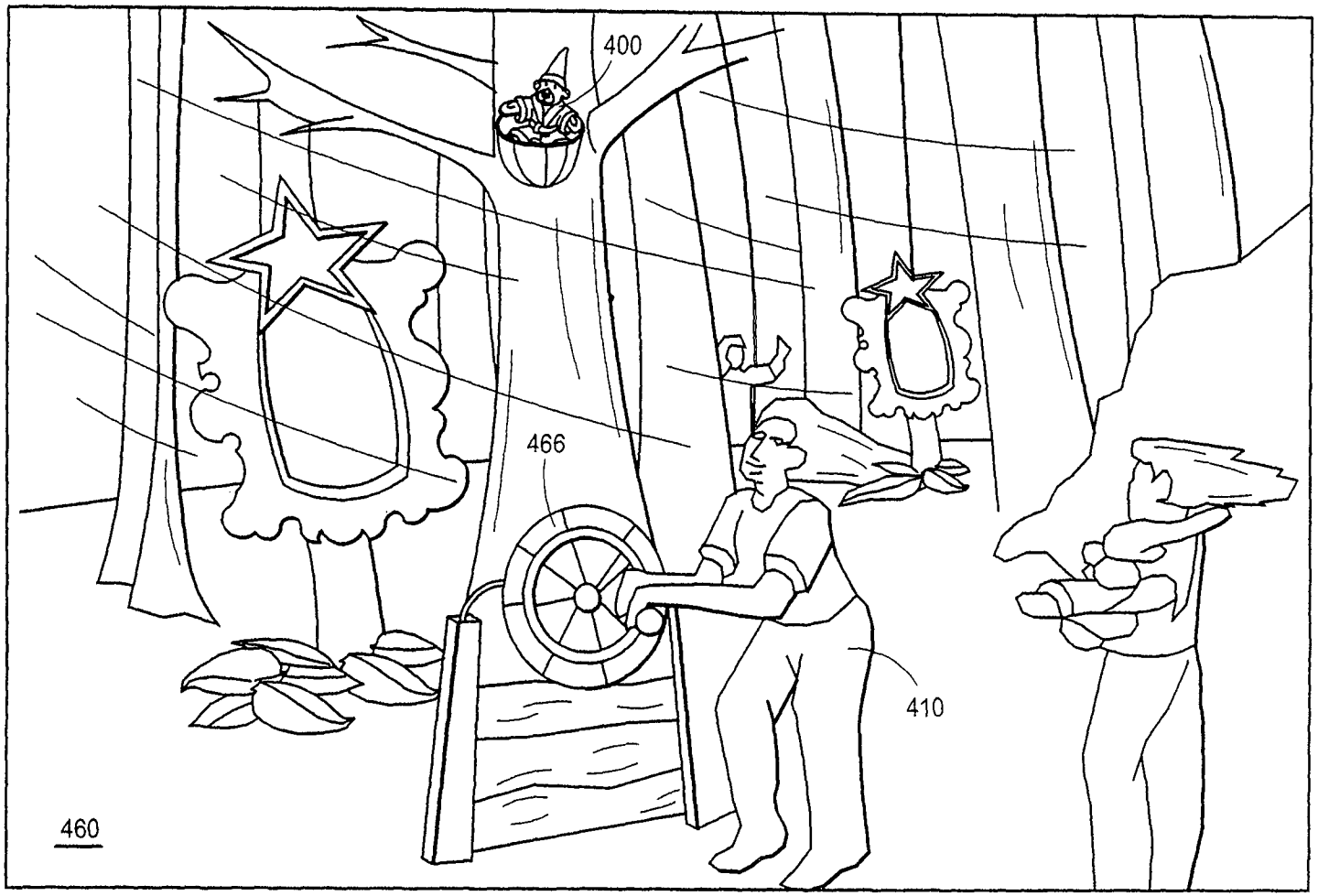
Figure 13:
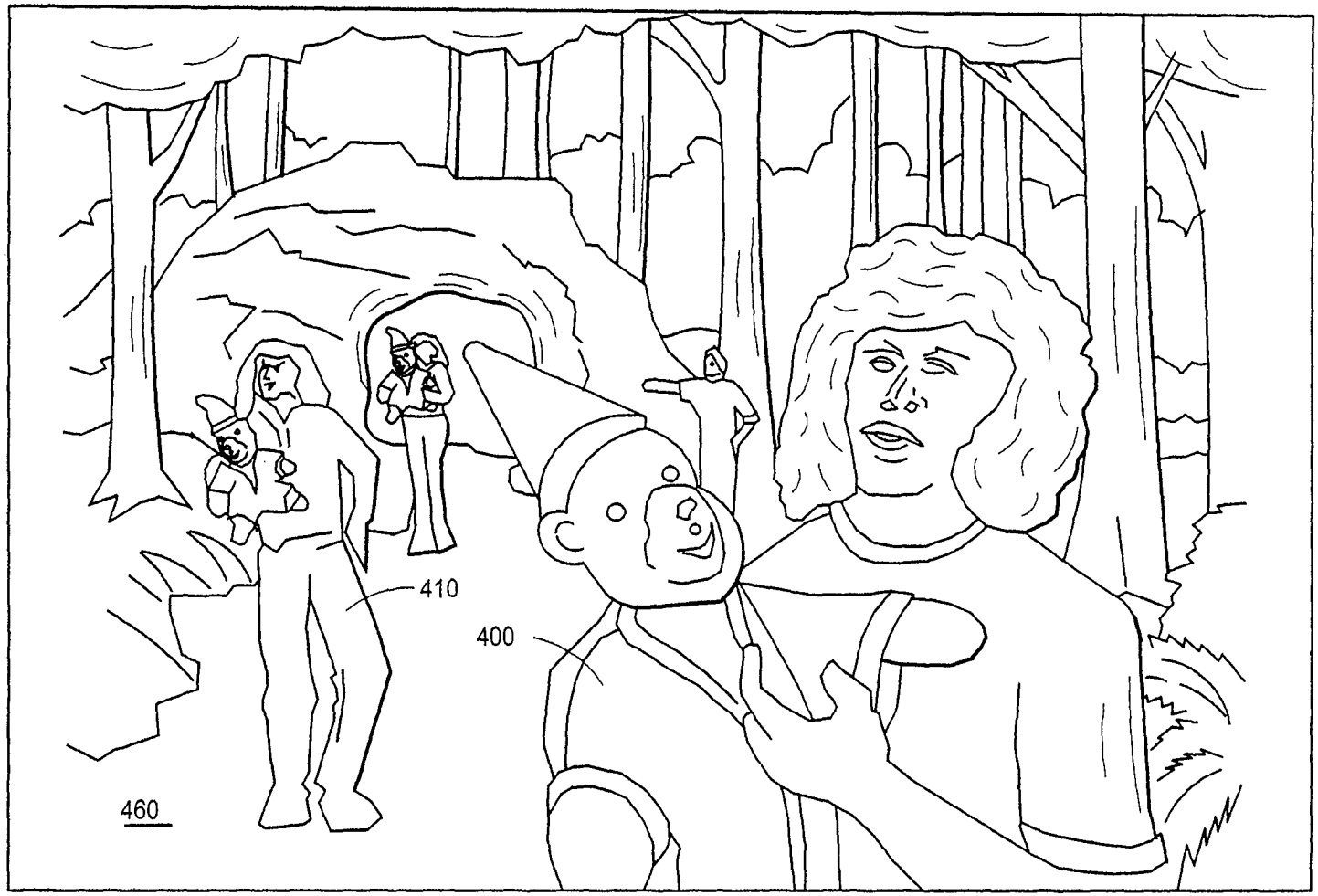

After guests choose their mate they are given official adoption papers, name their bear and the "story" (tracking) of the bear begins. They are then led through a hidden door, through a magical tunnel (FIG. 10) which takes them into the Enchanted Forest 460 where the magic training commences. The Enchanting Forest is an interactive maze of physical and hands on challenges, such as climbing nets 462, rope bridges 464, bear elevators 466, and the like (FIGS. 11-13). The bear 400 is taken by its owner through a series of magical lessons and fun experiences which will teach the bear and the guest how to use their magic powers. Magic is truly created and the bear 400 is able to set off a series of special effects as well as respond to various signals. Guests work their way through various caves, trees and bridges to different magic stations that help them teach their bear new skills. Each station is outfitted with a reader/writer device that logs and activates an effect after the bear completes a certain skill. For example, the bear's owner must teach the bear a magic saying. When this magic saying is done in a specific way (hold your bear to the sky and say, "Swish, Swirl, Bluster and Blow, Make the winds gust and grow!"), the bear's light will glow and powerful winds (high-powered fans) blow at the guests.

Figure 14:
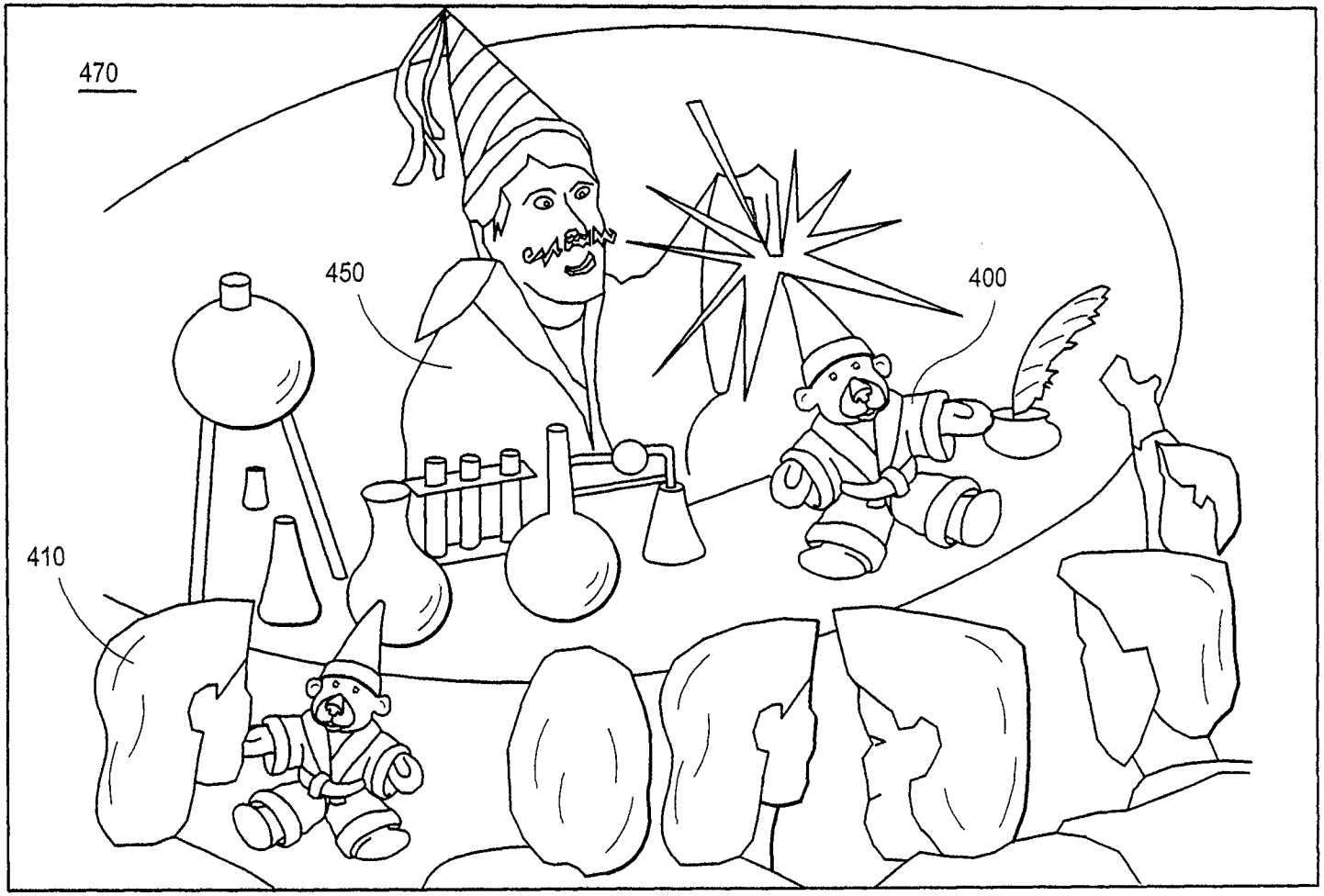
Figure 15:
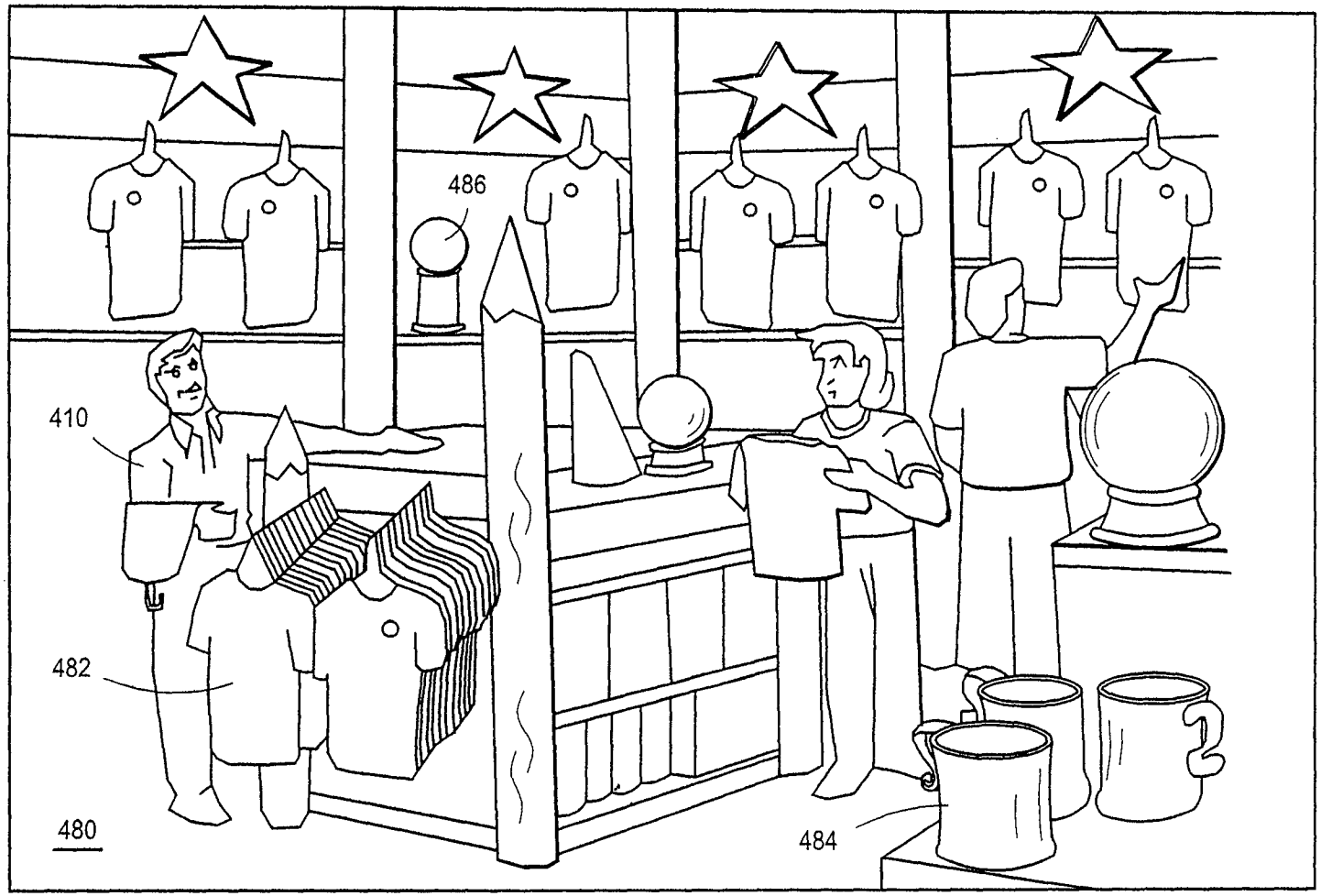

Once they make it through the Enchanted Forest they are then taken to a Wizard's Cove 470 (FIG. 14) where the Wizard 450 tests the bear's magic skills and official ceremonies are conducted. If they pass, they will be dubbed by the Wizard to have Level One Magic Powers. This area is actually a small theatre that uses a projected image of the Wizard and special effects. The bear will respond to signals that are integrated into the show. The guest then exits into a WizardWear shop 480 (FIG. 15) where he or she is able to select from dozens of outfits 482, accessories 484 and magical items 486.

Their magic experience doesn't end once guests exit the attraction area. Actually, the real experience begins. Various areas throughout the resort or equipped to track the bear and trigger events. Guests staying and paying for the Magic Mate Adventure have rooms that are outfitted with receivers that will cause specific events such as turn lights on and off and receive messages through the television. In addition, hallways, point portals (guest does an activity at a computer station and receives points for future redemption prizes), the restaurant and any other area at the resort have hidden receivers which will track the bear everywhere it goes. It will record the guest's activities as well as trigger effects such as talking pictures, sound and music effects.

Figure 16:
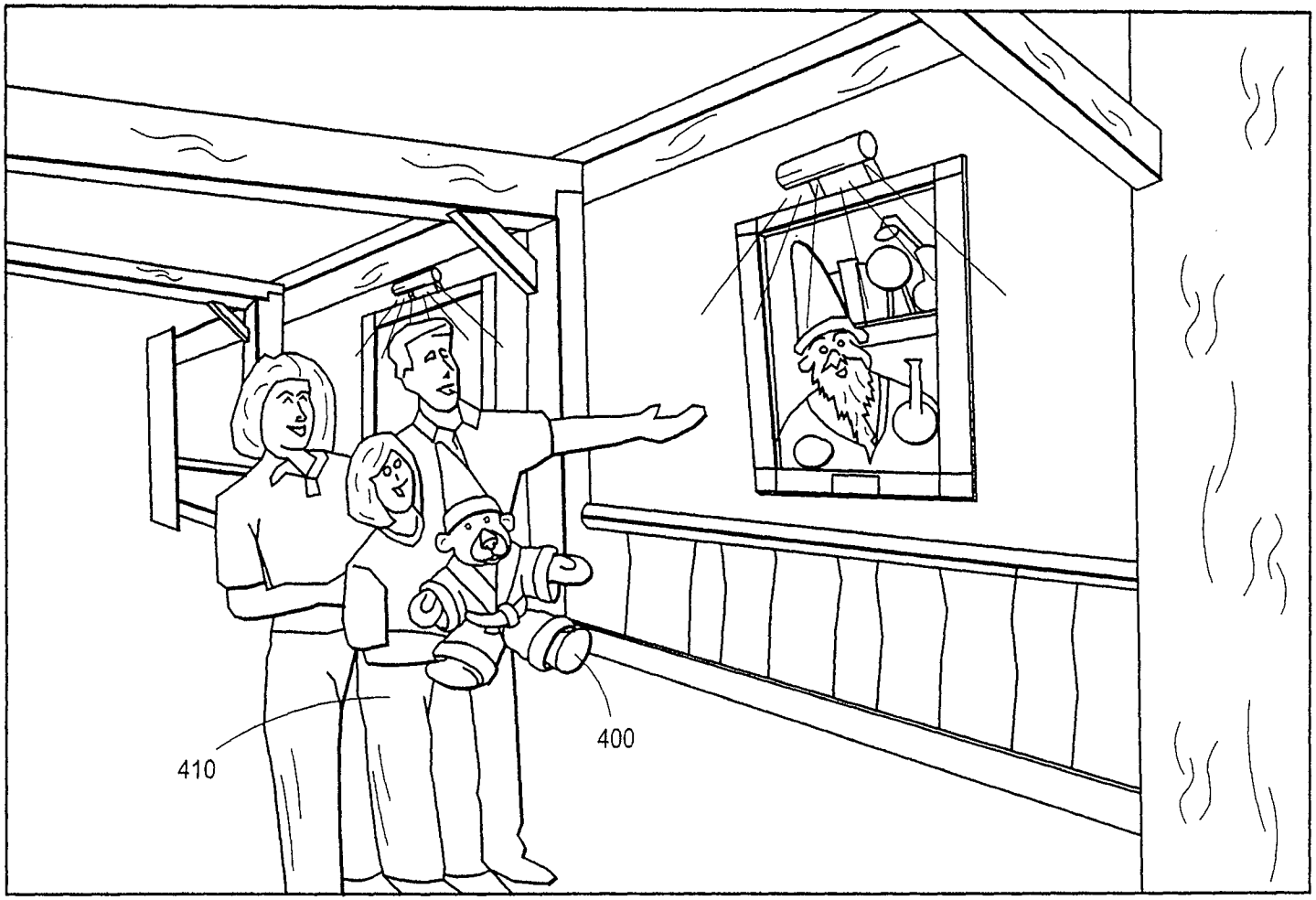
Figure 17:
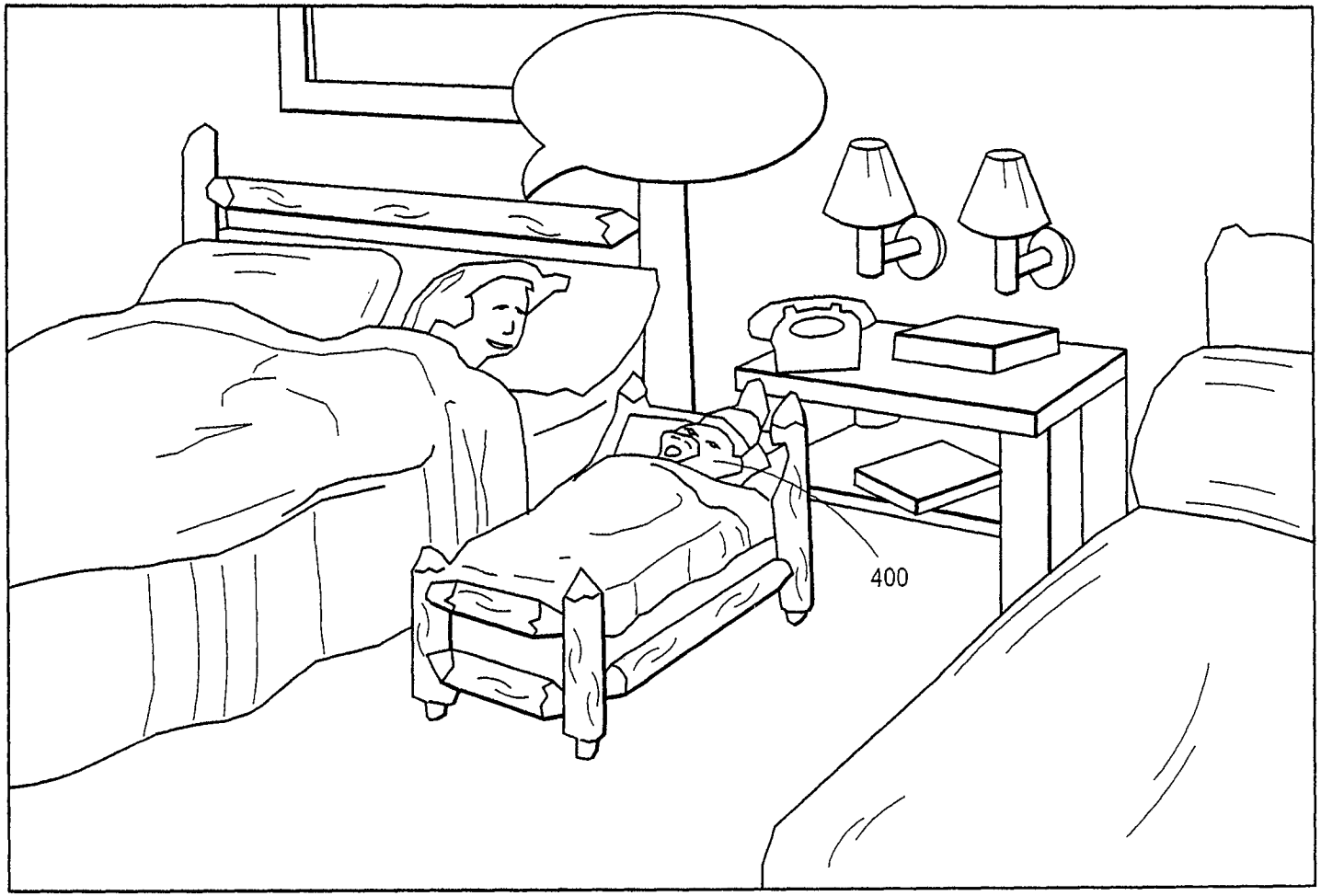
Figure 18:
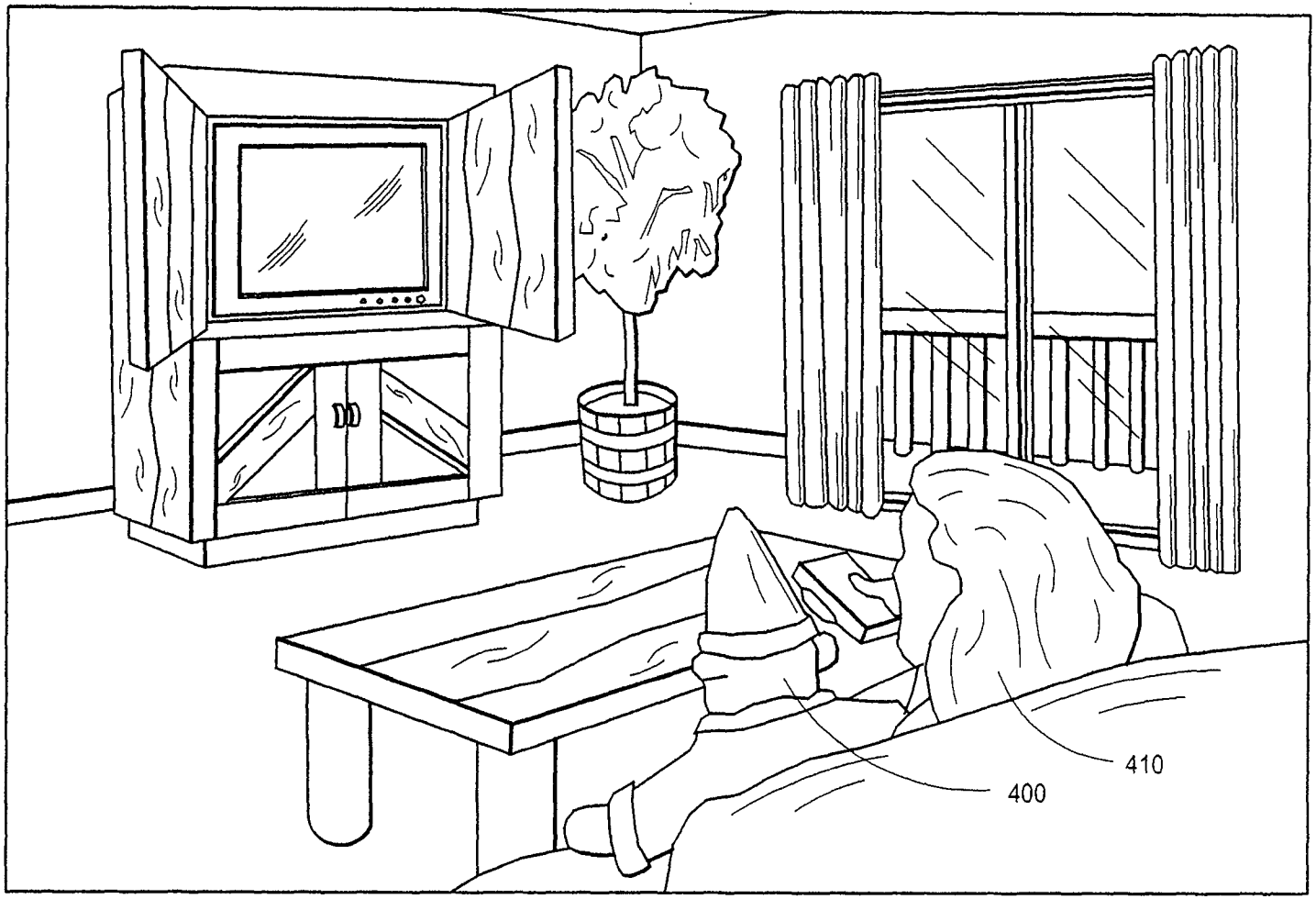

Throughout the resort are magic moments in which the bear will either set off a special effect, be asked to conduct a magic trick, take part in a photo opportunity, a story, event, party, game, etc. For example, as the guest walks down a hallway of the resort, pictures magically light up with magical images that address and speak to the bear (FIG. 16). In addition each of the guests staying at the hotel are given a room that has a special bed, telephone and toiletries for the bear. The room is also equipped and linked to the master system for special wake-up calls and magic tricks (FIGS. 17-18).

Figure 19:
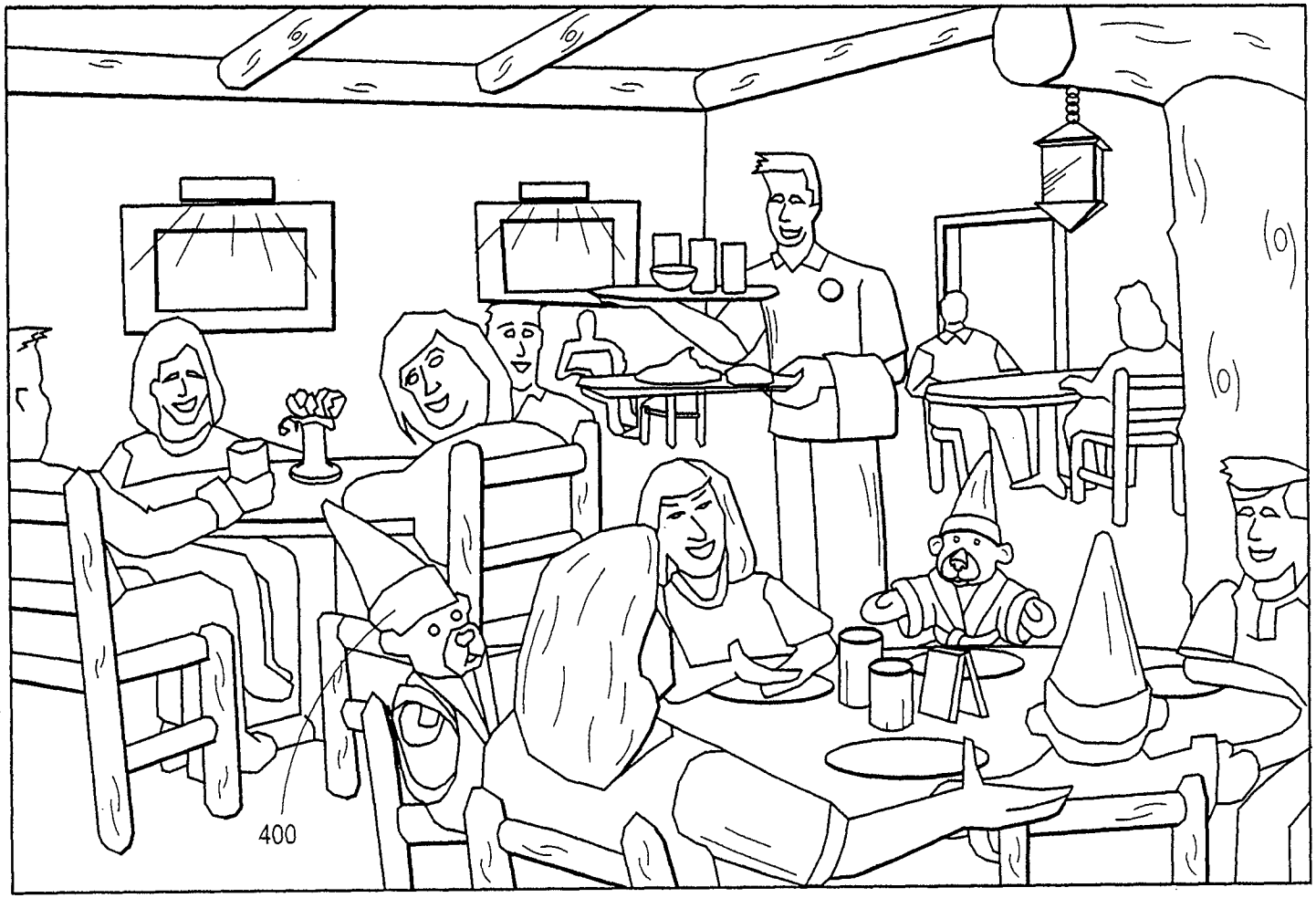
Figure 20:
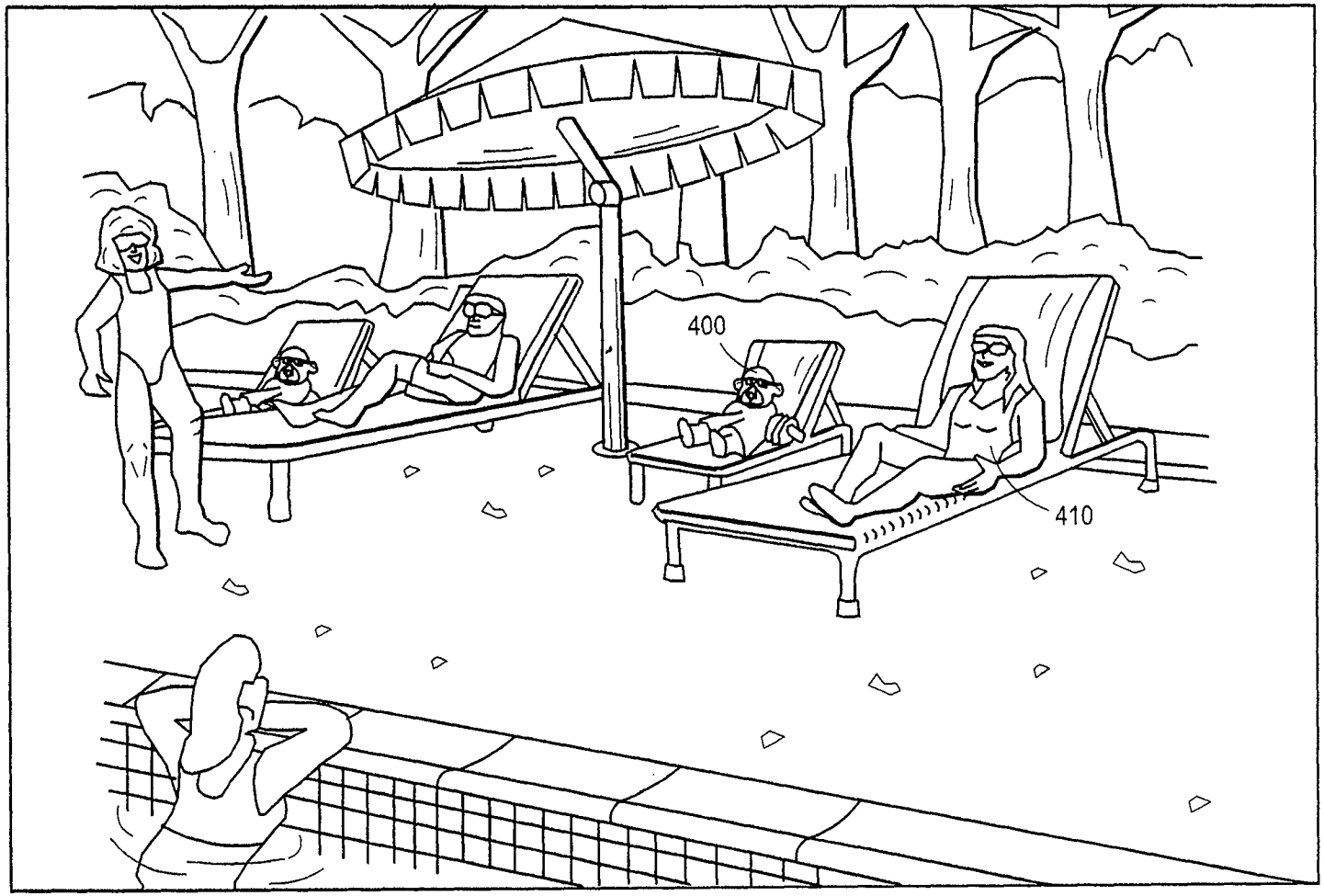
Figure 21:
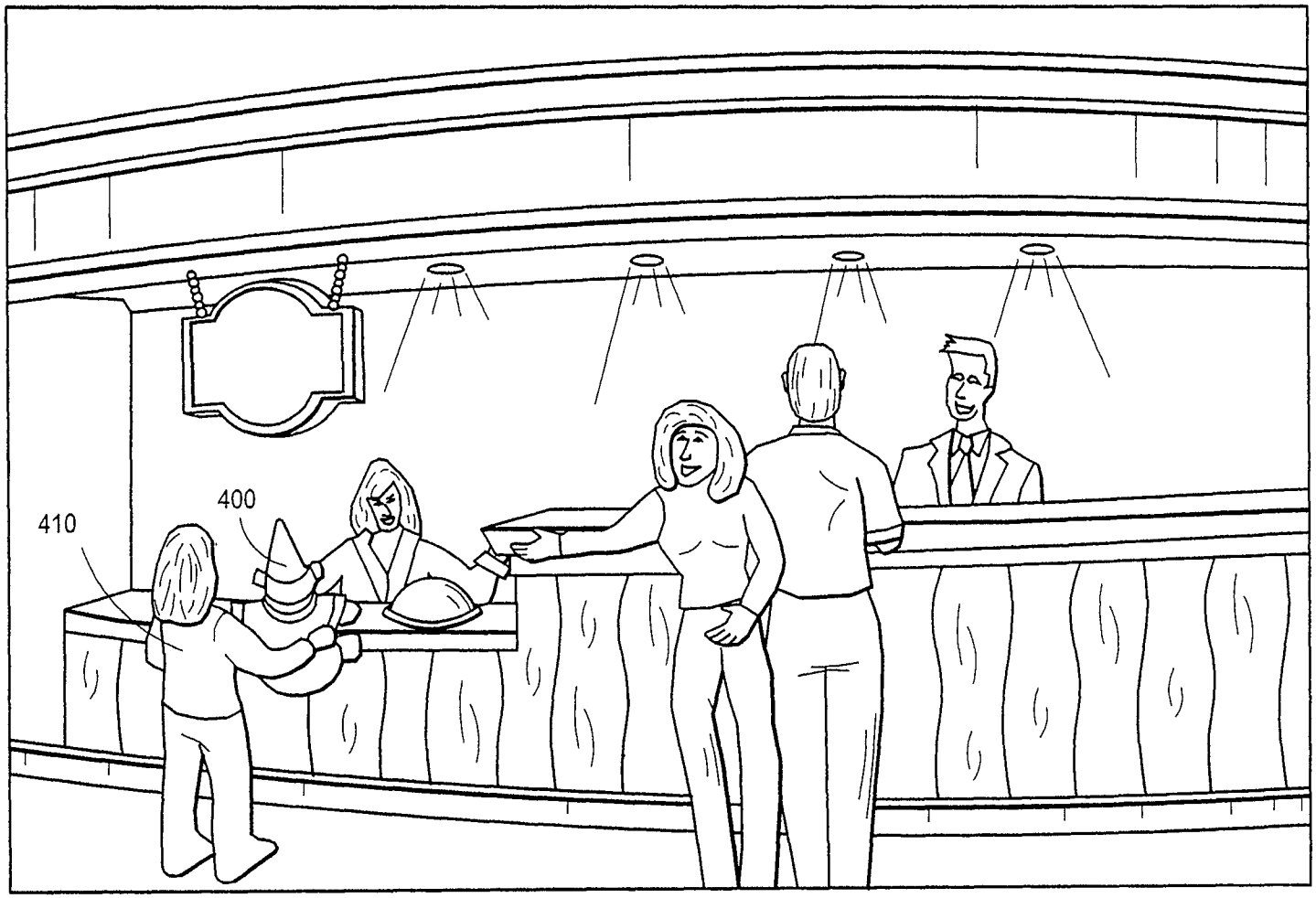

Other areas of the resort cater to the magic bear and the guest. The restaurant would have special seating for bears, a menu and special effects (FIG. 19). This would hold true for the pool with small lounge chairs for bears, a concierge desk for the bears and daily events for human and bear mates (FIGS. 20-21).

Figure 22:
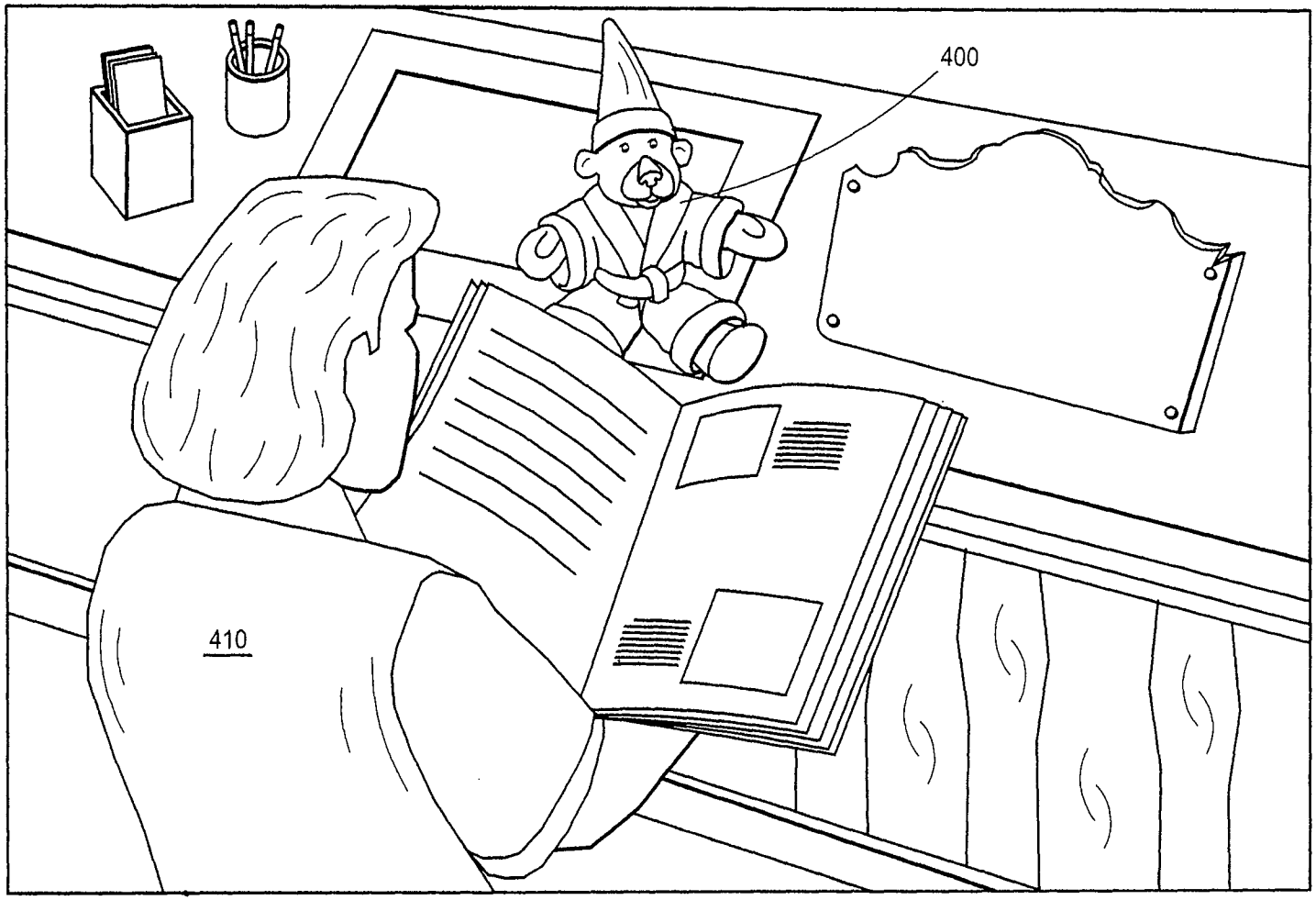
Figure 23:
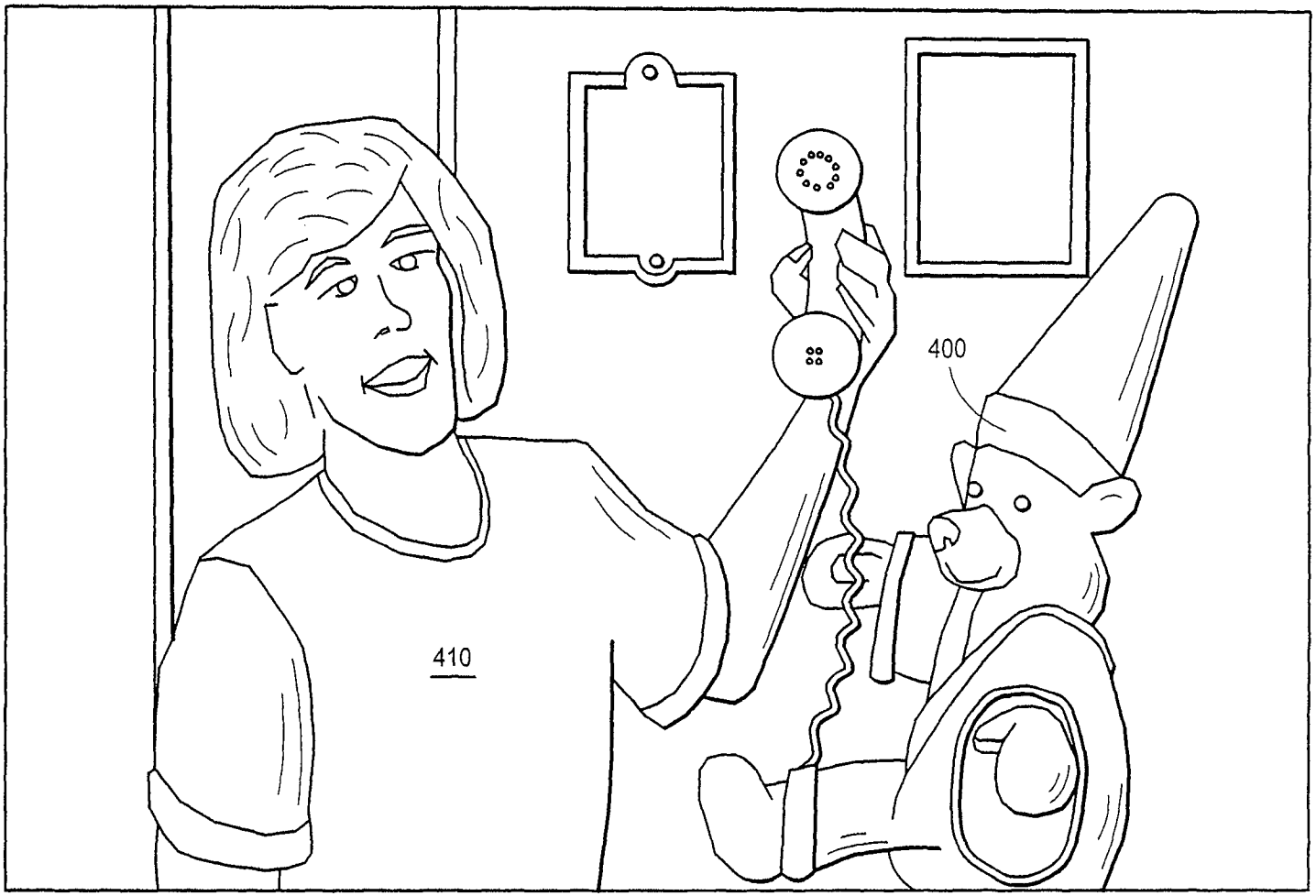

Overall, a magical story is created by tracking the guest and his or her bear throughout their stay. It will turn their events (their magical journey, when they go to dinner, play in the waterplay area, etc) at the resort into an imaginative story and give them a special book that recorded their memorable experiences. It is possible to include photo capturing or designated specific points as "photo-op" for their storybook. At check out the bear and its owner are presented with a printed photo-scrapbook 490 of their magical experience at the resort (FIG. 22). Other possibilities for continuing magic include:

- Visits to other facilities to increase magic skills and reach new levels
- Special events and festivals for the bear to attend
- New magic levels the bear must obtain in order for it to reach its fullest potential
- Catalogs with new clothing to purchase
- Magic can also come to the home through telephone calls, Internet, etc.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive entertainment system for amusing or entertaining one or more play participants as part of an interactive entertainment experience, said interactive entertainment system comprising:

a plurality of toy characters, each said toy character comprising:

a stuffed-animal, doll or action figure comprising a body having an inner portion and an outer portion;

a first wirelessly-powered radio frequency identification (RFID) tag provided on or within said body at a first location;

a second wirelessly-powered RFID tag provided on or within said body at a second location that is different than said first location, wherein each of said first and second wirelessly-powered RFID tags comprises:

a unique identification number;

a microprocessor;

non-volatile programmable memory configured to store selected information associated with each said corresponding toy character; and a radio frequency (RF) transceiver configured to facilitate two-way wireless communication with one or more compatible RFID reader devices; and at least one RFID reader device configured to wirelessly power and communicate with each of said first and second RFID tags at least in part through inductive coupling and wherein said wireless communication communicates at least said corresponding unique identification number and said selected information, wherein said at least one RFID reader device is further configured to communicate at least said corresponding unique identification number or said selected information to a game control system configured to actuate one or more interactive effects based at least in part on said corresponding unique identification number or said selected information.

2. The interactive entertainment system of claim 1, wherein each said toy character is configured to be used in an electronic role play game played by said one or more play participants wherein said toy character represents a role play character in said game and wherein said selected information comprises at least one of character attributes, progress, powers, skills, abilities, rank, points, or achievements for each corresponding toy character in said game.

3. The interactive entertainment system of claim 2, wherein said selected information further comprises a unique player identification number uniquely identifying a play participant in said game as a purchaser or owner of said toy character.

4. The interactive entertainment system of claim 1, wherein said at least one RFID reader device comprises a plurality of RFID reader devices and wherein said game control system comprises a host computer or server configured to communicate with said plurality of RFID reader devices.

5. The interactive entertainment system of claim 1, wherein at least one of said plurality of toy characters comprises a body in the form of a person, character or animal having one or more body parts or appendages and/or one or more clothing, jewelry or accessory items configured to be assembled with or inserted into the body of said toy character such that said at least one toy character can be personalized or customized according to the particular desires of a play participant.

6. The interactive entertainment system of claim 5, wherein said body parts or appendages comprise one or more hands, feet, head or belly and wherein said first or second RFID tag is provided in or on one or more of said body parts or appendages.

7. The interactive entertainment system of claim 5, wherein said first or second RFID tag is provided in or on said one or more clothing, jewelry or accessory items.

8. The interactive entertainment system of claim 1, wherein said first and second RFID tags are provided within said inner portion of said body and configured to wirelessly communicate said selected information without removal or exposure of said first and second RFID tags.

9. The interactive entertainment system of claim 1, wherein said game control system is configured to actuate said one or more interactive effects based at least in part on said communicated selected information.

10. The interactive entertainment system of claim 1, further comprising an image capture and retrieval system configured to automatically capture and store digital images of each toy character and/or a corresponding play participant.

11. The interactive entertainment system of claim 10, wherein said image capture and retrieval system is further configured to store each said captured image in association with a corresponding unique identification number such that said captured images may be subsequently retrieved according to said corresponding unique identification number.

12. The interactive entertainment system of claim 11, wherein said image capture system is further configured to produce a story book or scrap book comprising multiple captured images of each toy character and/or a corresponding play participant based at least in part on said corresponding unique identification number.

13. A wireless interactive toy configured to be accessorized or customized by a play participant as part of an interactive game or entertainment experience, said toy comprising:

a body in the form of a stuffed animal, doll or action figure;

one or more accessory items configured to be selectively assembled with or inserted into said body;

a first wirelessly-powered RFID tag affixed to or contained within said body and configured to uniquely and wirelessly identify said toy, said first RFID tag comprising:

i) non-volatile programmable memory configured to store selected information relevant to said toy, said play participant or a game played by said play participant using said toy, ii) an RF transceiver configured to facilitate two-way wireless communication with one or more compatible RFID reader devices, iii) a microprocessor, and iv) an antenna configured to wirelessly receive energy through inductive coupling with an externally applied electromagnetic field for wirelessly powering at least said microprocessor and said RF transceiver; and a second wirelessly-powered RFID tag affixed to or contained within said body or said one or more accessory items, said second RFID tag comprising:

i) non-volatile memory, ii) an RF transceiver, iii) a microprocessor; and iv) an antenna.

14. The wireless interactive toy of claim 13, wherein said body further comprises one or more body parts or appendages comprising one or more hands, feet, head or belly and wherein said first and second RFID tags are provided in or on one or more of said body parts or appendages.

15. The wireless interactive toy of claim 13, wherein said second RFID tag is provided in or on said one or more accessory items.

16. The wireless interactive toy of claim 15, wherein at least one of said one or more accessory items comprises a molded plastic substrate shaped in the form of a medallion and configured to hold and support said second RFID tag.

17. The wireless interactive toy of claim 13, wherein said toy is configured to be used in an electronic role play game played by said play participant, wherein said toy represents a character in said game, and wherein said selected information comprises character attributes, progress, powers, skills, abilities, rank, points, and/or achievements in said game.

18. The wireless interactive toy of claim 17, wherein said selected information further comprises a unique player identification number uniquely identifying said play participant in said game as a purchaser or owner of said toy.

19. The wireless interactive toy of claim 13, wherein said first or second RFID tag comprises a 13.56 MHz passive RFID tag comprising a unique identification number.

20. The wireless interactive toy of claim 13, in combination with an interactive game for amusing or entertaining one or more play participants, said combination comprising:

a plurality of said wireless interactive toys configured for use in said interactive game;

at least one RFID reader device configured to wirelessly power and communicate with each said RFID tag associated with each said corresponding toy and wherein said wireless communication communicates at least a unique identification number uniquely identifying each said toy; and a computing device configured to communicate with said at least one RFID reader device, to identify or track each said toy through said wireless communication, and to actuate one or more game effects based at least in part on information communicated through said wireless communication.

21. The combination of claim 20, wherein each said toy represents a role play character in said interactive game and wherein said selected information comprises character attributes, progress, powers, skills, abilities, rank, points, and/or achievements of said role play character in said game.

22. The combination of claim 21, wherein said wireless communication further comprises said selected information stored on said RFID tag and wherein said computing device is configured to selectively actuate said one or more game effects based on said selected information communicated by said RFID tag to said RFID reader device.

23. The combination of claim 20, wherein each said toy represents a character in said interactive game and wherein said selected information comprises a unique player identification number uniquely identifying a play participant in said game as a purchaser or owner of a corresponding toy.

24. The combination of claim 20, wherein said at least one RFID reader device comprises a plurality of RFID reader devices and wherein said computing device further comprises an interactive game control system configured to communicate with said plurality of RFID reader devices.

25. The combination of claim 20, further comprising an image capture and retrieval system configured to automatically capture and store digital images of each toy and/or a corresponding play participant.

26. The combination of claim 25, wherein said image capture and retrieval system is further configured to store each said captured image in association with said corresponding unique identification number such that said captured images may be subsequently retrieved according to said corresponding unique identification number.

27. The combination of claim 26, wherein said image capture system is further configured to assemble and produce a story book or scrap book comprising multiple captured images of each toy and/or a corresponding play participant based at least in part on said corresponding unique identification number.

28. The wireless interactive toy of claim 13, further comprising an LED indicator configured to illuminate when said at least one toy is within proximity of a compatible RFID reader device.

29. An interactive entertainment system for amusing or entertaining one or more play participants as part of an interactive entertainment experience, said interactive entertainment system comprising:

a plurality of wireless interactive toys, each said toy comprising a stuffed-animal, doll or action figure configured to be accessorized or customized by a play participant as part of a wireless interactive game or entertainment experience, each said toy further comprising:

a first RFID tag disposed in or on said toy and comprising a unique identification number uniquely identifying said toy, said first RFID tag further comprising:

i) non-volatile programmable memory configured to store, retrieve and update a first selection of game-relevant information, ii) a tag antenna sized and configured to be selectively energized by an externally produced electromagnetic field to thereby power said first RFID tag; and iii) an RF transceiver electrically coupled to said tag antenna and configured to wirelessly transmit and receive RF signals comprising at least said unique identification number and said first selection of game-relevant information; and at least one accessory item configured to be selectively and detachably assembled with said stuffed-animal, doll or action figure and comprising a second RFID tag, said second RFID tag comprising:

i) non-volatile memory configured to store a second selection of game-relevant information, ii) a tag antenna sized and configured to be selectively energized by an externally produced electromagnetic field to thereby power said second RFID tag; and iii) an RF transceiver electrically coupled to said tag antenna and configured to wirelessly transmit and receive RF signals comprising at least said second selection of game-relevant information; and at least one RFID reader/writer device configured to wirelessly power and communicate with each said first and second RFID tag through inductive coupling to wirelessly ascertain said unique identification number and said first and second selections of game-relevant information, and wherein said at least one RFID reader/writer device is further configured to communicate at least said first and second selections of game-relevant information to an associated game control system.

30. The interactive entertainment system of claim 29, in combination with a game control system configured to communicate with said at least one RFID reader/writer device and wherein said game control system is further configured to trigger or actuate one or more game effects based at least in part on said first or section selections of game-relevant information.

31. The interactive entertainment system of claim 30, wherein said at least one RFID reader/writer device comprises a plurality of RFID reader/writer devices configured to communicate with said game control system.

32. The interactive entertainment system of claim 31, wherein said game control system is configured to track each of said plurality of wireless interactive toys through wireless communications using each said corresponding unique identification number.

33. The interactive entertainment system of claim 32, wherein said first selection of game-relevant information comprises selected progress information associated with each corresponding toy and wherein said game control system is further configured to selectively actuate said one or more game effects based at least in part on said selected progress information associated with each corresponding toy.

34. The interactive entertainment system of claim 29, wherein each said toy is configured to be used in an electronic role play game played by said one or more play participants, wherein each said toy represents a role play character in said game, and wherein said first selection of game-relevant information comprises at least one of character attributes, progress, powers, skills, abilities, rank, points, and/or achievements of each said toy in said game.

35. The interactive entertainment system of claim 29, wherein said first selection of game-relevant information comprises a unique player identification number identifying a play participant in said game as a purchaser or owner of a corresponding toy.

36. The interactive entertainment system of claim 29, wherein said first or second RFID tag comprises a 13.56 MHz passive read/write RFID tag.

37. The interactive entertainment system of claim 29, wherein at least one of said plurality of wireless interactive toys comprises a main body in the form of a person, character or animal, and wherein said at least one accessory item comprises an item of clothing, jewelry or a body part configured to be worn by or inserted into said main body.

38. The interactive entertainment system of claim 37, wherein said at least one accessory item comprises a heart-shaped item symbolizing or representing the heart of said toy and configured to be inserted into said main body and wherein said first or second RFID tag is embodied or contained within said heart-shaped item.

39. The interactive entertainment system of claim 37, wherein said at least one accessory item comprises a hat, wand or medallion.

40. The interactive entertainment system of claim 37, wherein said first RFID tag is disposed on or in said main body at a first location and wherein said second RFID tag is disposed on or in said main body at a second location and wherein said second location is different than said first location.

41. The interactive entertainment system of claim 29, further comprising a digital camera configured to capture and store one or more digital images of each toy in association with said corresponding unique identification number such that said captured images may be subsequently retrieved according to said corresponding unique identification number.

42. The interactive entertainment system of claim 41, further comprising an image processing system configured to assemble and produce a story book or scrap book comprising multiple captured images of each toy based at least in part on said corresponding unique identification number.

43. The interactive entertainment system of claim 29, wherein at least one of said plurality of wireless interactive toys further comprises an LED indicator configured to illuminate when said at least one toy is within proximity of said at least one RFID reader/writer device.

44. A wireless interactive game for amusing or entertaining one or more play participants, comprising:

a plurality of wireless interactive toys, each depicting or representing a character relevant to said interactive game, and comprising a first RFID tag permanently associated with each said corresponding toy, said first RFID tag comprising: i) a unique identification number uniquely identifying said corresponding toy, and ii) non-volatile memory configured to store a first selection of game-relevant information;

a plurality of accessory items, each configured to be selectively and detachably assembled with at least one of said plurality of wireless interactive toys, and comprising a second RFID tag permanently associated with each said corresponding accessory item, said second RFID tag comprising non-volatile memory configured to store a second selection of game-relevant information;

each said first and second RFID tags further comprising:

i) a tag antenna sized and configured to be selectively energized by an externally produced electromagnetic field to thereby power each said RFID tag; and ii) an RF transceiver electrically coupled to said tag antenna and configured to wirelessly transmit and receive RF signals comprising at least said corresponding first or second selections of game-relevant information; and at least one RFID reader device configured to wirelessly power and communicate with each said first and second RFID tags and to ascertain said first and second selections of game-relevant information, and wherein said at least one RFID reader device is further configured to communicate said first and second selections of game-relevant information to an associated game control system.

45. The wireless interactive game of claim 44, wherein said non-volatile memory of said first or second RFID tag comprises programmable non-volatile memory configured to store, retrieve and update said corresponding first or second selections of game-relevant information.

46. The wireless interactive game of claim 44, wherein said interactive game comprises an interactive role play game wherein each said toy represents a particular character in said game and wherein said first selection of game-relevant information comprises at least one of character attributes, progress, powers, skills, abilities, rank, points, or achievements of said particular character in said interactive role play game.

47. The wireless interactive game of claim 46, wherein said first selection of game-relevant information further comprises a unique player identification number identifying a particular play participant in said game as an owner of said corresponding toy.

48. The wireless interactive game of claim 44, wherein said first or second RFID tag comprises a 13.56 MHz passive read/write RFID tag.

49. The wireless interactive game of claim 44, wherein at least one of said plurality of wireless interactive toys comprises a stuffed animal, doll or action figure comprising a body in the form of a person, character or animal.

50. The wireless interactive game of claim 44, wherein at least one of said plurality of accessory items comprises a medallion-shaped or heart-shaped item and wherein said second RFID tag is embodied or contained within said medallion-shaped or heart-shaped item.

51. The wireless interactive game of claim 44, wherein said at least one RFID reader device comprises a plurality of RFID reader devices each configured to communicate with an associated interactive game control system.

52. The wireless interactive game of claim 44, further comprising a digital camera configured to capture and store one or more digital images of each toy in association with said corresponding unique identification number such that said captured images may be subsequently retrieved according to said corresponding unique identification number.

53. The wireless interactive game of claim 44, further comprising an image processing system configured to assemble and produce a story book comprising multiple captured images of each toy based at least in part on said corresponding unique identification number.

54. The wireless interactive game of claim 44, wherein at least one of said plurality of wireless interactive toys further comprises an LED indicator configured to illuminate when said at least one toy is within proximity of said at least one RFID reader device 55. The wireless interactive game of claim 44 in combination with an interactive game control system configured to trigger or actuate one or more interactive effects based on said communicated first or second selections of game-relevant information.

56. The combination of claim 55 wherein said interactive game control system is further configured to track each of said plurality of wireless interactive toys using each said corresponding unique identification number wirelessly communicated through said transmitted RF signals.

* * * * *